US012220100B2

(12) United States Patent
Lv et al.

(10) Patent No.: US 12,220,100 B2
(45) Date of Patent: Feb. 11, 2025

(54) DOCKING STATION AND CLEANING SYSTEM

(71) Applicant: Dreame Innovation Technology (Suzhou) Co., Ltd., Suzhou (CN)

(72) Inventors: Xiaoming Lv, Suzhou (CN); Dong Li, Suzhou (CN); Jinlong Xue, Suzhou (CN); Ruqian Hu, Suzhou (CN); Shaohan Luo, Suzhou (CN); Mengda He, Suzhou (CN); Tianhong Zhang, Suzhou (CN); Chuncheng Chen, Suzhou (CN); Huichao Li, Suzhou (CN)

(73) Assignee: Dreame Innovation Technology (Suzhou) Co., Ltd., Suzhou (CN)

( * ) Notice: Subject to any disclaimer, the term of this patent is extended or adjusted under 35 U.S.C. 154(b) by 0 days.

(21) Appl. No.: 18/656,445

(22) Filed: May 6, 2024

(65) Prior Publication Data

US 2024/0358207 A1 Oct. 31, 2024

Related U.S. Application Data

(63) Continuation of application No. PCT/CN2023/119229, filed on Sep. 15, 2023.

(30) Foreign Application Priority Data

Apr. 28, 2023 (CN) ..... 202310484553.8
Apr. 28, 2023 (CN) ..... 202310485465.X

(51) Int. Cl.
*A47L 9/00* (2006.01)
*A47L 5/14* (2006.01)
(Continued)

(52) U.S. Cl.
CPC ..... *A47L 9/0063* (2013.01); *A47L 5/14* (2013.01); *A47L 7/0019* (2013.01);
(Continued)

(58) Field of Classification Search
CPC ..... A47L 9/0063; A47L 5/14; A47L 7/0019; A47L 7/0023; A47L 9/28; A47L 2201/024; A47L 2201/026
See application file for complete search history.

(56) References Cited

U.S. PATENT DOCUMENTS

2021/0393098 A1* 12/2021 Pan ..... A47L 9/2873
2022/0304539 A1 9/2022 Zheng

FOREIGN PATENT DOCUMENTS

CN 109091084 A 12/2018
CN 210826782 U 6/2020
(Continued)

OTHER PUBLICATIONS

CN217907598 U; Nov. 2022; Chen et al. (Year: 2022).*
(Continued)

*Primary Examiner* — David Redding

(57) ABSTRACT

The present disclosure provides a docking station and a cleaning system, where the docking station includes: at least one accommodating chamber, and a docking chamber for docking of a self-moving cleaning apparatus; and a height of the docking station is less than 350 mm. The docking station in the embodiments of the present disclosure has a smaller height and can be placed in a low space, improving adaptability of the docking station. Moreover, the integrated box is movable, and if the integrated box is placed in an embedded mode, replacement of consumables is realized by moving the integrated box, without the need to move the docking station out of the embedded space, thereby making the replacement of consumables to be more convenient.

20 Claims, 34 Drawing Sheets

(51) Int. Cl.
*A47L 7/00* (2006.01)
*A47L 9/28* (2006.01)

(52) U.S. Cl.
CPC ..... *A47L 7/0023* (2013.01); *A47L 9/28* (2013.01); *A47L 2201/024* (2013.01); *A47L 2201/026* (2013.01)

(56) References Cited

FOREIGN PATENT DOCUMENTS

| | | | | |
|---|---|---|---|---|
| CN | 113545718 | A | | 10/2021 |
| CN | 215227247 | U | | 12/2021 |
| CN | 114767010 | A | | 7/2022 |
| CN | 11483280 | A | * | 9/2022 |
| CN | 217408731 | U | | 9/2022 |
| CN | 217907598 | U | | 11/2022 |
| CN | 218026782 | U | | 12/2022 |
| CN | 218419703 | U | | 2/2023 |
| CN | 218500623 | U | | 2/2023 |
| DE | 202016104069 | U1 | * | 10/2017 |
| JP | H07313419 | A | | 12/1995 |
| WO | WO2022032640 | A1 | | 2/2022 |
| WO | WO2022052384 | A1 | | 3/2022 |

OTHER PUBLICATIONS

International Search Report dated Dec. 14, 2023 for International Application No. PCT/CN2023/119229.
Search and Examination Report dated Oct. 11, 2024 regarding Application No. GB2405717.6.
Search and Examination Report dated Nov. 26, 2024 regarding Application No. GB2405717.6.

* cited by examiner

DOCKING STATION AND CLEANING SYSTEM

This application is a continuation of International Application No. PCT/CN2023/119229, filed on Sep. 15, 2023, which claims priority to Chinese patent application No. 202310484553.8, filed on Apr. 28, 2023 and Chinese patent application No. 202310485465.X, filed on Apr. 28, 2023, all of which are hereby incorporated by reference in their entireties.

TECHNICAL FIELD

The present disclosure relates to the technical field of cleaning apparatus, and in particular to a docking station and a cleaning system.

BACKGROUND

Upon receiving a cleaning instruction, a self-moving cleaning apparatus can move on a surface to be cleaned and collect the dirt on the surface to be cleaned to complete the cleaning work. The automatic cleaning mode of the self-moving cleaning apparatus can reduce or even replace manual cleaning work. When a cleaning task is completed or other conditions are satisfied, the self-moving cleaning apparatus will return to a docking station, which may perform corresponding maintenance operations on the self-moving cleaning apparatus, for example, charging, dust collection, etc.

When the docking station is placed in an embedded mode, it needs to be removed from the space in which it is embedded before the consumables can be replaced. When the consumables for the docking station are replaced, replacement of consumables is usually done from the top of the docking station, and the docking station is tall, which requires sufficient vertical operating space above the docking station. Therefore, a current docking station is not only inconvenient to replace consumables, but also has poor adaptability, which cannot be installed in low-rise spaces, for example, the docking station cannot be installed underneath a cupboard, a basin cabinet, a balcony cabinet, etc.

SUMMARY

Embodiments of the present disclosure provide a docking station and a cleaning system.

According to embodiments of a first aspect of the present disclosure, a docking station is provided, and the docking station includes: at least one accommodating chamber, and a docking chamber for docking of a self-moving cleaning apparatus;

a height of the docking station is less than 350 mm; at least a part of space of the accommodating chamber is located above the docking chamber, or, at least a part of space of the accommodating chamber is located at a side of the docking chamber.

In one embodiment, a ratio of a height of the docking chamber to the height of the docking station is: 1/1.5 to 1/3.5.

In one embodiment, the docking station includes:

a station body having the accommodating chamber and the docking chamber;

where the accommodating chamber has a functional space, and the functional space includes at least two of following spaces: a dust collection space, a dirty-water storage space, and a cleaning agent storage space;

where a configuration of the spaces included in the functional space is any one of following modes:

all the spaces included in the functional space are horizontally arranged side by side above the docking chamber; or all the spaces included in the functional space are horizontally arranged side by side at a side of the docking chamber; or among all the spaces included in the functional space, one part of the spaces included in the functional space are horizontally arranged side by side above the docking chamber, and the other part of the spaces included in the functional space are horizontally arranged side by side at the side of the docking chamber.

In one embodiment, a chamber wall of the functional space forms an integrated box;

the station body further includes: an avoidance opening connected with the accommodating chamber, where the avoidance opening is configured for passage of the integrated box; and the integrated box is movable at least between a first position and a second position relative to the station body in a first direction, where the first direction is approximately parallel to a plane where a top wall of the station body is located, and/or the first direction is approximately parallel to a direction in which the self-moving cleaning apparatus enters and exits the docking station.

In one embodiment, when the integrated box is in the first position, the functional space is located inside the accommodating chamber; and when the integrated box is in the second position, the functional space is located outside the accommodating chamber and the functional space is exposed to an external environment.

In one embodiment, the docking station further includes:

a moving assembly, where the moving assembly is connected to the integrated box, and the moving assembly is configured to: drive the integrated box to be switched at least between the first position and the second position.

In one embodiment, the integrated box includes:

a functional module, where the functional module is detachably mounted in the functional space, and the functional module includes at least one of: a dust collection box located in the dust collection space, a dirty-water tank located in the dirty-water storage space, and a cleaning agent tank located in the cleaning agent storage space.

In one embodiment, the docking station further includes: a lifting assembly, and/or, a rotation assembly;

the lifting assembly is configured to: drive the functional module into and out of the functional space; and the rotation assembly is configured to: drive the integrated box to swing relative to the station body.

According to embodiments of a second aspect of the present disclosure, a docking station is provided, where the docking station includes:

a station body, where the station body includes at least one accommodating chamber, the accommodating chamber having a functional space, and a chamber wall of the functional space forms an integrated box;

the station body further includes: an avoidance opening for passage of the integrated box, and a docking chamber for docking of a self-moving cleaning apparatus; where the integrated box is movable between a first position and a second position relative to the station body; and at least one transfer tube, where the transfer tube is configured to: convey fluid to or out of the functional space; one end of the transfer tube is fixed to the integrated box and the transfer tube is driven by the integrated box to move.

In one embodiment, the functional space includes at least two of the following: a dust collection space, a dirty-water storage space, and a cleaning agent storage space, where a configuration of spaces included in the functional space is any one of the following modes:

all the spaces included in the functional space are horizontally arranged side by side above the docking chamber; or all the spaces included in the functional space are horizontally arranged side by side at a side of the docking chamber; or among all the spaces included in the functional space, one part of the spaces included in the functional space are horizontally arranged side by side above the docking chamber, and the other part of the spaces included in the functional space are horizontally arranged side by side at the side of the docking chamber.

In one embodiment, the transfer tube includes at least one of the following:

a waste inlet tube for passage of dirty-water flowing to the dirty-water storage space;

a waste discharge tube for passage of dirty-water flowing out of the dirty-water storage space;

a cleaning agent conveying tube for passage of a cleaning agent flowing out of the cleaning agent storage space; and a dust collection tube for passage of airflow to the dust collection space.

In one embodiment, an inner wall of the docking chamber further has an air blowing port and a dust collection port which are spaced apart;

the docking station further includes: a dust collection fan providing suction for dust collection, an air blowing tube for communicating the air blowing port with the dust collection fan; where the dust collection tube is configured for communicating the dust collection space with the dust collection port; and the dust collection tube includes: a first tube and a second tube, where the first tube is connected to the station body and connected with the dust collection port; and the second tube is connected to the integrated box and connected with the dust collection space, the first tube and the second tube moving relative to each other.

In one embodiment, one end of the waste inlet tube is fixed to the integrated box and connected with a waste inlet port of the dirty-water storage space, the waste inlet tube moving with the movement of the integrated box; or the docking station further includes: a connecting tube, where the connecting tube is connected to the integrated box and connected with the dirty-water storage space, and the waste inlet tube is connected with the connecting tube, the waste inlet tube and the connecting tube moving relative to each other.

In one embodiment, the docking station further includes:

a waste discharge pump, where the waste discharge pump is mounted on a bottom wall of the integrated box, and the waste discharge pump moves with the movement of the integrated box, and is configured to: provide a driving force for discharging dirty-water from the dirty-water storage space.

In one embodiment, the waste discharge pump includes: a pump body and a liquid inlet port for passing liquid into the pump body; and the liquid inlet port is connected to the bottom wall of the integrated box and is connected with the dirty-water storage space.

In one embodiment, the docking station further includes:

a liquid inlet tube, the liquid inlet tube being configured to: at least provide a cleaning liquid for cleaning a cleaning assembly of the self-moving cleaning apparatus;

a liquid inlet joint, where the liquid inlet joint is connected to the liquid inlet tube, and the liquid inlet joint is configured to: be connected with an external water source to convey a cleaning liquid from the external water source to the liquid inlet tube, the liquid inlet joint being rotatably connected to the liquid inlet tube; and/or the docking station further includes: a liquid outlet joint, where the liquid outlet joint is connected to the waste discharge tube, the waste discharge tube being configured for passage of dirty-water flowing out of the functional space, and the liquid outlet joint is configured for passage of dirty-water flowing out of the waste discharge tube, the liquid outlet joint being rotatably connected to the waste discharge tube.

In one embodiment, the docking station further includes:

a transit board, the transit board being connected to the station body;

a first wire, where one end of the first wire is connected to an electrical component fixed to the integrated box, and the other end of the first wire is connected to the transit board;

a second wire, the second wire being connected to the transit board and a main control module, respectively.

In one embodiment, the station body includes:

a housing, the housing having the accommodating chamber;

a base, where the base is detachably connected to the housing and located within the docking chamber, and the base has a cleaning groove.

In one embodiment, the station body further includes:

a latching assembly, where the latching assembly is connected to the base and the housing, respectively, and the latching assembly is configured to: lock a connection of the base to the housing, and unlock the connection of the base to the housing.

According to embodiments of a third aspect of the present disclosure, a cleaning system is provided, the cleaning system including: a self-moving cleaning apparatus, and the docking station as described in the embodiments of the first aspect or the embodiments of the second aspect.

The docking station in the embodiments of the present disclosure is lower in height and can be placed in a low-rise space, improving adaptability of the docking station. Moreover, the integrated box is movable, and if the integrated box is placed in an embedded mode, there is no need to move the docking station out of the embedded space. Replacement of consumables is realized by moving the integrated box, making the replacement of consumables to be more convenient.

BRIEF DESCRIPTION OF DRAWINGS

Drawings of specification, which form part of the present disclosure, are intended to provide a further understanding of the present disclosure, and illustrative embodiments of the present disclosure and descriptions thereof are used for explaining the present disclosure and do not constitute an improper limitation of the present disclosure. In the drawings.

Figure 1:
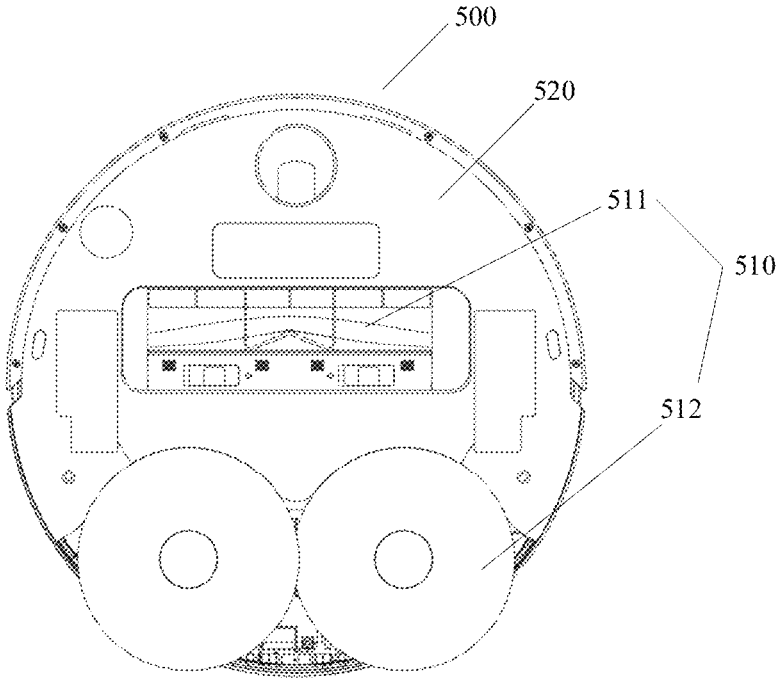
FIG. 1 shows a structure diagram of a self-moving cleaning apparatus provided by an embodiment of the present disclosure.

The above-mentioned drawings include following reference signs:

100, docking station; 101, air blowing tube; 101*a*, air hole; 110, station body; 102, mounting chamber; 103, second handle structure; 103*a*, handle; 103*b*, driving torsional spring; 104, groove; 104*a*, first limit groove; 104*b*, second limit groove; 105, dust collection module holder; 106, transit board; 107, first mounting groove; 107*a*, strong electric module; 108, second mounting groove; 108*a*, weak electric module; 109, third mounting groove; 110*a*, top wall of station body; 110*b*, tube catch groove; 110*c*, inner housing; 110*d*, outer housing; 110*e*, rear housing; 110*f*, left housing; 110*g*, right housing; 110*h*, upper housing; 110*i*, base plate; 110*j*, reinforcement plate; 111, docking chamber; 111*a*, air blowing port; 111*b*, dust collection port; 111*c*, cleaning groove; 112, accommodating chamber; 112*a*, avoidance opening; 113, housing of station body; 113*a*, fixed housing; 113*b*, door panel; 113*c*, movable cover; 113*d*, fourth mounting groove; 120, integrated box; 120*a*, dust collection box; 120*b*, dirty-water tank; 120*c*, cleaning agent tank; 120*d*, operation window; 120*e*, exterior decorative panel; 120*f*, functional cover; 120*g*, box body; 121, dust collection space; 121*a*, air outlet port; 122, dirty-water storage space; 122*a*, dirty-water level detector; 122*b*, detection probe; 123, cleaning agent storage space; 123*a*, float guiding groove; 124, functional space; 130, sliding rail assembly; 140, first handle structure; 141, self-tapping screw; 150, moving assembly; 151, first driving mechanism; 152, conveying belt; 153, connecting seat; 154, second drive shaft; 155, first in-position detector; 160, storage door; 170, dust collection fan; 171, shock-absorbing cushion; 172, first sealing element; 180, dust collection tube; 181, second tube; 182, first tube; 183, second sealing element; 191; connecting tube; 192, waste inlet tube; 193, third sealing element;

200, waste discharge pump; 200*a*, first check valve; 210, liquid inlet port; 230, liquid outlet port; and 240, joint pipe;

300, air pump; 310, waste discharge tube; 320, cleaning agent transfer tube; 330, transfer tube;

400, cleaning agent detector; 410, Hall sensing element; 420, magnetic float;

500, self-moving cleaning apparatus; 510, cleaning assembly; 511, rolling brush; 512, cleaning element;

600, clean water tank; 600*a*, second check valve; 600*b*, overflow hole; 600*c*, overflow pipeline; 600*d*, second check valve; 601, liquid pipeline joint; 602, three-way pipe; 603, three-way valve; 603*a*, replenishing pipeline; 604, four-way valve; 605, anti-siphon valve; 606, electromagnetic decompression integral valve; 610 water inlet port of clean water tank; 620, five-way valve; 620*a*, cleaning agent inlet port; 602*b*, cleaning liquid outlet port; 630, liquid inlet joint; 640, liquid outlet port; 650, temperature detection element; 660, heating module; 670, cleaning liquid transfer pump; 680, float valve;

700, base; 701, waste discharge butting tube; 702, insertion post; 703, light transmission sheet; 704, insertion hole; 705, avoidance hole; 710, latching assembly; 711, elastic element; 712, locking element; 713, roller; 720, pickup module; 730, interaction module; 740, mounting shaft; 750, liquid inlet tube; 770, cleaning agent transfer pump, 780, cleaning plate; 781, cleaning plate holder; 781*a*, shaft hole; 782, drive assembly; 783, rotation shaft; 784, filtering element;

1000, control device; 1100, first determination module; 1200, second determination module, 1300, a control module;

31, elastic torsional spring; 32, first driving gear; 33, first driven rack; 34, constraint element; 341, constraint groove;

40, rotation assembly; 41, first motor; 42, first gear; 43, first rack;

51, first fixed rail; 52, second fixed rail; 53, first movable rail; 54, second movable rail.

DESCRIPTION OF EMBODIMENTS

Technical solutions in the embodiments of the present disclosure will be clearly and completely described below in combination with the drawings in the embodiments of the present disclosure. Obviously, the described embodiments are only a part of the embodiments of the present disclosure, and not all of the embodiments. Actually, following descriptions of at least one exemplary embodiment are merely illustrative and in no way serve as any limitation on the present disclosure and application or use thereof. Based on the embodiments in the present disclosure, all other embodiments obtained by a person of ordinary skill in the art without creative labor fall within the protection scope of the present disclosure.

Figure 2:
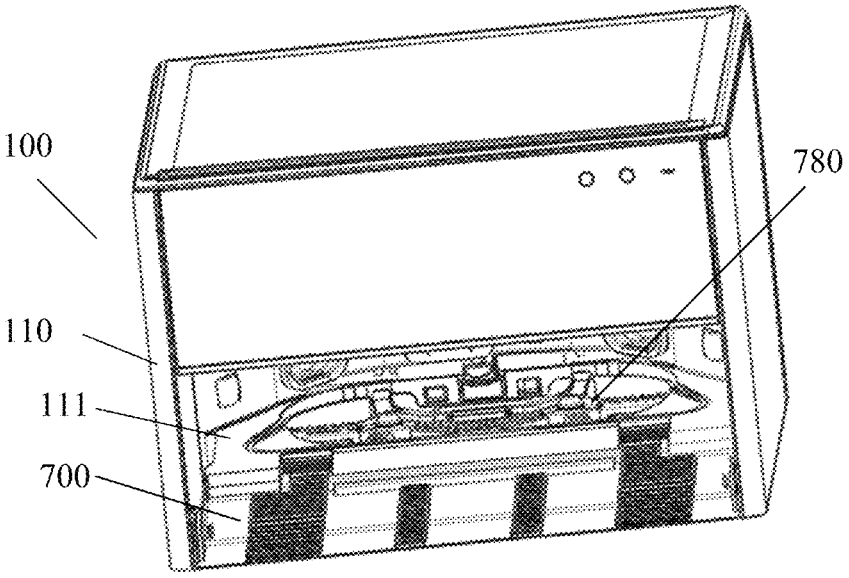
FIG. 2 shows a first structure diagram of a docking station provided by an embodiment of the present disclosure.

As shown in FIGS. 1 and 2, a cleaning system in an embodiment of the present disclosure includes a self-moving cleaning apparatus 500 and a docking station 100.

The self-moving cleaning apparatus 500 is an apparatus which automatically performs a cleaning operation in an area to be cleaned without user operation. When the self-moving cleaning apparatus 500 completes a cleaning task or in other circumstances where stopping the cleaning task is required, the self-moving cleaning apparatus 500 may return to the docking station 100 for operations, such as charging, and/or replenishing with water, and/or cleaning, and/or dust collection, etc.

As shown in FIG. 1, the self-moving cleaning apparatus 500 may include a machine body 520, and a sensing system, a control system, a driving system, a cleaning system, etc., which are provided on the machine body 520. The sensing system is configured to sense environmental information around the self-moving cleaning apparatus 500 and motion state information of the self-moving cleaning apparatus 500, and provide the information to the control system. The control system may draw an instant map of the environment where the self-moving cleaning apparatus 500 is located according to the information provided by the sensing system, and provide an action strategy for the self-moving cleaning apparatus 500 in combination with information such as a current motion state of the self-moving cleaning apparatus 500, etc. The driving system drives the self-moving cleaning apparatus 500 to move on a surface to be cleaned according to an instruction of the control system.

The self-moving cleaning apparatus 500 further includes a cleaning system, where the cleaning system may include a wet cleaning system and a dry cleaning system.

The dry cleaning system provided by an embodiment of the present disclosure may include a rolling brush 511, a dust bin, a fan, and an air outlet port. The rolling brush contacts the surface to be cleaned, sweeps up garbage on the surface to be cleaned and rolls it up to the front of a dust inlet air-duct, and then, under the negative pressure generated by the fan's pumping, the garbage enters into the dust bin from a dust suction port in front of the rolling brush via the dust inlet air-duct. The dry cleaning system may further include a side brush with a rotating shaft, the rotating shaft being at an angle with respect to the ground for moving debris into an area of the rolling brush 511 of the cleaning system. The rolling brush 511 may be a hair brush, a silicone brush, or a silicone-hair mixed brush.

The wet cleaning system may include: a cleaning assembly 510, a liquid conveying mechanism, a liquid storage tank, etc. The cleaning assembly 510 may be provided below the liquid storage tank, and a cleaning liquid inside the liquid storage tank is transferred to the cleaning assembly 510 through the liquid conveying mechanism, enabling the cleaning assembly 510 to perform wet cleaning on the surface to be cleaned. In other embodiments of the present disclosure, the cleaning liquid inside the liquid storage tank may also be sprayed directly onto the surface to be cleaned, and the cleaning assembly 510 realizes the cleaning of surface by applying the cleaning liquid evenly. It can be understood that the self-moving cleaning apparatus 500 is provided with a liquid filling port connected with the liquid storage tank, and by using the liquid filling port, the liquid outside the self-moving cleaning apparatus 500 can be replenished to the liquid storage tank to realize a liquid replenishment operation of the liquid storage tank.

The cleaning assembly 510 provided by an embodiment of the present disclosure includes a motion mechanism (not shown in the drawings) provided on the machine body 520 and a cleaning element 512, that is, the entire cleaning assembly 510 can be mounted on the machine body 520 through the motion mechanism, and the cleaning assembly 510 moves with the movement of the machine body 520 in order to realize a mopping function. The motion mechanism is configured to drive the cleaning element 512 to move, for example, the motion mechanism may drive the cleaning element 512 to go up and down; and the motion mechanism may also drive the cleaning element 512 to move, for example, reciprocating motion in horizontal, vertical, and other directions, as well as rotation, etc., so as to satisfy different functional requirements of the cleaning element 512. That is, it is possible to realize processing of differentiated strategy of the cleaning element 512, which improves cleaning performance of the self-moving cleaning apparatus, and improves its cleaning efficiency and usage experience. In a forward direction of the self-moving cleaning apparatus 100, the cleaning element 512 may be located at the rear of the rolling brush 511, and the material of the cleaning element 512 may usually be fabric, sponge, and other flexible substances with water-absorbing property.

When the self-moving cleaning apparatus 500 reaches specified cleaning time or specified cleaning area, the power of the self-moving cleaning apparatus is below a threshold, or the dirt in the dust bin of the self-moving cleaning apparatus 500 reaches a certain amount, etc., the self-moving cleaning apparatus 500 may return to the docking station 100 for corresponding maintenance.

If the maintenance of the self-moving cleaning apparatus 500 by the docking station 100 includes dust collection, the docking station 100 needs to be provided with a dust collection box and a dust collection channel is constructed between the dust collection box and the dust bin of the self-moving cleaning apparatus 500, thereby utilizing the dust collection channel to transfer the dirt inside the dust bin to the dust collection box so as to realize a dust collection function.

If the maintenance of the self-moving cleaning apparatus 500 by the docking station 100 includes washing besides the dust collection, a dirty-water tank **120*b*, a base 700, a liquid pipeline, and a waste discharge pipeline need to be added in the docking station in addition to the dust collection box. After returning to the docking station 100, the self-moving cleaning apparatus 500 is loaded on the base 700, and the base 700 is at least partially in contact with the cleaning element in the cleaning assembly 510. As shown in FIG. 2, the liquid pipeline transfers a cleaning liquid in a liquid supply source to a docking chamber 111 and wets the cleaning element 512 disposed in the docking chamber 111; and the cleaning element 512, driven by the motion mechanism, carries out actions such as rotating or swinging, etc., and the dirt on the cleaning element 512 may be scraped off through the contact between the base 700 and the cleaning element 512**, and the resulting dirt liquid is transferred to the dirty-water tank through the waste discharge pipeline.

Thus, as the functions of the docking station 100 are enriched, the structure of the docking station 100 becomes more and more complex, and the height of the docking station 100 becomes higher and higher, so that it is not possible to place the docking station 100 in a low-rise space. Moreover, in a current home scenario, it is not desirable for the docking station 100 to occupy a large space.

Figure 3:
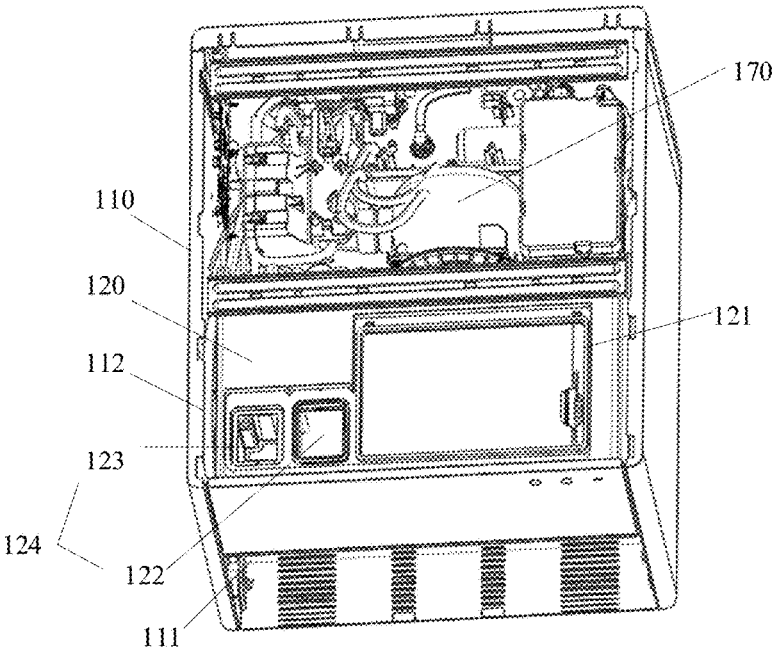
FIG. 3 shows a partial structure diagram of the docking station in FIG. 2.

As shown in FIGS. 2 and 3, the embodiments of the present disclosure provide a docking station 100, and the docking station 100 includes: a station body 110 and at least one integrated box 120, where the station body 110 has: an accommodating chamber 112 for accommodating the integrated box 120, and a docking chamber 111 for docking of the self-moving cleaning apparatus 500, the integrated box 120 has at least one of: a dust collection space 121, a dirty-water storage space 122, and a cleaning agent storage space 123, and the height of the docking station 100 is less than 350 mm.

In an embodiment of the present disclosure, the integrated box 120 may integrate one, two or even three spaces of the functional space 124 such as the dust collection space 121, the dirty-water storage space 122, and the cleaning agent storage space 123, etc. The greater the number of these spaces of the functional space 124 integrated in the integrated box 120, the more conducive it is to fully utilizing the space within the station body 110, and the more conducive it is to reducing the height of the docking station 100.

The functional space 124 within the integrated box 120 is not limited to the dust collection space 121, the dirty-water storage space 122, and the cleaning agent storage space 123. The functional space 124 may further include: a clean water storage space, a receiving space, and other spaces. The receiving space may be configured for receiving a cleaning brush, a cleaning rag, a dust bag, etc.

In one embodiment, the integrated box 120 is provided with three or more functional spaces 124.

The docking station 100 with a height of lower than 350 mm is lower in height, and then the docking station 100 can be placed in a low space. For example, the docking station 100 can be placed under a cupboard, a basin cabinet, a balcony cabinet, etc.

In one embodiment, the height of the docking station 100 is 300 mm to 350 mm. For example, the height of the docking station 100 is 300 mm, 305 mm, 310 mm, 315 mm, 320 mm, 325 mm, 330 mm, 335 mm, 340 mm, 345 mm, or 350 mm.

In one embodiment, the height of the docking station 100 is less than 300 mm, for example, the height of the docking station 100 is 280 mm, 290 mm, 295 mm, or 298 mm. Without limitation, in an embodiment of the present disclosure, the height of the docking chamber 111 is 100 mm to 200 mm. For example, the height of the docking chamber 111 may be 100 mm, 120 mm, 130 mm, 140 mm, 150 mm, 170 mm, or 180 mm, etc.

In one embodiment, a ratio of the height of the docking chamber 111 to the height of the integrated box 120 is: 1/0.55 to 1/2.5. For example, the height of the docking chamber 111 is a half of the height of the integrated box 120. Alternatively, the height of the docking chamber 111 is equal to the height of the integrated box 120.

In one embodiment, a ratio of the height of the docking chamber 111 to the overall height of the docking station 100 is: 1/1.5 to 1/3.5. For example, the ratio of the height of the docking chamber 111 to the overall height of the docking station 100 is: 1/2 to 1/2.8.

In one embodiment, the height of the docking chamber 111 is 140 mm, the height of the docking station 100 is 280 mm, and the ratio of the height of the docking chamber 111 to the height of the docking station 100 is approximately 0.5.

In an embodiment of the present disclosure, a chamber wall of the functional space 124 forms the integrated box 120. The integrated box 120 may be a part of the station body 110. For example, the accommodating chamber 112 in the station body 110 may be used as a functional space 124, or the accommodating chamber 124 may be separated into at least two functional spaces 124, where a chamber wall of the accommodating chamber 112 is the same as a chamber wall of the functional space 124, and the chamber wall of the accommodating chamber 112 forms the integrated box 120. Alternatively, the integrated box 120 and the station body 110 are two different components, and at this case, the chamber wall of the accommodating chamber 112 and the chamber wall of the functional space 124 are two different chamber walls.

Figure 5A:
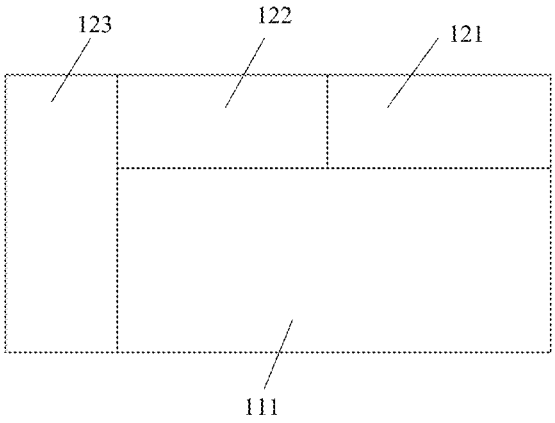
FIG. 5*a* shows a first arrangement relationship diagram of a functional space and a docking chamber in a docking station provided by an embodiment of the present disclosure.

As shown in FIGS. 3 and 5*a*, in one embodiment, at least a part of space of the accommodating chamber 112 is located above the docking chamber 111. The at least a part of the space of the accommodating chamber 112 being located above the docking chamber 111 includes, but is not limited to: in one embodiment, at least a part of the space of the accommodating chamber 112 is located right above or diagonally above the docking chamber 111.

As shown in FIG. 3, the accommodating chamber 112 is located right above the docking chamber 111, or, as shown in FIG. 5*a*, a part of the accommodating chamber 112 is located diagonally above the docking chamber 111.

In one embodiment, at least a part of the space of the accommodating chamber 112 is located at a side of the docking chamber 111. For example, FIG. 5*a* shows that one part of the space of the accommodating chamber 112 is located above the docking chamber 111 and the other part of the space is located at the side of the docking chamber 111. For example, FIG. 5*b* shows that all spaces of the accommodating chamber 112 are each located at a side of the docking chamber 111.

Figure 5B:
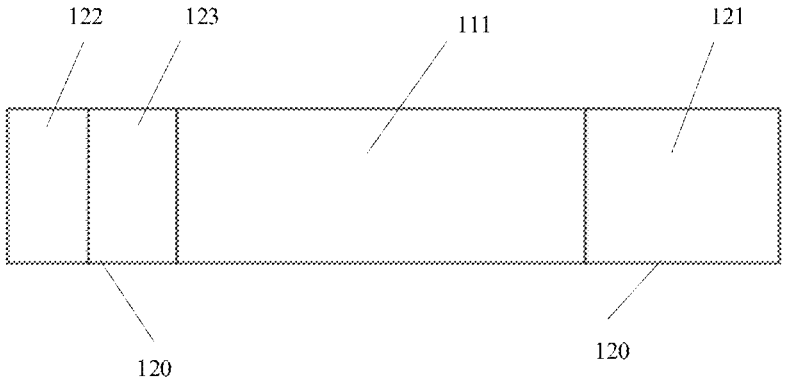
FIG. 5*b* shows a second arrangement relationship diagram of a functional space and a docking chamber in a docking station provided by an embodiment of the present disclosure.

It can be understood that in an embodiment of the present disclosure, a configuration of spaces included in the functional space 124 includes any one of following modes:

- as shown in FIG. 3, all the spaces included in the functional space 124 are arranged side by side in a horizontal direction above the docking chamber 111;
- as shown in FIG. 5*b*, all the spaces included in the functional space 124 are arranged side by side in a horizontal direction at sides of the docking chamber 111;
- as shown in FIG. 5*a*, among all the spaces included in the functional space 124, one part of the spaces included in the functional space 124 are arranged side by side in a horizontal direction above the docking chamber 111, and the other part of the spaces included in the functional space 124 are arranged side by side in a horizontal direction at a side of the docking chamber 111.

As shown in FIGS. 3 to 6*a*, according to one embodiment of the present disclosure, top walls of at least one integrated box 120 are at a same horizontal plane or approximately at the same horizontal plane, or, the top walls of at least one integrated box 120 are parallel or approximately parallel to a top wall of the station body 110. This structure of the integrated box 120 may allow the above-mentioned multiple functional spaces 124 to be arranged in a horizontal direction instead of being stacked in a vertical direction perpendicular to the horizontal direction, which in turn reduces the increase in the height of the docking station 100 and facilitates reducing the height of the docking station 100.

In an embodiment of the present disclosure, all the functional space 124 at least includes: a dust collection space 121, a dirty-water storage space 122, and a cleaning agent storage space 123.

Figure 7:
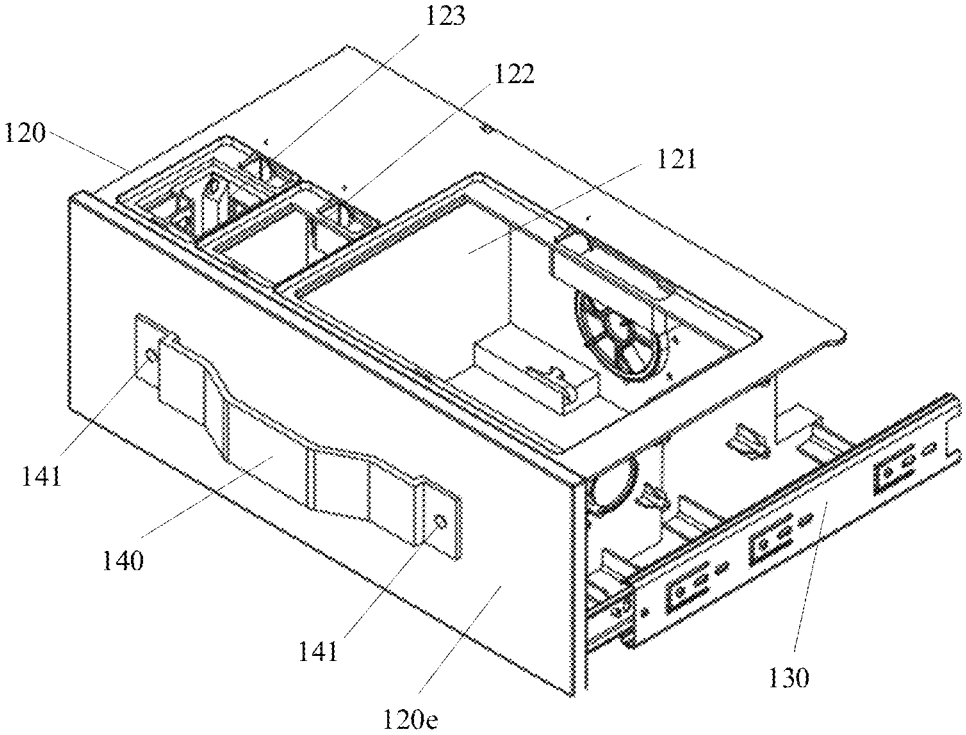
FIG. 7 shows a first partial structure diagram of a docking station provided by an embodiment of the present disclosure.
Figure 8A:
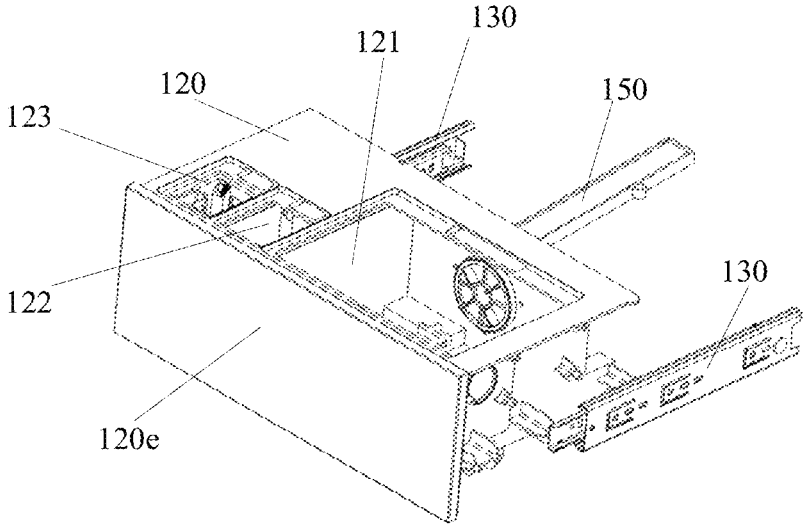
FIG. 8*a* shows a second partial structure diagram of a docking station provided by an embodiment of the present disclosure.
Figure 9A:
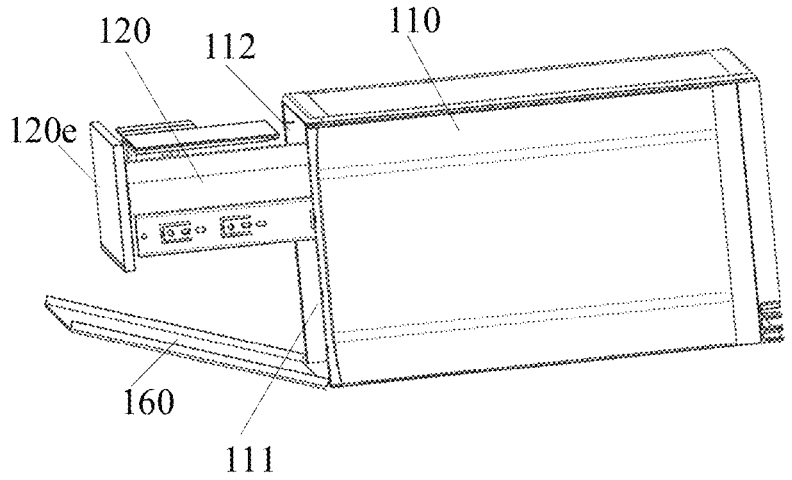
FIG. 9*a* shows a third partial structure diagram of a docking station provided by an embodiment of the present disclosure.
Figure 9B:
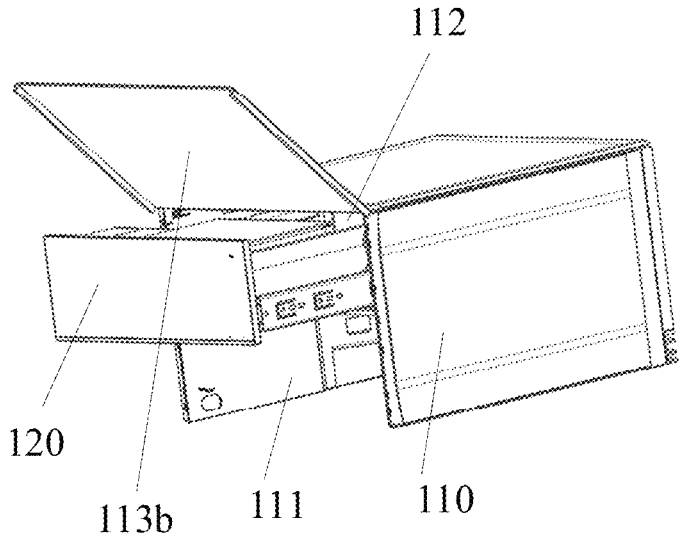
FIG. 9*b* shows a fourth partial structure diagram of a docking station provided by an embodiment of the present disclosure.
Figure 9C:
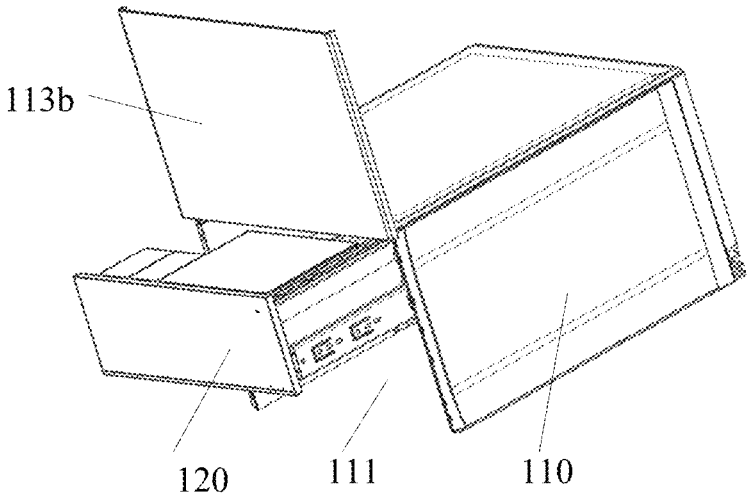
FIG. 9*c* shows a fifth partial structure diagram of a docking station provided by an embodiment of the present disclosure.
Figure 9D:
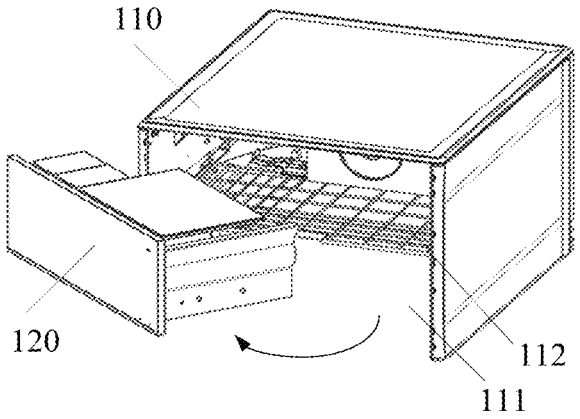
FIG. 9*d* shows a sixth partial structure diagram of a docking station provided by an embodiment of the present disclosure.
Figure 9E:
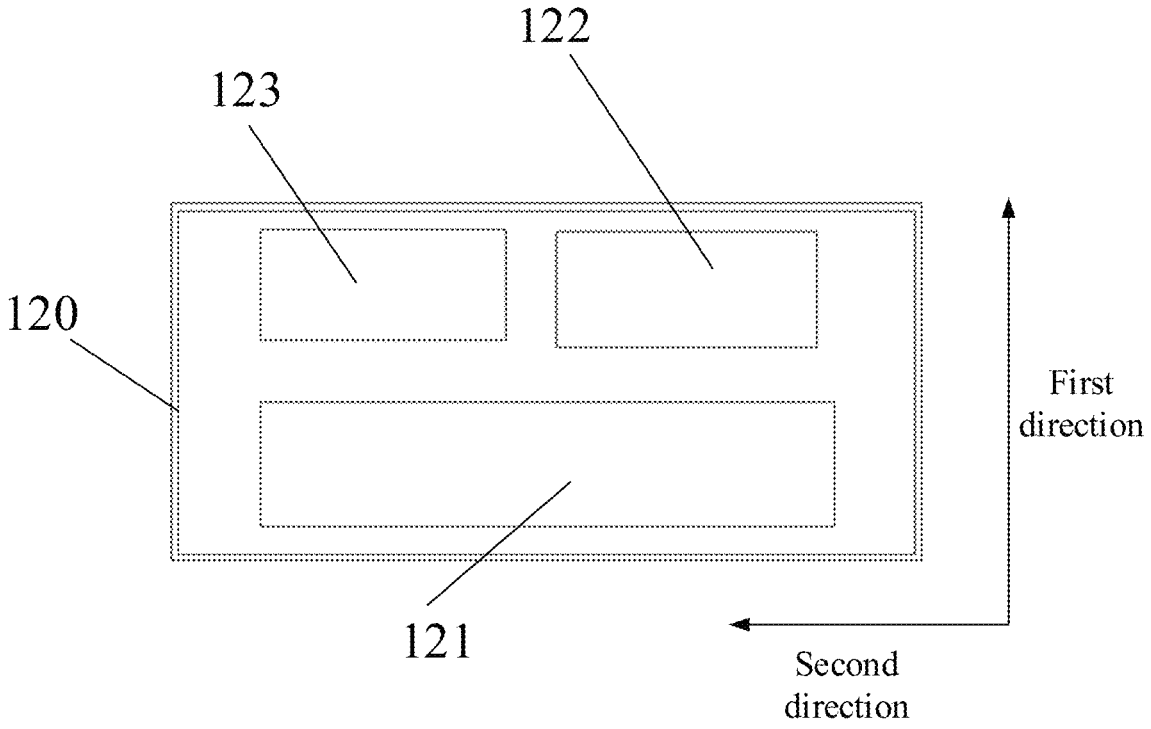
FIG. 9*e* shows an arrangement relationship diagram of spaces in a functional space in a docking station provided by an embodiment of the present disclosure.

Side-by-side arrangement of the spaces included in the functional space 124 in the horizontal direction above the docking chamber 111 includes that: when there are at least two spaces in the integrated box 120, multiple spaces are arranged side by side in a first direction of the horizontal direction, or, as shown in FIGS. 7 and 8*a*, multiple spaces are arranged side by side in a second direction of the horizontal direction, or, as shown in FIG. 9*e*, multiple spaces may be arranged along both the first direction and the second direction, where the second direction is perpendicular or approximately perpendicular to the first direction, and both the first direction and the second direction are partial directions of the horizontal direction.

In the embodiments shown in FIG. 3, FIG. 4*a*, FIG. 4*b*, and FIG. 6*a*, the integrated box 120 is located above the docking chamber 111, and the integrated box 120 is located between a top wall 110*a* of the station body 110 and a top wall of the docking chamber 111. For example, as shown in FIG. 3, FIG. 4*a*, FIG. 4*b*, and FIG. 6*a*, the docking station 100 has one integrated box 120, where the one integrated box 120 has the dust collection space 121, the dirty-water storage space 122, and the cleaning agent storage space 123, and the integrated box 120 is located above the docking chamber 111.

When at least a part of space of the accommodating chamber 112 is located at a side of the docking chamber 111 or all the functional spaces 124 are arranged side by side in the horizontal direction at a side of the docking chamber 111, as shown in FIG. 5*b*, in one embodiment, the top wall of the integrated box 120 may be located at a same horizontal plane or approximately at the same horizontal plane as the top wall of the docking chamber 111. For example, in the embodiment shown in FIG. 5*b*, the docking station 100 has two integrated boxes 120, which are located at both sides of the docking chamber 111 respectively. One of the two integrated boxes 120 has the dust collection space 121, and the other of the integrated boxes 120 has the dirty-water storage space 122 and the cleaning agent storage space 123. The dust collection space 121, the docking chamber 111, the dirty-water storage space 122, and the cleaning agent storage space 123 are arranged side by side in a first horizontal direction of the horizontal plane, and top walls of the two integrated boxes 120 and the top wall of the docking chamber 111 are approximately at the same horizontal plane.

It can be understood that the configuration of the functional spaces 124 in the integrated box 120 is not limited to the above modes, and the number of the integrated box 120, and the configuration of the integrated box 120 on the station body 110 is not limited to the above modes, either.

In one embodiment, as shown in FIG. 3, the functional space 124 of the integrated box 120 may be used to contain a consumable, and the consumable includes, but is not limited to, at least one of a dust bag, a filter mesh, a cleaning agent replacement pack, etc. For example, a dust bag may be placed in the dust collection space 121 and filter an airflow which contains dirt and enters the dust collection space 121; and after the dirt remained on the dust bag reaches a certain amount, a user may detach the dust bag from the dust collection space 121 of the docking station 100 and install a new and clean dust bag in the dust collection space 121 to maintain the continuous working capability of the docking station 100. Alternatively, a filter mesh may be placed in the dirty-water storage space 122, and the user may periodically remove and clean the filter mesh and then return the cleaned filter mesh to the dirty-water storage space 122; or a cleaning replacement pack may be placed in the cleaning agent storage space 123. The user may replace a used cleaning agent replacement pack in the cleaning agent storage space 123 with a new replacement pack filled with cleaning agent when the cleaning agent is depleted, to complete replenishment of the cleaning agent of the docking station 100.

In one embodiment, the functional space 124 of the integrated box 120 is configured to contain a functional module, where the consumables are disposed in the functional module. The functional module include at least one of a dust collection box 120*a*, a dirty-water tank 120*c*, and a cleaning agent tank 120*b*, where the dust collection box 120*a* is disposed in the dust collection space 121, the dust collection box 120*a* having a dust bag inside; the dirty-water tank 120*c* is disposed in the dirty-water storage space 122, the dirty-water tank 120*c* having a filter mesh; and the cleaning agent tank 120*b* is disposed in the cleaning agent storage space 123, the cleaning agent tank 120*b* containing a cleaning agent replacement pack.

In one embodiment, the functional module is detachably placed in a corresponding functional space 124.

Figure 6A:
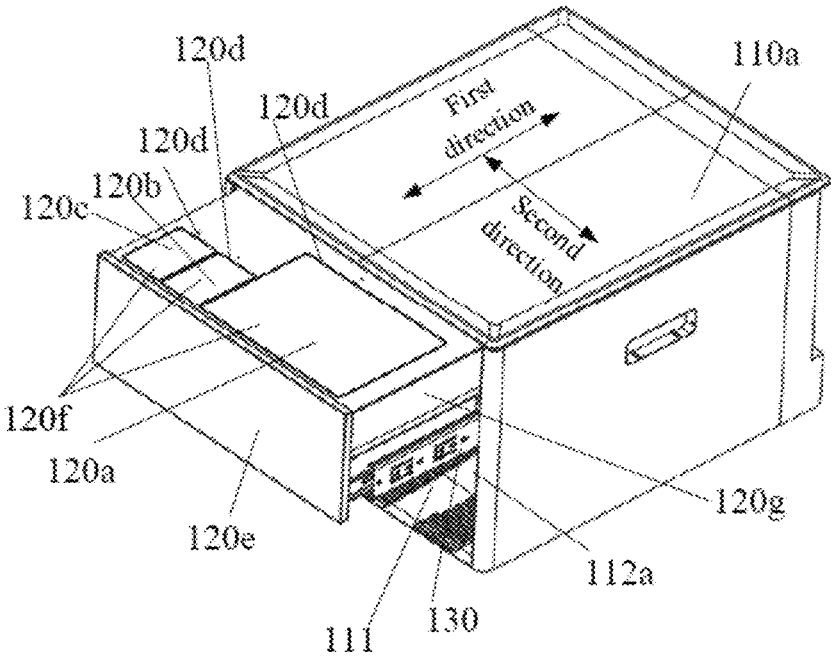
FIG. 6*a* shows a structure diagram of the docking station in FIG. 2 with an integrated box being in a second position.
Figure 6B:
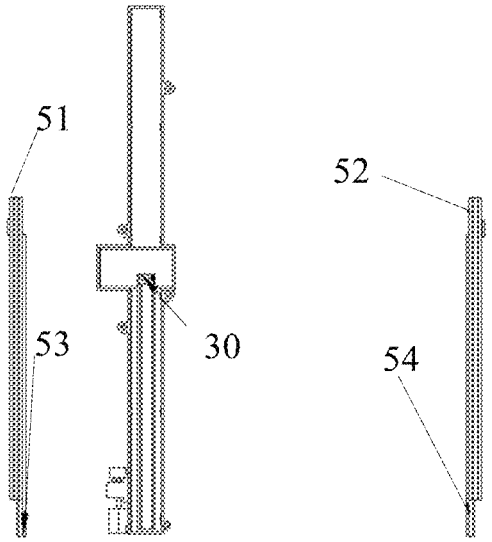
FIG. 6*b* shows a relative position relationship diagram of a moving assembly and a sliding rail assembly in a docking station provided by an embodiment of the present disclosure.
Figure 6C:
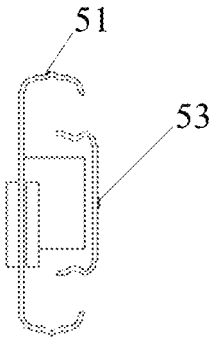
FIG. 6*c* shows a cross-sectional view of the fit between a first fixed rail and a first movable rail in a docking station provided by an embodiment of the present disclosure.
Figure 6D:
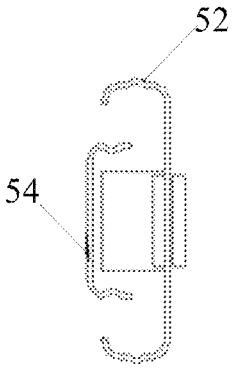
FIG. 6*d* shows a cross-sectional view of the fit between a second fixed rail and a second movable rail in a docking station provided by an embodiment of the present disclosure.

As shown in FIG. 6*a*, in one embodiment, the functional module includes: a functional body and a functional cover 120*f*, where the functional body has a storage space, and the functional cover 120*f* is detachably mounted on the functional body; or, the functional cover 120*f* is pivotally connected to the functional body so that the functional cover 120*f* can be covered on the storage space. When the consumable needs to be replaced, the functional cover 120*f* can be removed or rotated so as to make the storage space exposed, which is easy for the removal of consumable.

For example, the functional cover 120*f* includes at least: a top cover of a dust collection box, a top cover of a dirty-water tank, and a top cover of a cleaning agent tank.

In addition to containing consumables, the storage space may also be configured to contain residual dirt of airflow as for the dust collection box 120*a*; the storage space may also contain dirty-water as for the dirty-water tank 120*c*; and the storage space may also be configured to contain a cleaning agent as for the cleaning agent tank 120*b*.

Figure 4A:
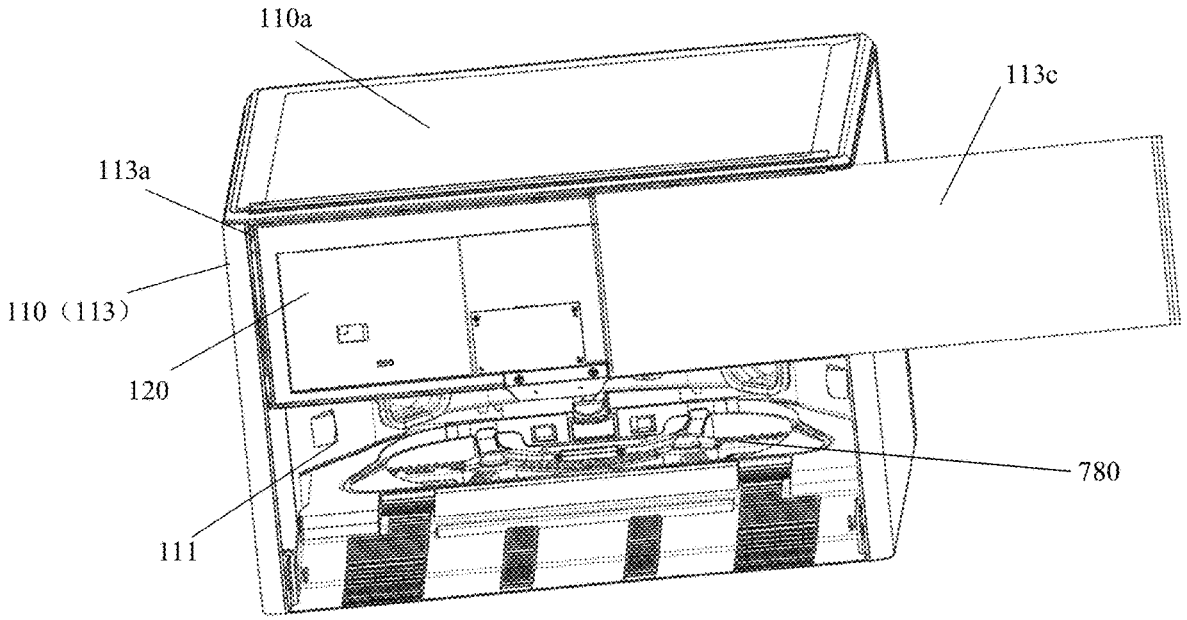
FIG. 4*a* shows a second structure diagram of a docking station provided by an embodiment of the present disclosure.
Figure 4B:
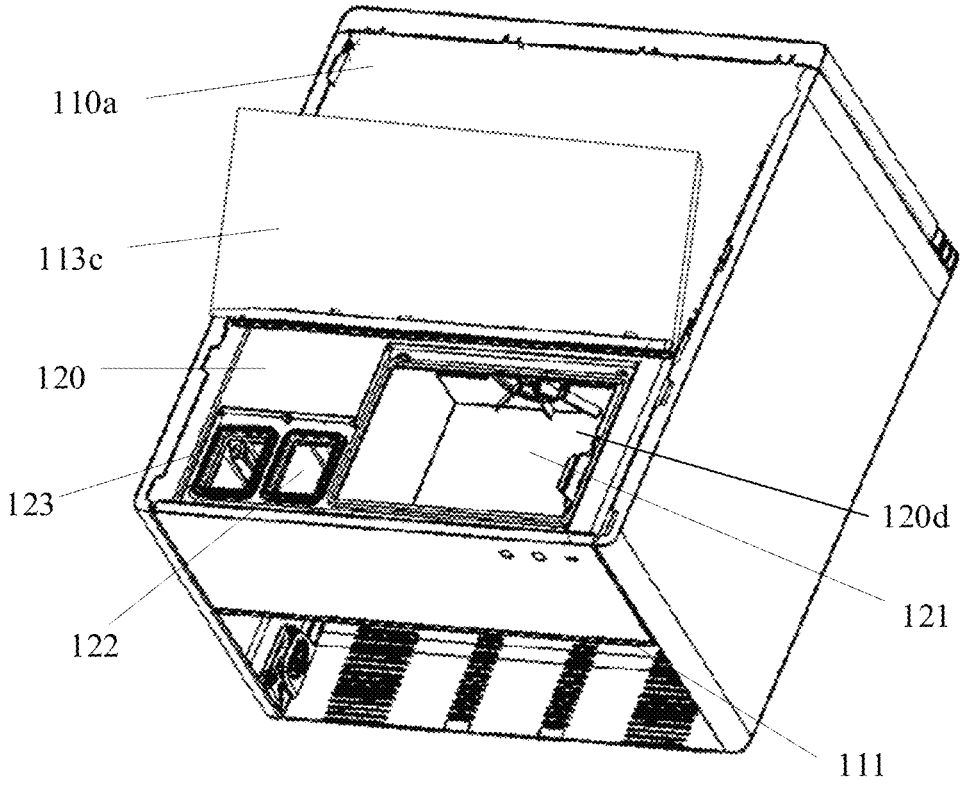
FIG. 4*b* shows a third structure diagram of a docking station provided by an embodiment of the present disclosure.

As shown in FIG. 4*a* and FIG. 4*b*, in one embodiment, the integrated box 120 may be fixed to the station body 110. The integrated box 120 also has an operation window 120*d* connected with the functional space 124. In order to facilitate maintenance operations on the functional space 124 through the operation window 120*d* such as consumable replacement, dirt cleaning, etc., a housing 113 of the station body 110 may include a fixed housing 113*a* and a movable cover 113*c*. The movable cover 113*c* has a closed state and an opened state with respect to the integrated box 120. When the movable cover 113*c* is in the closed state, the movable cover 113*c* covers the operation window 120*d*; when the movable cover 113*c* is in the opened state, the movable cover 113*c* cannot cover the operation window 120*d*, and the operation window 120*d* is exposed to the external environment. If the docking station 100 needs to be maintained, the movable cover 113*c* may be disposed in the opened state so that the operation window 120*d* is exposed, and the consumables such as the dust bag in the dust collection space 121, the filter mesh in the dirty-water storage space 122, and the cleaning agent in the cleaning agent storage space 123 may be replaced.

Without limitation, the movable cover 113*c* may be horizontally slidably mounted to the fixed housing 113*a*, as shown in FIG. 4*a*; or, the movable cover 113*c* is pivotally connected to the fixed housing 113*a*, as shown in FIG. 4*b*.

Without limitation, the number of the operation window 120*d* is the same as the number of the functional space 124 of the integrated box 120. At least two operation windows 120*d* are on a same horizontal plane or approximately the same horizontal plane.

If the integrated box 120 has the functional cover 120*f*, when the movable cover 113*c* is opened, the operation window 120*d* is first exposed to the external environment and then the functional cover 120*f* is exposed, and after the functional cover 120*f* is opened, the consumable stored in a corresponding functional module may be taken out. If the integrated box 120 does not have the functional cover 120*f*, when the operation window 120*d* is exposed to the external environment, the consumable can be directly taken out from the functional space 124.

As shown in FIG. 4*a*, the movable cover 113*c* may be disposed at a side of the station body 110, so that it is possible to realize opening of the functional space 124 from the side of the docking station 100 for maintenance of the docking station 100. At this time, not only can the docking station 100 be placed in a low space, but also an appliance may be placed above the top wall 110*a* of the station body 110; or, the docking station 100 may be placed in an embedded mode, for example, the docking station 100 may be embedded in the bottom space of an appliance. The appliance includes, but is not limited to: a home appliance or a cabinet, where the home appliance includes, but is not limited to, a laundry machine; and the cabinet includes, but is not limited to, a cupboard, a basin cabinet, a balcony cabinet, a restroom cabinet, etc. When the docking station 100 is required for maintenance, the docking station 100 can be kept in place and consumable replacement can be performed on the docking station 100.

As shown in FIG. 4*b*, the movable cover 113*c* may also be disposed on the top of the station body 110, and the movable cover 113*c* may be a part of the top wall 110*a* of the station body 110. In this case, although the docking station 100 may be placed in a low space, it is not suitable to place other appliances above the top wall 110*a* of the station body 110, and the docking station 100 is not suitable for embedded placement. If an appliance is placed above the docking station 100 or the docking station 100 is placed in an embedded mode, when consumable is to be replaced, it is necessary to remove the docking station 110 from the underneath of the appliance.

As shown in FIG. 6*a*, in one embodiment, the station body 110 further has an avoidance opening 112*a* connected with the accommodating chamber 112, the avoidance opening 112*a* being used for passage of the integrated box 120. The integrated box 120 is movable relative to the station body 110 between a first position and a second position in a first direction, where the first direction is approximately parallel to a plane in which the top wall 110*a* of the station body 110 is located, and/or the first direction is approximately parallel to a direction in which the self-moving cleaning apparatus 500 enters and exits the docking station 100.

In contrast to the embodiment shown in FIG. 4*a*, as shown in FIG. 6*a*, the integrated box 120 is movable relative to the station body 110, and the integrated box 120 passes through the avoidance opening 112*a* during a moving process to realize switching of the integrated box 120 between the first position and the second position.

In contrast to the embodiment shown in FIG. 4*a*, in the embodiment shown in FIG. 6*a*, the integrated box 120 can not only open the functional space 124 at the side, but also move at least one functional space 124 between the first position and the second position along a horizontal direction. The moved functional space 124 can be exposed more at the side of the station body 110, and then a consumable can be replaced above the side of the docking station 100, allowing for more convenient maintenance of the docking station 100 and greater adaptability of the docking station 100.

For example, the operation window 120*d* of the integrated box 120 faces toward the top wall 110*a* of the station body 110, and the functional cover 120*f* is adjacent to the top wall 110*a* of the station body 110. This configuration allows the operation window 120*d* and the functional cover 120*f* to be exposed above the side of the docking station 100 when the integrated box 120 is in the second position, making consumable replacement more convenient.

For example, FIG. 2 shows a structure diagram of the docking station 100 when the integrated box 120 is in the first position; and for another example, FIG. 6*a* shows a structure diagram of the docking station 100 when the integrated box 120 is in the second position.

The integrated box 120 has at least one operation window 120*d*, and as shown in FIG. 2, when the integrated box 120 is disposed in a first position, it is located in the accommodating chamber 112 of the station body 110, the operation window 120*d* is not exposed outside the station body 110, and the functional space 124 may provide the self-moving cleaning apparatus with a desired function. As shown in FIG. 6*a*, when the integrated box 120 is disposed in the second position, the operation window 120*d* is exposed outside the station body 110, and a user can replace the consumable for the functional space 124 through the operation window 120*d*, the operation being simple and convenient.

If the functional space 124 integrated in the integrated box 120 is two or more in number, after moving the integrated box 120 to the second position, consumables can be replaced for two or more functional spaces 124 at the same time without the necessity to pull each functional space 124 individually by a user, which makes the operation simpler and more convenient, and improves working efficiency. If the number of the functional space 124 integrated in the integrated box 120 is one, after moving the integrated box 120 to the second position, a user can move the integrated box 120 in which the consumables need to be replaced individually as required, which is convenient for operation.

In an embodiment of the present disclosure, the integrated box 120 may be manually or automatically switched between the first position and the second position.

As shown in FIG. 7, in one embodiment, the docking station 100 further includes a handle structure 140, where the handle structure 140 is provided on the integrated box 120 and exposed outside the accommodating chamber 112. When force is applied to the handle structure 140, the integrated box 120 may be switched between the first position and the second position. For example, pulling the handle structure 140 can cause the integrated box 120 to be switched from the first position to the second position, and pushing the handle structure 140 can cause the integrated box 120 to be switched from the second position to the first position, and a user can conveniently and manually realize the movement of the integrated box 120 by operating the handle structure 140.

For example, as shown in FIG. 7, the handle structure 140 is provided on a front side of the integrated box 120, the front side being located at the avoidance opening 112*a*. If the configuration as shown in FIG. 5*b* is applied to the integrated box 120, a pull ring structure may further be provided at a left side or a right side of the integrated box 120 adjacent to the avoidance opening 112*a*, where both the left side and the right side are a side which is adjacent to a front side and is approximately perpendicular to the front side.

The handle structure 140 may be a pull ring as shown in FIG. 7, and for example, the pull ring may be fixed to the integrated box 120 by two self-tapping screws 141 so that the pull ring is integrated with the integrated box 120. In addition, the handle structure 140 may also be a groove or a convex pole formed in the integrated box 120, or the handle structure 140 may take other forms as well.

As shown in FIG. 7 and FIG. 8*a*, in one embodiment, the docking station 100 further includes a sliding rail assembly 130, where the sliding rail assembly 130 is connected to the station body 110 and the integrated box 120, respectively, and the integrated box 120 is switched between the first position and the second position via the sliding rail assembly 130. That is to say, the integrated box 120 is provided slidably in the accommodating chamber 112 through the rail assembly 130 and reciprocates in an extension direction of the sliding rail assembly 130. The sliding rail assembly 130 has a guiding function, which can effectively constrain motion freedom of the integrated box 120, and improve reliability and stability of the switching of the integrated box 120 between the first position and the second position.

In one embodiment, it is also possible to construct a structure with guiding and constraining functions by utilizing the own structures of the integrated box 120 and the station body 110 without providing the sliding rail assembly 130. For example, a sliding groove may be provided outside the integrated box 120, a protruding sliding block may be provided on an inner wall of the accommodating chamber 112 of the station body 110, where the sliding block is disposed in the sliding groove, and the sliding block moves along the sliding groove when the integrated box 120 is moved under an external force.

In an embodiment of the present disclosure, movement of the integrated box 120 relative to the station body 110 includes horizontal movement and/or rotation.

As shown in FIG. 6*a*, under a guiding function of a linear sliding rail assembly 130, the integrated box 120 can horizontally move in a horizontal direction along a straight line to realize switching between the first position and the second position. The rotation of the integrated box 120 may be realized by changing a shape of the sliding rail assembly 130. For example, by changing the linear sliding rail assembly 130 in FIG. 6*a* to an arc-shaped sliding rail assembly 130, and manually pulling the integrated box 120 or using the moving assembly 150 to automatically drive the integrated box 120 to move, the movement trajectory of the integrated box 120 may be an arc shape, thereby achieving the rotation of the integrated box 120.

For example, FIG. 9*d* shows that the movement of the integrated box 120 relative to the station body 110 is a rotation, and that the movement trajectory of the integrated box 120 is an arc shape shown in FIG. 9*d* when the integrated box 120 is moved from the first position to the second position.

As shown in FIGS. 6*a* to 6*d*, in one embodiment, the sliding rail assembly 130 includes: a first fixed rail 51 and a second fixed rail 52, the first fixed rail 51 and the second fixed rail 52 being disposed correspondingly on the inner wall of the accommodating chamber 112; and a first movable rail 53 and a second movable rail 54, the first movable rail 53 slidably fitting with the first fixed rail 51, and the second movable rail 54 slidably fitting with the second fixed rail 52; where the first movable rail 53 and the second movable rail 54 are fixedly connected to both sides of the integrated box 120 respectively. Such a setting not only ensures simplification of the structure of the sliding rail assembly 130 but also makes the sliding rail assembly 130 work reliably.

In one embodiment, the sliding rail assembly 130 further include a limit element, where the limit element is provided on the first fixed rail 51 to constrain a motion range of the first movable rail 53 on the first fixed rail 51; or, the limit element is provided on the second fixed rail 52 to constrain a motion range of the second movable rail 54 on the second fixed rail 52; or, there are at least two limit elements provided on the first fixed rail 51 and the second fixed rail 52 respectively, to jointly constrain the motion range of the first movable rail 53 on the first fixed rail 51 and the motion range of the second movable rail 54 on the second fixed rail 52. Reliable engagement of a first rack 43 with a first gear 42 is ensured by stop constraints of the limit elements.

As shown in FIG. 8*a*, in one embodiment, the docking station 100 further includes: a moving assembly 150, where the moving assembly 150 is connected to the integrated box 120, and is configured to drive the integrated box 120 to be switched at least between the first position and the second position. Utilization of the moving assembly 150 enables the integrated box 120 to be automatically switched to the first position or the second position, which is more convenient for a user to replace a consumable in the integrated box 120, reduces labor intensity of replacement work, improves the user's long-term usage experience and makes subsequent promotion and sale of product more convenient.

If the docking station 100 has the sliding rail assembly 130 and the moving assembly 150 at the same time, the guiding and constraining functions of the sliding rail assembly 130 can further improve working reliability of the moving assembly 150.

As shown in FIG. 8*a*, in one embodiment, the moving assembly 150 includes: a first driving mechanism 151 and a converting mechanism, where the first driving mechanism 151 provides a driving force, and the converting mechanism is connected to the first driving mechanism 151 and the integrated box 120, respectively, thereby converting the driving force generated by the first driving mechanism 151 into reciprocating motion of the integrated box 120.

For example, the first driving mechanism 151 may include: a motor or an elastic element (e.g., an elastic torsional spring), etc.

Figure 8B:
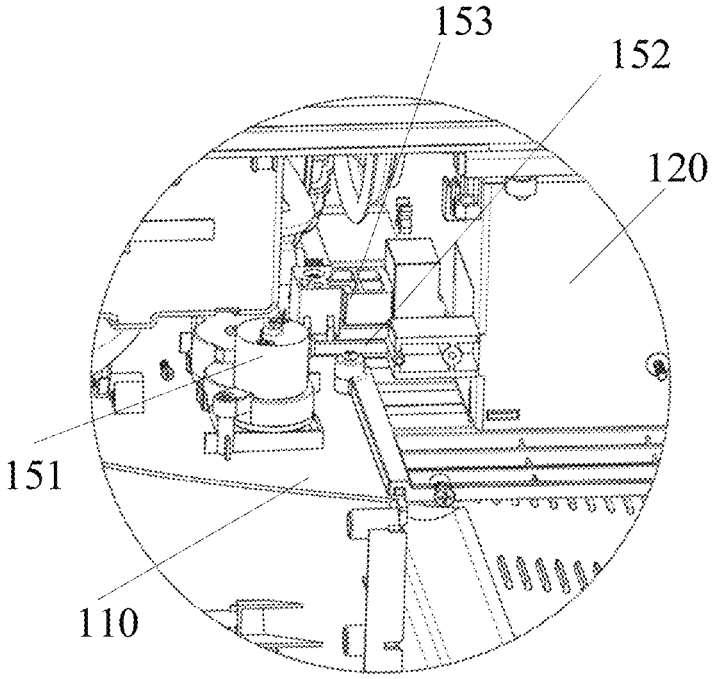
FIG. 8*b* shows a first partial structure diagram of a docking station provided by an embodiment of the present disclosure, including a conveying belt.
Figure 8C:
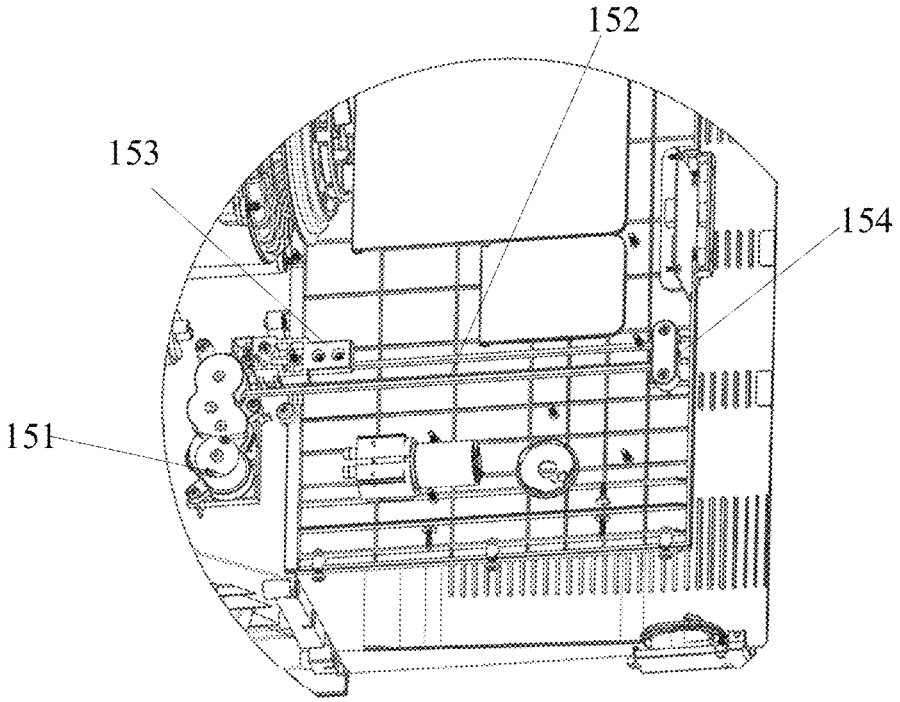
FIG. 8*c* shows a second partial structure diagram of a docking station provided by an embodiment of the present disclosure, including a conveying belt.

For example, the converting mechanism may be a lead screw mechanism, a worm driving mechanism, a gear driving mechanism, a conveying belt driving mechanism, etc. For example, FIG. 8*b* and FIG. 8*c* show an implementation mode in which a conveying belt driving mechanism is utilized to drive the integrated box 120 to move. In the embodiments shown in FIG. 8*b* and FIG. 8*c*, the moving assembly 150 includes: a first driving mechanism 151, a first drive shaft (not shown), a conveying belt 152, a second drive shaft 154, and a connecting seat 153, where the first drive shaft, the conveying belt 152, the second drive shaft 154, and the connecting seat 153 jointly form a conveying belt driving mechanism. The first driving mechanism 151 is connected to the first drive shaft to drive the first drive shaft to rotate; two ends of the conveying belt 152 are connected to the first drive shaft and the second drive shaft 154, respectively, and the connecting seat 153 is connected to the conveying belt 152 and the integrated box 120, respectively. A rotating first drive shaft can drive the conveying belt 152 to move around the second drive shaft 154 and the moving conveying belt 152 then drives the connecting seat 153 to be switched between a third position and a fourth position, where the integrated box 120 is in the first position when the connecting seat 153 is in the third position, and the integrated box 120 is in the second position when the conveying belt 152 drives the connecting seat 153 to move to the fourth position.

For example, as shown in FIG. 8*b* and FIG. 8*c*, the second drive shaft 154 is closer to the integrated box 120 than the first drive shaft, the conveying belt 152 is annular, and the conveying belt 152 rotates circularly between the first drive shaft and the second drive shaft 154. The third position and the fourth position may be two different positions located between the first drive shaft and the second drive shaft 154, and the third position is located between the fourth position and the first drive shaft. That is to say, the fourth position is closer to the second drive shaft 154 than the third position.

In one embodiment, the conveying belt 152 is a cog belt with conveying teeth, the first drive shaft and the second drive shaft 154 are both cog shafts, and the conveying belt is engaged with the first drive shaft and the second drive shaft 154.

Without limitation, the first driving mechanism 151 includes a motor; or, the first driving mechanism 151 includes a motor and a gear.

Without limitation, when the integrated box 120 needs to be moved from the first position to the second position, the motor of the first driving mechanism 151 may be controlled to rotate in a clockwise direction, the motor drives the conveying belt 152 to rotate in a preset direction (the preset direction may be counterclockwise or clockwise) via the first drive shaft, the rotating conveying belt drives the connecting seat 153 to move from the third position to the fourth position, and then the connecting seat 153 drives the integrated box 120 to move from the first position to the second position. If the integrated box 120 needs to be returned to the first position, the motor of the first driving mechanism 151 may be controlled to rotate reversely, the conveying belt 152 will rotate in a reverse direction opposite to the preset direction, the connecting seat 153 returns from the fourth position to the third position along with rotation of the conveying belt 152, and then the connecting seat 153 drives the integrated box 120 to return from the second position back to the first position. The way in which the conveying belt driving mechanism drives the integrated box 120 is not limited to this.

Figure 8D:
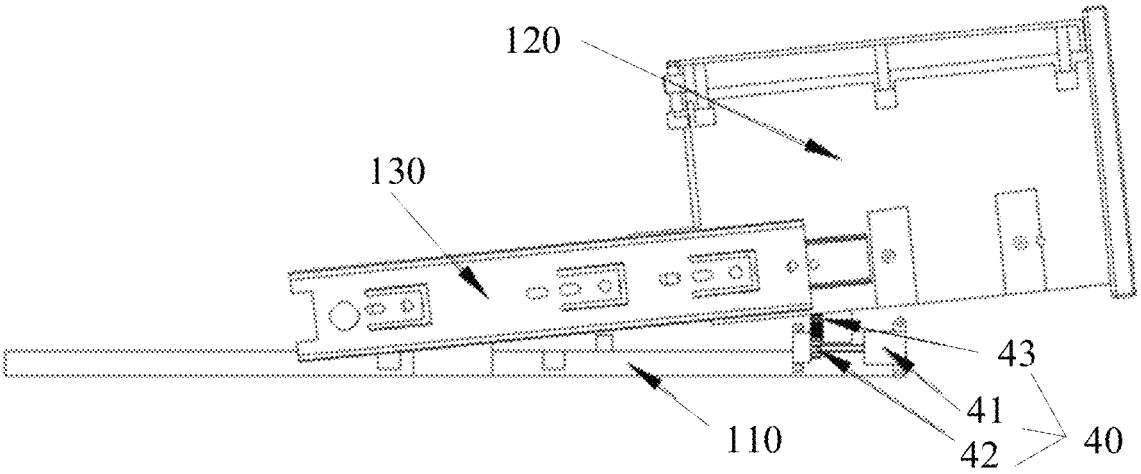
FIG. 8*d* shows a schematic diagram of the cooperation operation between a rotation assembly and an integrated box in a docking station provided by an embodiment of the present disclosure.
Figure 8E:
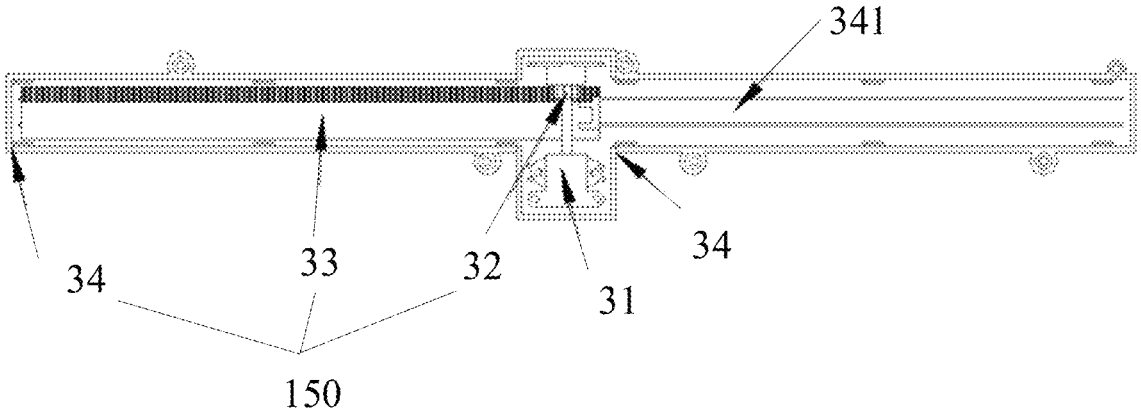
FIG. 8*e* shows a specific structure diagram of a moving assembly in a docking station provided by an embodiment of the present disclosure.

In one embodiment, if the converting mechanism is a gear driving mechanism, the moving assembly 150 may realize function thereof by the following technical solution: as shown in FIG. 8*a*, FIG. 8*d*, and FIG. 8*e*, the moving assembly 150 includes: an elastic torsional spring 31 provided on the station body 110; a first driving gear 32 connected to the elastic torsional spring 31; and a first driven rack 33 engaged with the first driving gear 32 and fixedly connected to the integrated box 120. In a state where the elastic torsional spring 31 releases an elastic force, the elastic torsional spring 31 drives the first driven rack 33 and the integrated box 120 to move linearly by driving the first driving gear 32 to rotate. By providing the elastic torsional spring 31, the integrated box 120 can reliably move linearly under the elastic force while ensuring that the mobile assembly 150 has simplified overall structure and low cost.

For example, a common elastic snap-fit structure may be provided between the integrated box 120 and the station body 110 accordingly, and have a locked state and a released state. In the locked state, the integrated box 120 is fixed to the station body 110 by the elastic snap-fit structure, and at this time, the elastic torsional spring 31 does not work. A user may press the integrated box 120 to make the elastic snap-fit structure switched from the locked state to the released state; and under an elastic force of the elastic snap-fit structure, the integrated box 120 is out of contact with the station body 110, at this time, the elastic torsional spring 31 begins to release the elastic force and automatically propels the integrated box 120 to move linearly, thereby realizing an automatic ejection of the integrated box 120.

Based on the embodiments shown in FIGS. 8*a* to 8*e*, the moving assembly 150 further includes a constraint element 34, the constraint element 34 having a constraint groove 341. The first driven rack 33 is slidably provided in the constraint groove 341, an extension direction of the constraint groove 341 being parallel to an extension direction of the first driven rack 33. An inner wall of the constraint groove 341 is abutted against two sides of the first driven rack 33 to constrain the first driven rack 33 to slide along the extension direction of the constraint groove 341. By providing the constraint element 34, the sliding of the first driven rack 33 along the extension direction of the constraint groove 341 is effectively ensured, which then improves reliability of the linear movement of the integrated box 120.

It is worth noting that: in order to further ensure the mating effect of the constrain element 34 and the first driven rack 33, in one embodiment, a bottom surface of a driven rack (a surface backing away from a plane where the rack teeth are located) may be provided with a protrusion, and a bottom wall of the constrain groove 341 is provided with a groove, where an extension direction of the groove is parallel to the extension direction of the constrain groove 341. The protrusion is provided in the groove and is slidably fitted with the groove. Obviously, both the protrusion and the groove may also be multiple, which will not be repeated herein.

In one embodiment, if the converting mechanism is a worm driving mechanism, the moving assembly 150 may realize its function by the following technical solution. The moving assembly 150 includes: a first driving motor fixedly provided on the integrated box 120; a driving worm connected to a rotating shaft of the first driving motor; a fixed worm fixedly provided on the station body 110. Where, worm teeth on the fixed worm engage with worm teeth on the driving worm; and a central axis of the fixed worm is perpendicular to a central axis of the driving worm; where the first driving motor drives the driving worm to rotate, and the first driving motor, the integrated box 120, and the driving worm jointly reciprocate linearly along an axial direction of the fixed worm. By adopting an existing way of two mutually perpendicular worms matched with each other (the specific working principle is commonly found in mechanical books, which will not be repeated herein), the reliability of the linear movement of the integrated box 120 is effectively ensured; and at the same time, based on the structural advantages of worm matching, the way in which worms are matched with each other can significantly improve driving strength, and is more applicable to the integrated box 120 with a larger weight.

It should be noted that: in an implementation mode of the worm driving mechanism, a guiding structure is usually required to constrain the movement trajectory of the driving worm in the way in which two worms are cooperated with each other, and a sliding rail assembly 130 can serve as the guiding structure; when the sliding rail assembly 130 is not included in some technical solutions, it is necessary to additionally set up a guiding structure to constrain the movement trajectory of the driving worm in order to ensure working reliability of the worm driving mechanism.

In one embodiment, if the converting mechanism is a driving mechanism combining a rack and a gear, the moving assembly 150 may realize its function by the following technical solution. The converting mechanism includes: a first driving gear 32 connected to the rotating shaft of the first driving motor; a first driven rack 33 engaged with the first driving gear 32 and fixedly connected to the integrated box 120; where the first driving motor drives the first driven rack 33 and the integrated box 120 to reciprocate linearly by driving the first driving gear 32 to rotate. By adopting the way of the gear and the rack cooperating with each other, simplification of the structure of the converting mechanism is ensured and assembling of the converting mechanism is facilitated.

Figure 8F:
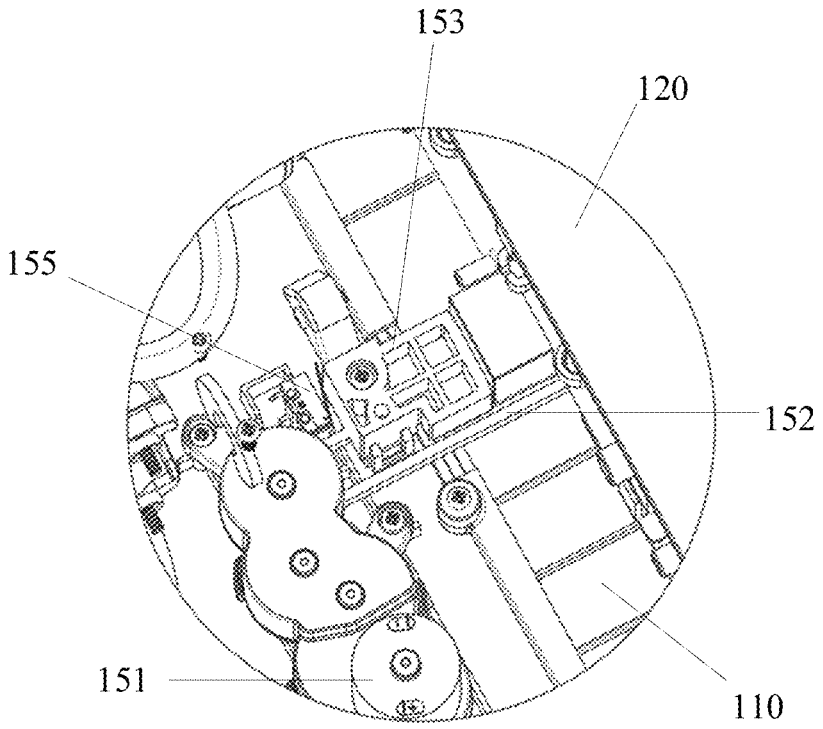
FIG. 8*f* shows a partial structure diagram of a docking station provided by an embodiment of the present disclosure, including a first in-position detector.

In one embodiment, if the converting mechanism is a lead screw mechanism, the moving assembly 150 may realize its function by the following technical solution. The converting mechanism includes: a driving lead screw connected to the rotating shaft of the first driving motor; and a screw element movably provided on the driving lead screw. The screw element is in screw-thread fit with the driving lead screw and is fixedly connected to the integrated box 120; where the first driving motor drives the screw element and the integrated box 120 to reciprocate linearly along an axial direction of the driving lead screw by driving the driving lead screw to rotate. In contrast to the worm driving mechanism, the mode of lead screw driving is quieter and more efficient. As shown in FIG. 8*b* and FIG. 8*f*, the docking station 100 further includes: at least one first in-position detector 155 detecting whether the integrated box 120 reaches the first position and/or the second position, the at least one first in-position detector 155 being mounted on the station body 110, and/or the first in-position detector 155 being arranged adjacent to the moving assembly 150.

For example, as shown in FIG. 8*d* and FIG. 8*f*, a first in-position detector for detecting whether the integrated box 120 reaches the first position may be provided. In this structure, as shown in FIG. 8*f*, the first in-position detector 155 may be mounted on the station body 110 and adjacent to the integrated box 120.

In an embodiment where the docking station 100 includes only one first in-position detector 155, the first in-position detector 155 is not configured to detect whether the integrated box 120 reaches the second position, and a software may be utilized to determine whether the integrated box 120 reaches the second position. For example, the time since the integrated box 120 left the first position may be utilized to determine whether the integrated box 120 reaches the second position. If the time since the integrated box 120 left the first position reaches a first preset duration, it is indicated that the integrated box 120 reaches the second position; conversely, if the time since the integrated box 120 left the first position does not reach the first preset duration, it is indicated that the integrated box 120 does not reach the second position. There are other ways to determine whether the integrated box 120 reaches the second position, which will not be described in detail herein.

For example, a first in-position detector A and a first in-position detector B, a total of two first in-position detectors, may be provided respectively. The first in-position detector A is adjacent to the first position where the integrated box 120 is located or adjacent to the third position where the connecting seat 153 is located; and the first in-position detector B is adjacent to the second position where the integrated box 120 is located or adjacent to the fourth position where the connecting seat 153 is located. When the first in-position detector A detects a first detection signal, it can be determined that the integrated box 120 is in the first position; at this time, the control system of the docking station 100 may control the first driving mechanism 151 of the moving assembly 150 to stop outputting a driving force according to the received first detection signal, so as to ensure that the integrated box 120 can stay in the first position more accurately and to reduce collision between the integrated box 120 and the station body 110. Similarly, when the first in-position detector B detects a second detection signal, it can be determined that the integrated box 120 is in the second position; at this time, the control system of the docking station 100 may control the first driving mechanism 151 of the moving assembly 150 to stop outputting the driving force according to the received second detection signal, so as to ensure that the integrated box 120 can stay in the second position more accurately.

For example, the first in-position detector 155 is a Hall sensor. Without limitation, the Hall sensor may be mounted on the housing 113. The first in-position detector A is noted as a first Hall sensor and the first in-position detector B is noted as a second Hall sensor, with the first Hall sensor provided adjacent to the first position and the second Hall sensor provided adjacent to the second position. The integrated box 120 is provided with a magnetic part. Both the first Hall sensor and the second Hall sensor can sense magnetic field generated by the magnetic part to obtain detection information. The detection information detected by the first Hall sensor may be utilized to determine where the magnetic part is located, i.e., the first Hall sensor may be configured to detect whether the integrated box 120 reaches the first position; similarly, the second Hall sensor may be utilized to detect whether the integrated box 120 reaches the second position.

In another example, one first in-position detector 155 may also be utilized to determine both whether the integrated box 120 is in the first position and whether the integrated box 120 is in the second position. The first in-position detector may detect a relative distance between it and the integrated box 120, and may determine a position of the integrated box 120 based on the relative distance. For example, if the first in-position detector 155 detects that the relative distance reaches a first preset distance, it may be determined that the integrated box 120 is in the first position, at this time, through the communication between the control system and the in-position detector, the integrated box 120 may be remained in the first position. If the first in-position detector 155 detects that the relative distance reaches a second preset distance, it may be determined that the integrated box 120 is in the second position, at this time, through the communication between the control system and the in-position detector, the integrated box 120 may be remained in the second position.

In one embodiment, the docking station 100 further includes a lifting assembly, the lifting assembly being configured to drive a functional module in the integrated box 120 to enter and exit the functional space 124. The lifting assembly can realize automatic entry and exit of the functional module to and from the functional space 124, facilitating replacement of the functional module.

For example, the lifting assembly includes a second driving mechanism and a conveying assembly. The conveying assembly drives the functional module to enter and exit the functional space 124, under the driving action of the second driving mechanism.

In a specific embodiment of the present disclosure, a set of lifting assemblies drive multiple functional modules to move up and down at the same time. For example, there is a movable support plate underneath the dust collection box 120*a*, the dirty-water tank 120*b*, and the cleaning agent tank 120*c*, and the support plate abuts against bottom surfaces of the dust collection box 120*a*, the dirty-water tank 120*b*, and the cleaning agent tank 120*c* at the same time. The lifting assemblies propel the dust collection box 120*a*, the dirty-water tank 120*b*, and the cleaning agent tank 120*c* to move up and down simultaneously by controlling the support plate to move up and down.

In another specific embodiment of the present disclosure, there may be three sets of lifting assemblies, the operation among them does not affect each other, and the three sets of lifting assemblies drive the dust collection box 120*a*, the dirty-water tank 120*b*, and the cleaning agent tank 120*c* to move up and down, respectively. For example, each set of the lifting assemblies contains a retractable support rod, the support rods of the three sets of lifting assemblies abut against the bottom surfaces of the dust collection box 120*a*, the dirty-water tank 120*b*, and the cleaning agent tank 120*c*, respectively. The dust collection box 120*a*, the dirty-water tank 120*b*, and the cleaning agent tank 120*c* are each controlled to move up and down, by extension and retraction of the support rods.

In addition, the structures of the lifting assemblies (i.e., the support plate structure and the support rod structure) in the above-mentioned two embodiments may be interchangeable, and freely selected according to space size inside the station body 110 and usage requirements.

As shown in FIG. 8*d*, in one embodiment, the docking station 100 further includes a rotation assembly 40, the rotation assembly 40 being configured to drive the integrated box 120 to swing relative to the station body 110. By providing the rotation assembly 40, the integrated box 120 is enabled to have a freedom degree of swinging relative to the station body 110, and when used by a user, the integrated box 120 swings in a direction that ensures that openings of the dust collection box 120*a*, the dirty-water tank 120*b*, and the cleaning agent tank 120*c* used for entry and exit of substance are oriented toward the user, which further facilitates the user to observe a using status of a functional box (e.g., whether the dust collection box 120*a* is filled), and meantime, facilitates replacement of the dust collection box 120*a*, the dirty-water tank 120*b* and the cleaning agent tank 120*c*.

In one embodiment, in some embodiments, the operation of the rotation assembly 40 may be controlled by setting a main control module, based on this, a triggering condition for the swinging of the integrated box 120 relative to the station body 110 may be set. For example, the rotation assembly 40 starts controlling the integrated box 120 to swing relative to the station body 110 only when the integrated box 120 is located outside the accommodating chamber 112, thereby ensuring that the integrated box 120 does not interfere with other structures during the swinging, and then ensuring work reliability and safety of the integrated box 120.

As shown in FIG. 8*d*, the rotation assembly 40 includes: a first motor 41 fixedly provided on the station body 110; a first gear 42 connected to a rotating shaft of the first motor 41; and a first rack 43 fixedly connected to the integrated box 120. In a state where the integrated box 120 is located outside the accommodating chamber 112 (i.e., the integrated box 120 is in the second position), the first rack 43 engages with the first gear 42, and the first motor 41 drives the first gear 42 to rotate, and drives the integrated box 120 to swing relative to the station body 110 via the first rack 43. Such a setting not only ensures simplified structure of the rotation assembly 40, but also causes the cost of the rotation assembly 40 to be lower.

It should be noted that, in order to ensure reliable engagement of the first rack 43 and the first gear 42, in a specific embodiment of the present disclosure, an orientation of an opening between adjacent rack teeth of the first rack 43 may be set to be consistent with a moving direction of the integrated box 120, i.e., a moving direction of the rack teeth of the first rack 43 is perpendicular to a peripheral surface of the first gear 42.

As shown in FIG. 6*a* and FIG. 7, the integrated box 120 includes: a box body 120*g* and an exterior decorative panel 120*e*, the box body 120*g* having at least one functional space 124 as described above, the exterior decorative panel 120*e* being connected to the outer side of the box body 120*g*. When the integrated box 120 is in the first position, the exterior decorative panel 120*e* covers the avoidance opening 112*a*; and when the integrated box 120 is in the second position, the exterior decorative panel 120*e* is separated from the station body 110 and the avoidance opening 112*a* is exposed to the external environment.

The exterior decorative panel 120*e* may form an exterior surface of the docking station 100 together with the housing 113 of the station body 110, ensuring the integrity of the exterior surface of the docking station 100.

When the docking station 100 is embedded in the bottom of an appliance in an embedded manner, the exterior decorative panel 120*e* may use the same appearance material as the appliance to improve the integrity of the docking station 100 with the appliance and to improve usage experience of the docking station.

The above-mentioned handle structure 140 may be mounted on the exterior decorative panel 120*e*.

As shown in FIG. 9*b* and FIG. 9*c*, in one embodiment, the docking station 100 further includes a door panel 113*b* for closing the avoidance opening 112*a*, the door panel 113*b* being mounted to the station body 110, the door panel 113*b* having a closed state and an open state relative to the station body 110. When the integrated box 120 is in the first position, the door panel 113*b* is in the closed state, and the door panel 113*b* covers the avoidance opening 112*a*; and when the integrated box 120 is in the second position, the door panel 113*b* is in the open state, and the avoidance opening 112*a* is exposed outside the door panel 113*b*. In this structure, the integrated box 120 may not be provided with the exterior decorative panel 120*e*.

The door panel 113*b* forms the exterior surface of the docking station 100 together with the housing 113 of the station body 110. Providing the door panel 113*b* not only effectively ensures the integrity of the exterior surface of the docking station 100, but also plays a protective role on the integrated box 120.

For example, the door panel 113*b* is pivotally or slidably connected to the station body 110.

The door panel 113*b* may be mounted to a bottom wall of the station body 110; or, as described in FIG. 9*b* and FIG. 9*c*, the door panel 113*b* may be mounted to the top wall 110*a* of the station body 110; or, the door panel 113*b* may also be mounted to a side wall of the station body 110.

Without limitation, as shown in FIG. 9*b* and FIG. 9*c*, there may be no connection relationship between the door panel 113*b* and the integrated box 120, so that movement of the door panel 113*b* and movement of the integrated box 120 may be independent from each other. When it is necessary to pull the integrated box 120 out of the accommodating chamber 112, the door panel 13*b* may be opened before moving the integrated box 120; or, the integrated box 120 may be moved directly and the door panel 113*b* may be pushed off by use of the integrated box 120, causing the door panel 113*b* to be in the open state.

In one embodiment, the door panel 113*b* may also be connected to the integrated box 120 such that the movement of the door panel 113*b* may be synchronized with the movement of the integrated box 120. If an external force is applied to the door panel 113*b* to move the door panel 113*b*, the door panel 113*b* may drive the integrated box 120 to move. For example, when the door panel 113*b* is pulled, the door panel 113*b* may be switched from the closed state to the open state, and at the same time, the integrated box 120 is switched from the first position to the second position.

As shown in FIG. 9*a*, in one embodiment, the docking station 100 further includes: a storage door 160 used for covering the docking chamber 111.

For example, the storage door 160 may be pivotally connected to a chamber wall of the docking chamber 111 (i.e., pivotally connected to the station body 110), and the storage door 160 may be independent from the door panel 113*b* (or from the integrated box 120). In this way, the docking chamber 111 can be opened or closed by rotation of the storage door 160. When the docking chamber 111 is opened, it is possible to facilitate the self-moving cleaning apparatus 500 to enter the docking chamber 111; and when the docking chamber 111 is closed, it is possible to reduce a noise generated by dust collection and/or cleaning of the self-moving cleaning apparatus 500 located in the docking chamber 111.

Alternatively, there is no connection relationship between the storage door 160 and the station body 110, and the storage door 160 is slidably connected to the integrated box 120.

For example, the storage door 160 is slidably connected to the exterior decorative panel 120*e* of the integrated box 120, and a sliding direction of the storage door 160 relative to the exterior decorative panel 120*e* may be perpendicular to a horizontal plane direction. When it is necessary to open the docking chamber 111, the storage door 160 may be moved upwardly to expose the docking chamber 111; and when it is necessary to close the docking chamber 111, the storage door 160 may be moved downwardly.

In one embodiment, the integrated box 120 includes at least a dust collection space 121, and the volume of the dust collection space 121 is related to a distance between the integrated box 120 and the station body 110 when the integrated box 120 is in the second position. Generally, the greater the distance between the integrated box 120 and the station body 110 is, i.e., the farther the integrated box 120 is away from the accommodating chamber 112, the greater the volume of the dust collection space 121 is, and the longer a time interval at which a user needs to replace a dust bag in the dust collection space 121 is.

Without limitation, when the integrated box 120 is in the second position, the distance between the integrated box 120 and the station body 110 is in a positively proportional relationship, or approximately positively proportional relationship, to the volume of the dust collection space 121.

Figure 10A:
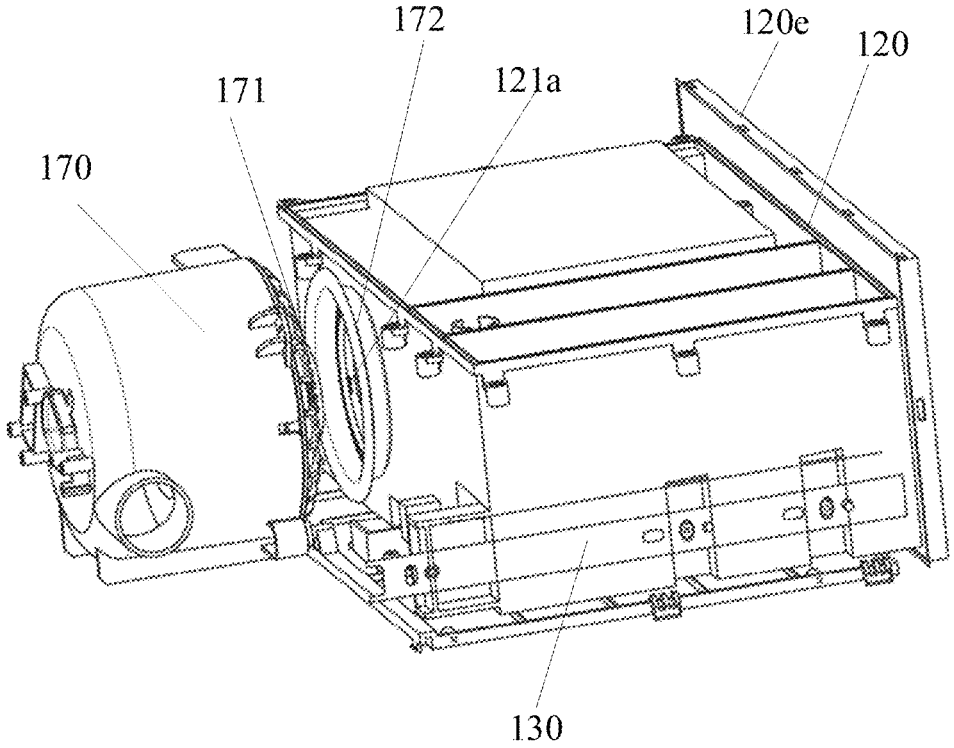
FIG. 10*a* shows a seventh partial structure diagram of a docking station provided by an embodiment of the present disclosure.
Figure 10B:
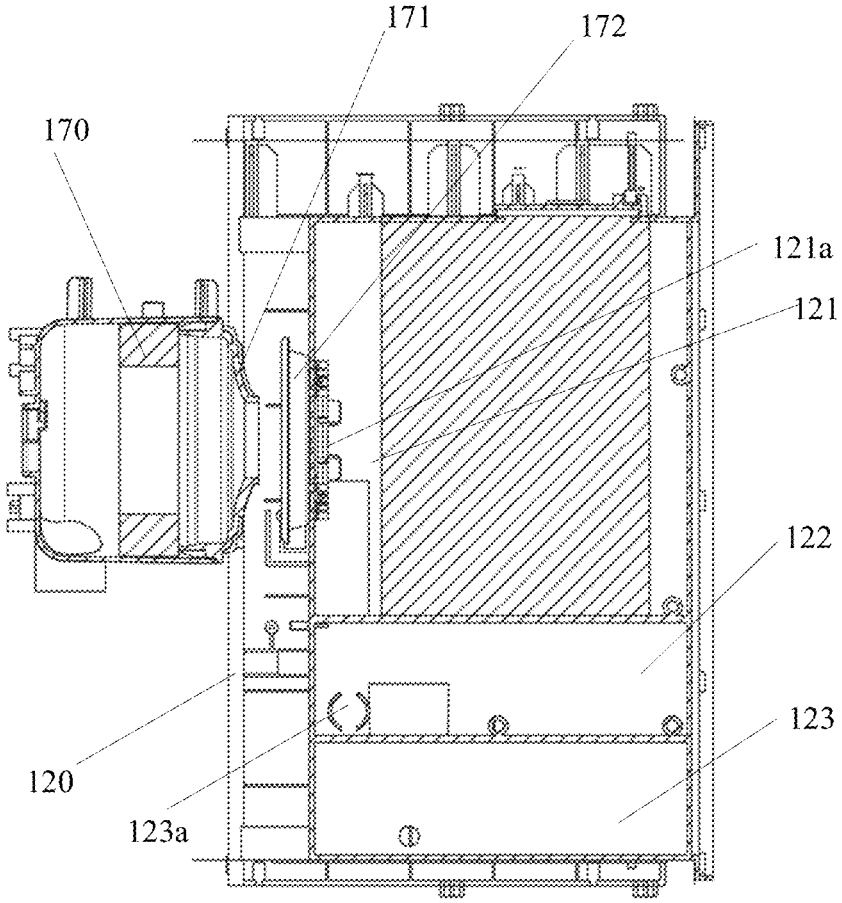
FIG. 10*b* shows a partial structure sectional view of the docking station in FIG. 10*a* with an integrated box being in a first position.
Figure 10C:
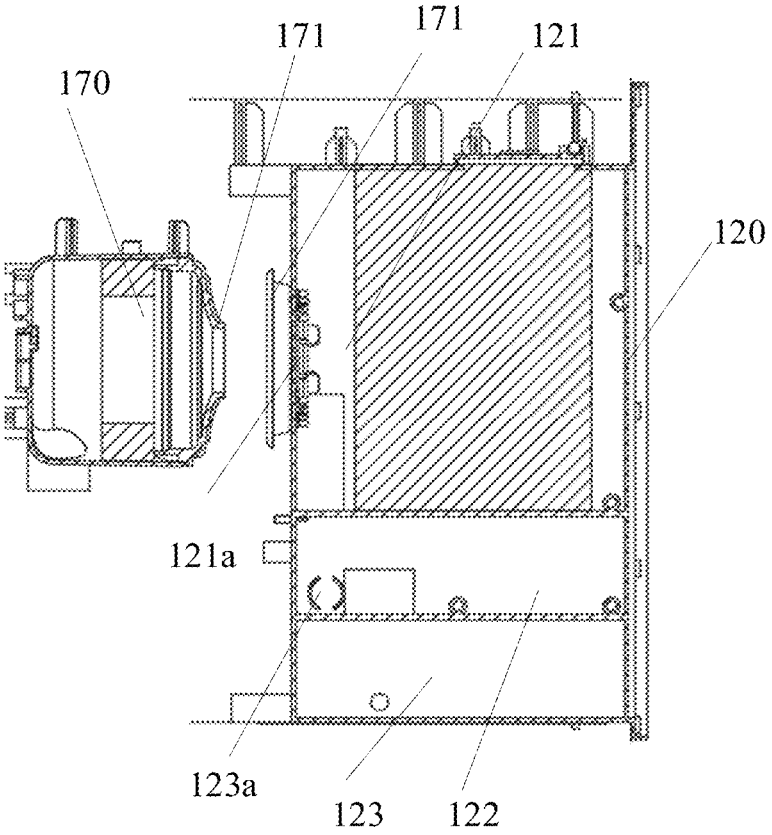
FIG. 10*c* shows a partial structure sectional view of the docking station in FIG. 10*a* with an integrated box being in a second position.

As shown in FIG. 10*a*, in one embodiment of the present disclosure, the docking station 100 further includes: a dust collection fan 170 providing suction for dust collection, and a first sealing element 172. An inner wall of the dust collection space 121 of the integrated box 120 has an air outlet port 121*a*, the dust collection fan 170 extracts air to form a negative pressure in order to suck dirt from a dust bin of the self-moving cleaning apparatus 500 into the dust collection space 121 through a pipeline, and the dirt entering the dust collection space 121 is filtered by a filter bag and then flows out of the dust collection space 121 via the air outlet port 121*a*. The first sealing element 172 is mounted to the integrated box 120 and surrounds the air outlet port 121*a*; as shown in FIG. 10*b*, the integrated box 120 is in the first position, and the dust collection fan 170 is connected with the air outlet port 121*a* and hermetically connected to the first sealing element 172; and as shown in FIG. 10*c*, the integrated box 120 is in the second position, and the dust collection fan 170 is separated from the first sealing element 172.

In an embodiment of the present disclosure, the dust collection fan 170 and the integrated box 120 jointly form a part of an airflow channel.

The dust collection fan 170 extracts air to form a negative pressure, and an airflow enters the dust collection space 121 from the docking chamber 111 through a pipeline (i.e., a dust collection tube 180 described below), and is then blown from an outlet of the dust collection space 121 to the docking chamber 111 through another pipeline (i.e., an air blowing tube 101 described below), a channel formed by this process being the airflow channel.

Utilizing the first sealing element 172 can ensure the sealing effect of connection between the dust collection fan 170 and the integrated box 120, which effectively ensures sealing of a dust collection channel during the dust collection and an effect of the dust collection. Moreover, the first sealing element 172 can be separated from the integrated box 120 and can also realize sealing after abutting against the integrated box 120, effectively adapting to the mobility of the integrated box 120.

As shown in FIG. 10*b* and FIG. 10*c*, in one embodiment, the dust collection fan 170 includes a fan body and a shock-absorbing cushion 171, the shock-absorbing cushion 171 being mounted on the fan body. As shown in FIG. 10*b*, the integrated box 120 is in the first position, and the dust collection fan 170 is hermetically connected to the first sealing element 172 by the shock-absorbing cushion 171; and as shown in FIG. 10*c*, the integrated box 120 is in the second position, and the shock-absorbing cushion 171 is separated from the first sealing element 172. By utilizing the shock-absorbing cushion 171, an impact force of the movement of the integrated box 120 on the fan body can be absorbed, which has a protective effect on the fan body. Moreover, providing the shock-absorbing cushion 171 can also reduce an impact noise generated in a moving process of the integrated box 120 returning from the second position to the first position.

Figure 11A:
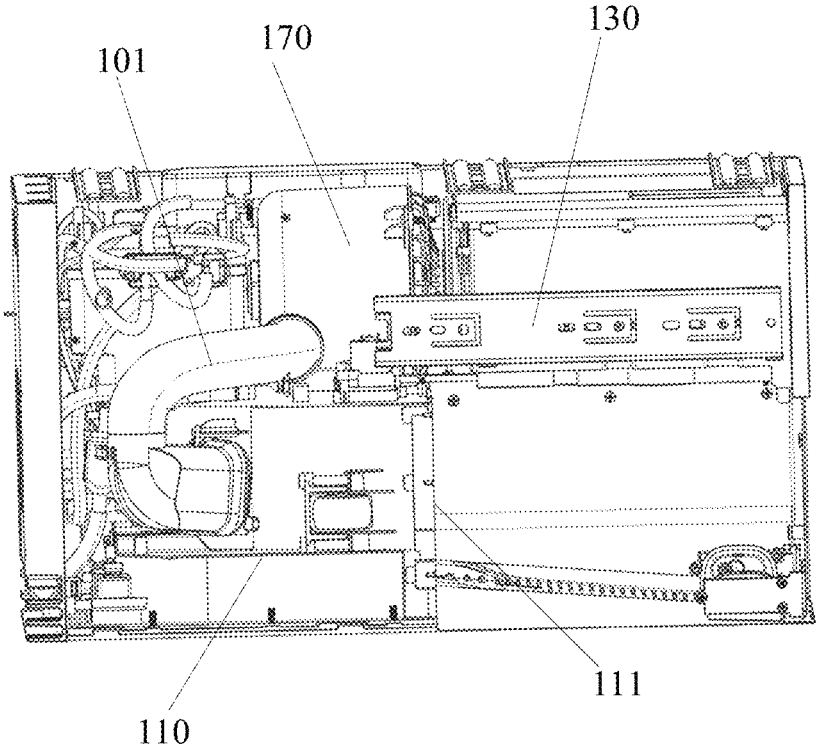
FIG. 11*a* shows an eighth partial structure diagram of a docking station provided by an embodiment of the present disclosure.
Figure 11B:
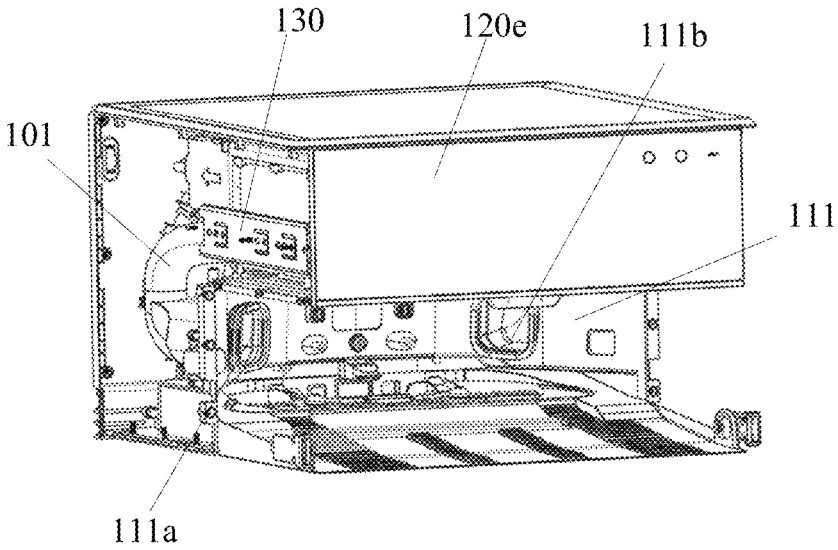
FIG. 11*b* shows a ninth partial structure diagram of a docking station provided by an embodiment of the present disclosure.

As shown in FIG. 11*a* and FIG. 11*b*, an inner wall of the docking chamber 111 further has an air blowing port 111*a* and a dust collection port 111*b* which are spaced apart, and the docking station 100 further includes: an air blowing tube 101 communicating the air blowing port 111*a* with the dust collection fan 170, and a dust collection tube 180 communicating the dust collection space 121 with the dust collection port 111*b*.

The dirt inside the dust bin of the self-moving cleaning apparatus 500 may enter the dust collection tube 180 via the dust collection port 111*b*, and then enter the dust collection space 121 from the dust collection tube 180, and gas filtered by the dust bag enters the air blowing tube 101 from an outlet of the dust collection fan 170 and is then blown into the dust bin via the air blowing port 111.

Figure 11C:
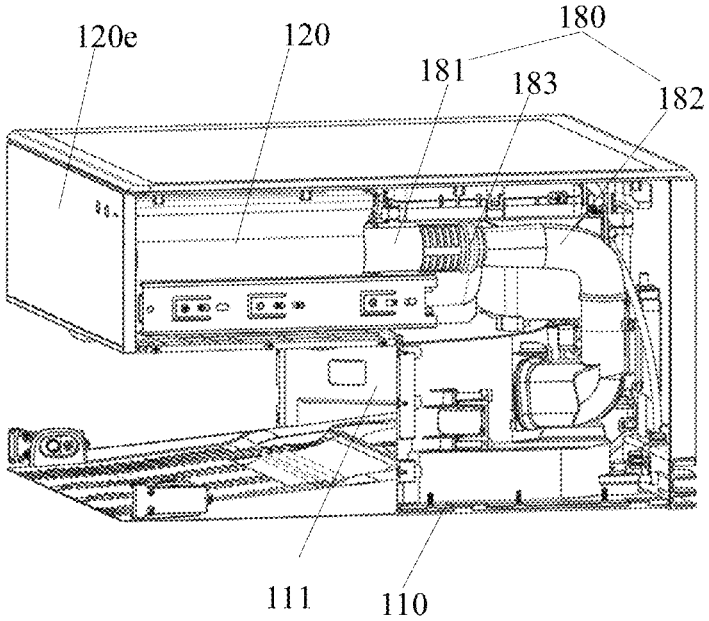
FIG. 11*c* shows a tenth partial structure diagram of a docking station provided by an embodiment of the present disclosure.
Figure 11D:
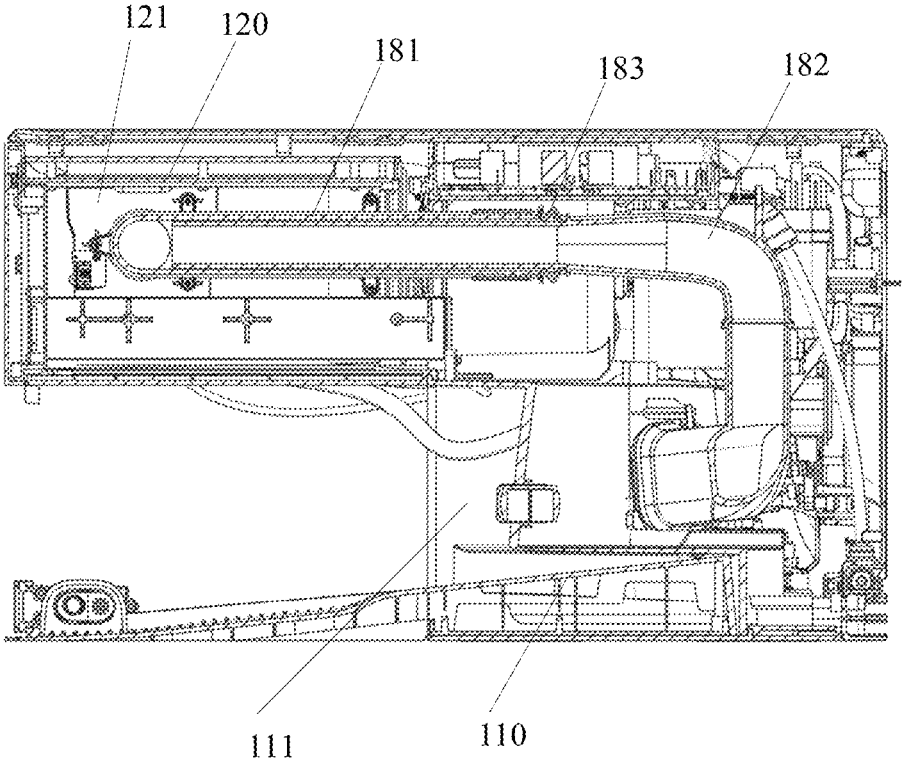
FIG. 11*d* shows a sectional view of FIG. 11*c*.

As shown in FIG. 11*d*, in one embodiment, the dust collection tube 180 include: a first tube 182, a second tube 181, and a second sealing element 183, where the first tube 182 is connected to the station body 110 and is connected with the dust collection port 111*b*; and the second tube 181 is connected to the integrated box 120 and is connected with the dust collection space 121. The second tube 181 and the first tube 182 are movable relative to each other, for example, the first tube 182 and the second tube 181 realize relative movement through a sleeved connection. The second sealing element 183 is hermetically connected to a joint between the first tube 182 and the second tube 181. Since one end of the dust collection tube 180 is fixed to the station body 110 and the other end thereof is fixed to the integrated box 120, when the integrated box 120 moves, it may adapt to the movement of the integrated box 120 by means of the movable first tube 182. For example, when the integrated box 120 moves from the first position to the second position, the second tube 181 moves with the integrated box 120, the second tube 181 moves away from the first tube 182, and the length of a portion where the first tube 182 and the second tube 181 are sleeved with each other gradually decreases, or, the first tube 182 is separated from the second tube 181; and when the integrated box 120 moves from the second position to the first position, the integrated box 120 drives the second tube 181 to be close to the first tube 182, the length of the portion where the first tube 182 and the second tube 181 are sleeved with each other gradually increases, or, the first tube 182 and the second tube 181 gradually change from a separated state to a sleeved-connection state.

Without limitation, the sleeved-connection between the first tube 182 and the second tube 181 includes that: as shown in FIG. 11*c* and FIG. 11*d*, the first tube 182 is partially disposed within the second tube 181. Alternatively, in other embodiments, the sleeved-connection between the first tube 182 and the second tube 181 may also be that: the second tube 181 is partially disposed within the first tube 182.

In one embodiment, the first tube 182 may be a retractable tube and the second tube 181 is a non-retractable tube. For example, the first tube 182 is a corrugated tube.

Figure 11E:
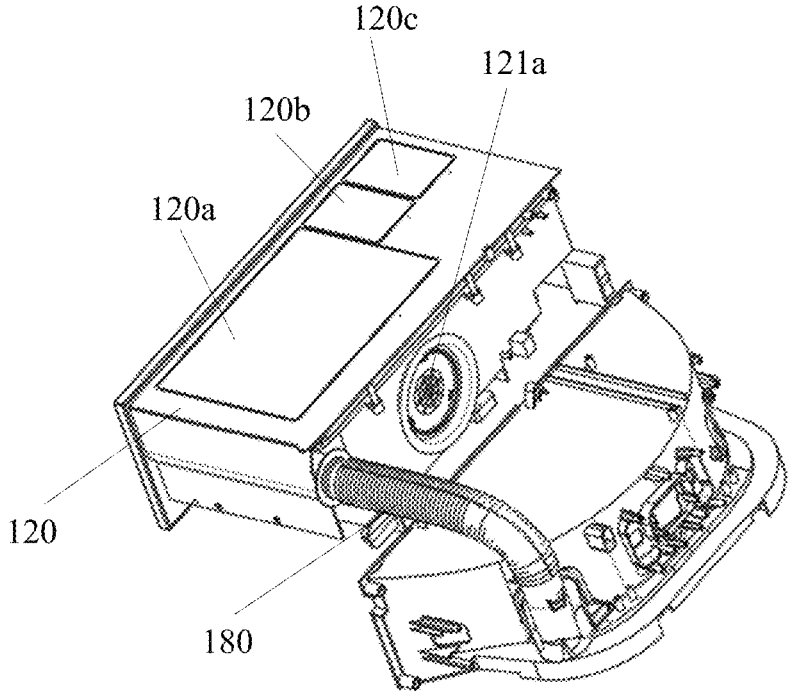
FIG. 11*e* shows an eleventh partial structure diagram of a docking station provided by an embodiment of the present disclosure.
Figure 13A:
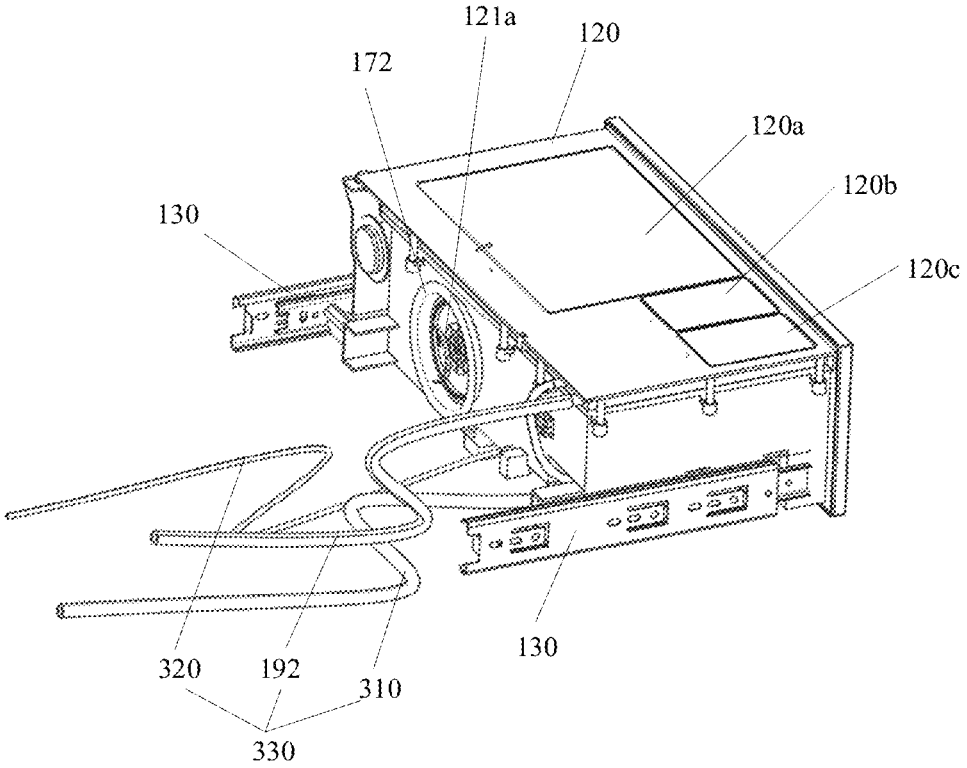
FIG. 13*a* shows a fifteenth partial structure diagram of a docking station provided by an embodiment of the present disclosure.

In one embodiment, as shown in FIG. 13*a*, instead of the first tube 182 and the second tube 181 being internally and externally sleeved with each other, the dust collection tube 180 is a single tube. That is, the dust collection tube 180 is a single retractable tube. As shown in FIG. 11*e*, at least part of the dust collection tube 180 is a corrugated tube. Retractility of the corrugated tube may be utilized to adapt to the movement of the integrated box 120. When the integrated box 120 is pulled out of the accommodating chamber 112, the corrugated tube may be stretched entirely; and when the integrated box 120 returns to the accommodating chamber 112, the corrugated tube will shrink back. Using the dust collection tube 180 in a form of a corrugated tube ensures that there is no disconnecting gap in the dust collection tube 180, which will not allow dirt to leak out, effectively ensuring the sealing of the dust collection tube 180; is high in reliability and low in cost; and occupies less space in the docking station 100.

In one embodiment, the second sealing element 183 may be sleeved on the first tube 182, and the first tube 182 does not move with the movement of the integrated box 120. When the integrated box 120 is in the first position, the first tube 182 is in tight contact with the second sealing element 183 to realize sealing. When the integrated box 120 leaves the first position, the first tube 182 may be separated from the second sealing element 183, which does not need to provide a sealing function.

In one embodiment, the second sealing element 183 may also be sleeved on the second tube 181, or, the second sealing element 182 may be sleeved on both the first tube 182 and the second tube 181.

Without limitation, the second sealing element 183 may not be retractable when the second sealing element 183 is sleeved on the first tube 182 or the second tube 181.

In addition, the second sealing element 183 may also be retractable. For example, when the second sealing element 183 is sleeved on the first tube 182 and the second tube 181 at the same time, the second sealing element 183 may be retractable. The second sealing element 183 may elastically and extensionally deform along with elongation of the first tube 182, or may restore elastic deformation along with contraction of the first tube 182, in order to ensure radial sealing of a joint between the first tube 182 and the second tube 181 during the movement of the integrated box 120.

Figure 11F:
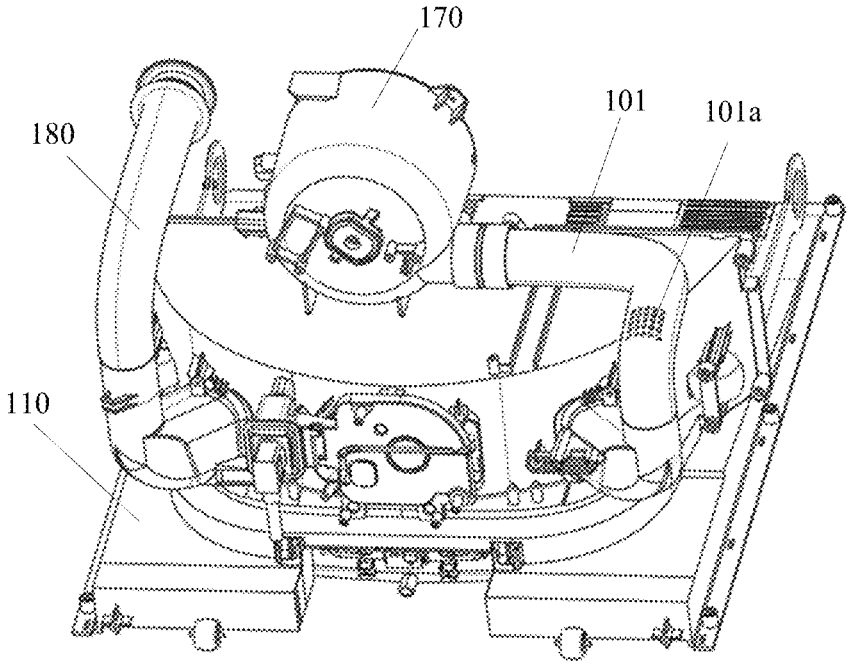
FIG. 11*f* shows a twelfth partial structure diagram of a docking station provided by an embodiment of the present disclosure.

As shown in FIG. 11*f*, in one embodiment, the air blowing tube 101 has a plurality of air holes 101*a*. Generally, when air is blown into the dust bin via the air blowing tube 101, the air holes 101*a* can reduce the pressure of a blowing airflow, thereby reducing an amount of the blowing airflow toward the dust bin, and reducing the risk of the dirt in the dust bin being blown to a suction port of the self-moving cleaning apparatus 500 and falling onto the docking station 100 due to a relatively high blowing airflow pressure.

Figure 12A:
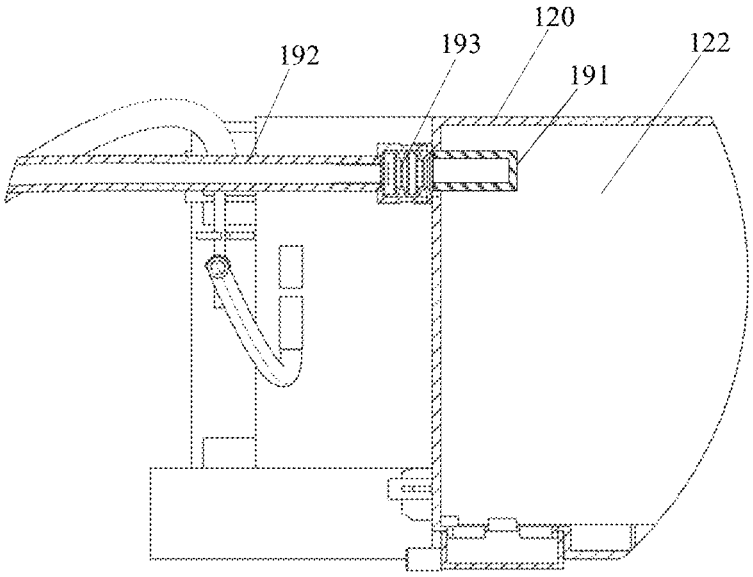
FIG. 12*a* shows a partial structure sectional view of a docking station in an embodiment of the present disclosure, the docking station being at a dirty-water storage space and an integrated box being in a first position.

As shown in FIG. 13*a*, in one embodiment, the docking station further includes: a waste inlet tube 192 for passage of dirty-water flowing to the dirty-water storage space 122. One end of the waste inlet tube 192 is fixed to the dirty-water storage space 122 and connected with a waste inlet port of the dirty-water storage space 122. The waste inlet tube 192 may move with the movement of the integrated box 120. For example, the waste inlet tube 192 may stretch out and draw back with the movement of the integrated box 120. The other end of the waste inlet tube 192 may lead to a waste discharge port in a bottom wall of the docking chamber 111. Dirty-water generated from washing the cleaning assembly flows out of the docking chamber 111 via the waste discharge port and is transferred to the dirty-water storage space 122 via the waste inlet tube 192. As shown in FIG. 12*a*, a pipeline for introducing dirty-water from the docking chamber 111 into the dirty-water storage space may be classified into two tubes, the waste inlet tube 192 and a connecting tube 191. In one embodiment, the docking station includes: the connecting tube 191 and the waste inlet tube 192, where the connecting tube 191 is connected to the integrated box 120 and connected with the dirty-water storage space 122, and the connecting tube 191 may move with the movement of the integrated box 120. When the integrated box 120 is in the first position, the waste inlet tube 192 and the connecting tube 191 are movable relative to each other, for example, the waste inlet tube 192 and the connecting tube 191 are sleeved with each other, and the waste inlet tube 192 is connected with the connecting tube 191. When the integrated box 120 is in the second position, the waste inlet tube 192 is separated from the connecting tube 191.

For example, the waste inlet tube 192 may be a flexible tube and the connecting tube 191 is a rigid tube.

Without limitation, the sleeved-connection of the connecting tube 191 relative to the waste inlet tube 192 includes that: as shown in FIG. 12*a*, the connecting tube 191 is partially disposed within the waste inlet tube 192, or, in other embodiments, the sleeved-connection of the connecting tube 191 relative to the waste inlet tube 192 includes that: the waste inlet tube 192 is partially disposed within the connecting tube 191.

As shown in FIG. 12*a*, in one embodiment, the docking station 100 further includes a third sealing element 193, the third sealing element 193 being configured to seal a joint between the connecting tube 191 and the waste inlet tube 192, to realize radial sealing of the joint between the connecting tube 191 and the waste inlet tube 192.

For example, the third sealing element 193 may be fixed to the connecting tube 191, and may move with movement of the connecting tube 191. When the waste inlet tube 192 is connected to the connecting tube 191 by insertion, the waste inlet tube 192 will press against the third sealing element 193 to realize sealing.

In one embodiment, the third sealing element 193 may also be fixed to the waste inlet tube 192, and does not move. When the waste inlet tube 192 is connected to the connecting tube 191 by insertion, the connecting tube 191 will press against the third sealing element 193 to realize sealing.

Figure 12B:
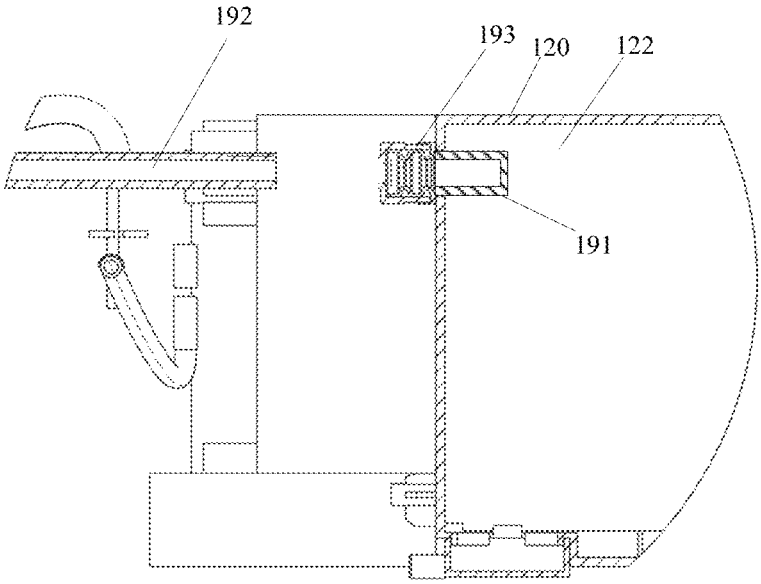
FIG. 12*b* shows a partial structure sectional view of a docking station in an embodiment of the present disclosure, the docking station being at a dirty-water storage space and an integrated box being in a second position.

As shown in FIG. 12*a* and FIG. 12*b*, without limitation, the third sealing element 193 is approximately annular, and its inner wall is sleeved outside the connecting tube 191 and is in interference fit with the connecting tube 191. An outer wall of the third sealing element 193 is located within the waste inlet tube 192 and is in interference fit with the waste inlet tube 192.

For example, the third seal 193 is an elastic rubber element.

In one embodiment, the docking station 100 further includes: a second in-position detector and a third in-position detector, the second in-position detector being configured to detect whether the connecting tube 191 is connected in place to the waste inlet tube 192; and the third in-position detector being configured to detect whether the connecting tube 191 is separated in place from the waste inlet tube 192.

The "connected in place" includes that: the third sealing element 193 is compressed and sealed, which also means a state where the waste inlet tube 192 and the connecting tube 191 are sleeved with each other when the integrated box 120 is in the first position. The "separated in place" includes: a maximum distance at which the waste inlet tube 192 can be separated from the connecting tube 191, which also means a separated state of the waste inlet tube 192 and the connecting tube 191 when the integrated box 120 is in the second position.

For example, if the second in-position detector detects position information, it is indicated that the connecting tube 191 is connected in place to the waste inlet tube 192, which also means that the integrated box 120 is in the first position. If the second in-position detector does not detect the position information, it is indicated that the connecting tube 191 is not connected in place to the waste inlet tube 192, which also means that the integrated box 120 does not reach the first position. If the third in-position detector detects position information, it is indicated that the connecting tube 191 is separated in place from the waste inlet tube 192, which also means that the integrated box 120 is in the second position. If neither the second in-position detector nor the third in-position detector detects the position information, the connecting tube 191 and the waste inlet tube 192 may be in a connected state but are not connected in place; and the connecting tube 191 and the waste inlet tube 192 may also be in a separated state, but are not separated in place.

Without limitation, the second in-position detector and the third in-position detector may both be photoelectric in-position detectors.

Figure 12C:
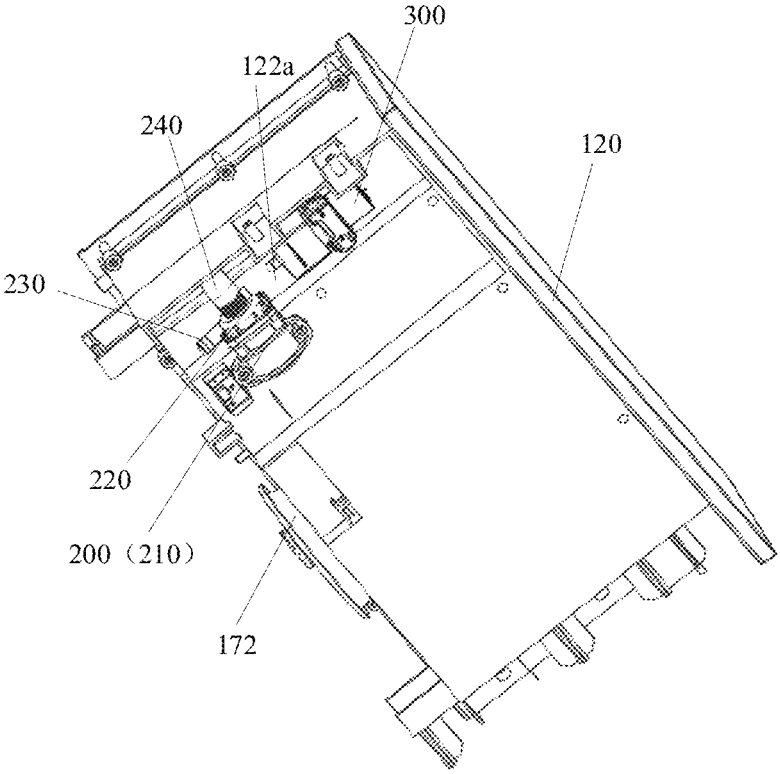
FIG. 12*c* shows a thirteenth partial structure diagram of a docking station provided by an embodiment of the present disclosure.

As shown in FIG. 12*c*, in one embodiment, the docking station 100 further includes: an air pump 300 configured to extract gas from the dirty-water storage space 122, where the air pump 300 is mounted under the integrated box 120, then the air pump 300 may move with the movement of the integrated box 120. The air pump 300 is provided in a way which adapts to switching of the integrated box 120 between the first position and the second position.

After the air pump 300 removes the gas from the dirty-water storage space 122, the dirty-water storage space 122 is in a negative pressure state. Under pressure difference, dirty-water in the docking chamber 111 may be sucked into the connecting tube 191 and the waste inlet tube 192 via the waste discharge port, and then enter the dirty-water storage space 122 via the waste inlet tube 192, achieving cleaning of the dirty-water in the docking chamber 111.

As shown in FIGS. 12*c* to 12*f*, in one embodiment, the docking station 100 further includes: a waste discharge pump 200 for discharging dirty-water from the dirty-water storage space 122, where the waste discharge pump 200 is mounted under the integrated box 120, then the waste discharge pump 200 may move with the movement of the integrated box 120. The waste discharge pump 200 is provided in a way which adapts to the switching of the integrated box 120 between the first position and the second position.

The dirty-water storage space 122 has a dirty-water outlet and a dirty-water inlet, where the dirty-water outlet is disposed lower than the dirty-water inlet to avoid backflow of dirty-water and to better facilitate emptying dirty-water in the dirty-water storage space 122. For example, the dirty-water inlet is disposed at a side wall of the dirty-water storage space and the dirty-water outlet is disposed at a bottom wall of the dirty-water storage space.

Figure 12D:
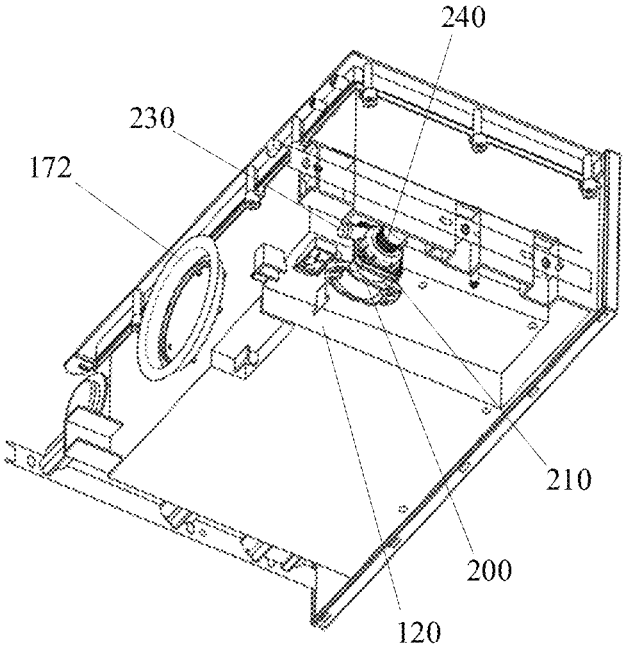
FIG. 12*d* shows a fourteenth partial structure diagram of a docking station provided by an embodiment of the present disclosure.
Figure 12E:
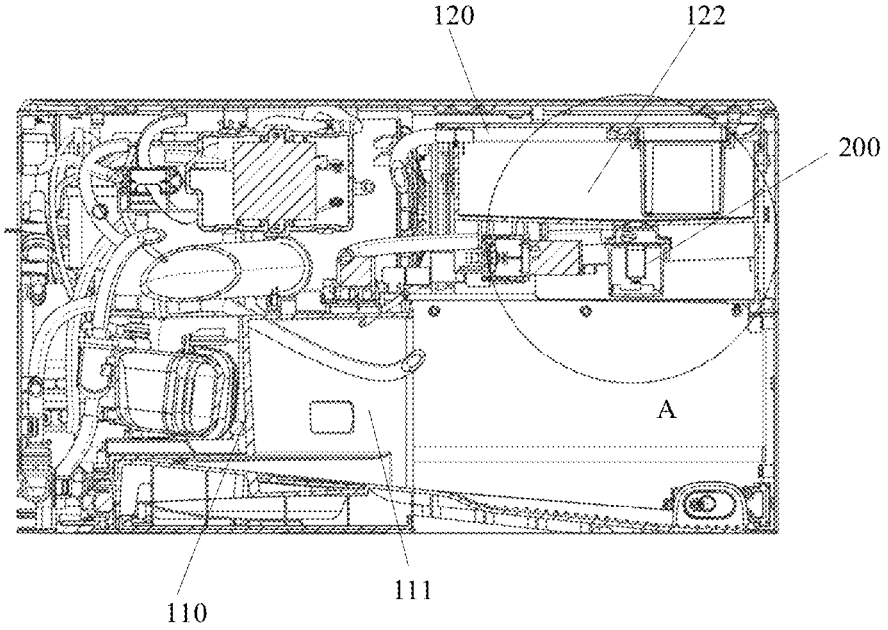
FIG. 12*e* shows a partial structure sectional view of a docking station provided by an embodiment of the present disclosure, the docking station being in proximity to a waste discharge pump.
Figure 12F:
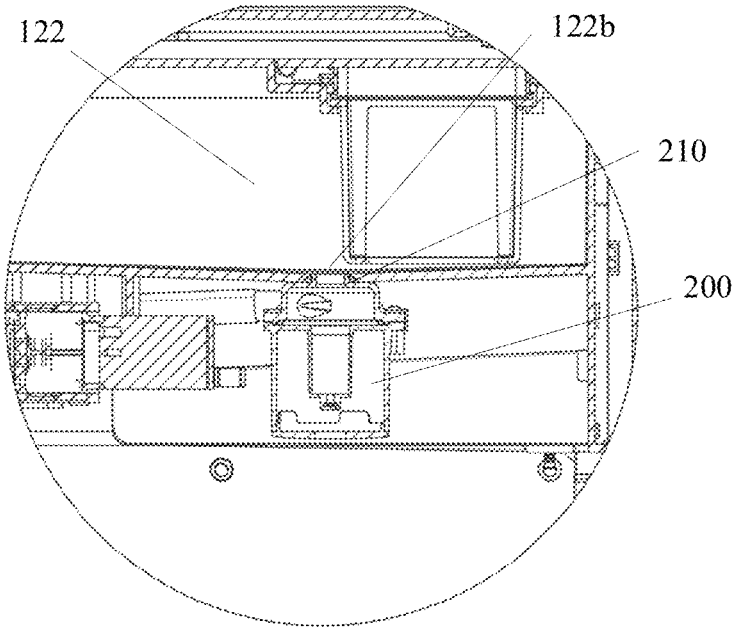
FIG. 12*f* shows an enlarged view of part A in FIG. 12*e*.

As shown in FIG. 12*e* and FIG. 12*f*, in one embodiment, the waste discharge pump 200 is a centrifugal pump, and includes: a pump body, a liquid inlet port 210 through which liquid is introduced into the pump body, and a liquid outlet port (not shown in FIG. 12*e* and FIG. 12*f*); and the liquid inlet port 210 of the waste discharge pump 200 is connected with the dirty-water outlet of the bottom wall of the dirty-water storage space 122. The waste discharge pump 200 can provide a driving force for discharging the dirty-water from the dirty-water storage space 122. The dirty-water in the dirty-water storage space 122 enters the pump body via the liquid inlet port 210 and is subsequently discharged via the liquid outlet port 230 of the pump body. The liquid outlet port 230 may be connected with a waste discharge tube 310 to convey the dirty-water to a floor drain via the waste discharge tube 310.

As shown in FIG. 12*c* and FIG. 12*d*, in one embodiment, the docking station 100 further includes a joint pipe 240 communicating the liquid inlet port 210 with the dirty-water outlet of the bottom wall of the dirty-water storage space 122. The dirty-water in the dirty-water storage space 122 enters the liquid inlet port 210 of the waste discharge pump 200 via the joint pipe 240, and then enters the pump body via the liquid inlet port 210, and is subsequently discharged via the liquid outlet port 230 of the pump body. The liquid outlet port 230 may be connected with a waste discharge tube 310 to convey the dirty-water to a floor drain via the waste discharge tube 310.

In contrast to the embodiment shown in FIG. 12*d*, the joint pipe 240 is not provided in the embodiment shown in FIG. 12*f*, and the liquid inlet port 210 is directly connected with the dirty-water outlet of the bottom wall of the dirty-water storage space 122, which can shorten a distance between the waste discharge pump 200 and the bottom wall of the dirty-water storage space 122, reduce a problem of air trapping in the waste discharge pump 200, and facilitate discharging more dirty-water from the dirty-water storage space 122.

The pump body of the waste discharge pump 200 has an impeller, which is infinitely close to the dirty-water outlet in the bottom wall of the dirty-water storage space 122.

In one embodiment, a distance between the impeller and the bottom wall of the dirty-water storage space 122 is close to 0. For example, the distance between the impeller and the bottom wall of the dirty-water storage space 122 is 0 to 10 mm.

As shown in FIG. 12*f*, in one embodiment, a length of the liquid inlet port 210 is close to 0 mm. The shorter the length of the liquid inlet port 210 is, the more favorable it is for emptying the dirty-water in the dirty-water storage space 122, the easier it is for the pump body to vent gas. Therefore, the pump body is less likely to generate trapped gas, and it is more favorable for improving dirty-water discharging effect. For example, the length of the liquid inlet port is 0-10 mm.

In one embodiment, the waste discharge pump 200 further includes: a first check valve, where the first check valve is connected with the liquid inlet port 210 and the dirty-water storage space 122, and is configured to provide unidirectional passage of fluid in the dirty-water storage space 122 toward a direction of the liquid inlet port, the fluid including liquid and/or gas.

In one embodiment, if a joint pipe 240 is provided between the liquid inlet port 210 and the dirty-water storage space 122, the first check valve is provided on the joint pipe 240 and may be connected with the joint pipe 240 and the dirty-water storage space 122.

Utilizing the first check valve can prevent the liquid and/or gas from flowing back into the dirty-water storage space, ensuring waste discharging effect.

For example, the first check valve may be a duckbill valve.

As in FIG. 12*e*, the waste discharge pump 200 further includes: a fourth sealing element, which is connected to the pump body and surrounds the liquid inlet port 210. The fourth sealing element is hermetically connected to the pump body and the bottom wall of the dirty-water storage space 122, realizing the sealing at the connection between the pump body and the bottom wall of the dirty-water storage space 122 to limit dirty-water leakage.

Figure 13B:
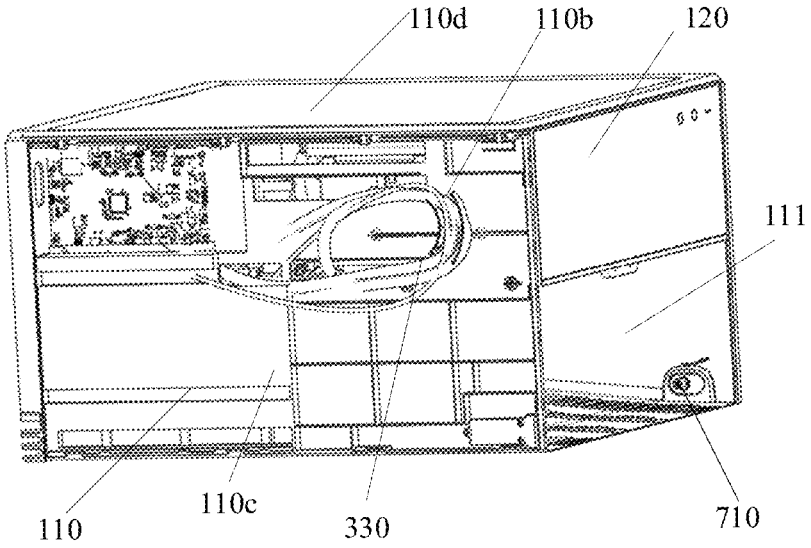
FIG. 13*b* shows a sixteenth partial structure diagram of a docking station provided by an embodiment of the present disclosure.

As described in FIG. 13*a* and FIG. 13*b*, in one embodiment, the docking station 100 further includes: a transfer tube 330 for transferring fluid to the functional space 124 in the integrated box 120 or for outputting fluid from the functional space 124. A first end of the transfer tube 330 is connected to the integrated box 120 or to a first functional element fixed to the integrated box 120; and a second end of the transfer tube 330 is connected to the station body 110 or to a second functional element disposed on the station body 110. When the integrated box 120 is in the first position, there is a redundant part between the first end and the second end of the transfer tube 330; and when the integrated box 120 is in the second position, length of the redundant part between the first end and the second end of the transfer tube 330 is reduced. The redundant part provides a deformable margin for movement of the transfer tube 330 to avoid loss of a transferring function due to dropping of the transfer tube 330 with the movement of the integrated box 120.

The fluid conveyed in the transfer tube 330 includes, but is not limited to, liquid and gas, where the gas may be mixed with liquid and/or solid, and the liquid may be mixed with gas and/or solid.

As shown in FIG. 13*b*, the housing 113 of the station body 110 includes: an inner housing 110*c* and an outer housing 110*d*, where the integrated box 120 is located inside the inner housing 110*c* and the outer housing 110*d* is located outside the inner housing 110*c*, and the redundant part of the transfer tube 330 is at least partially fixed between the inner housing 110*c* and the outer housing 110*d* after passing through the inner housing 110*c*. This tube configuration may ensure that a part of the transfer tube 330 can move flexibly with the movement of the integrated box 120, and also ensure that a part of the transfer tube 330 is bound to the station body 110, reducing contact of the redundant part with other components in the station body 110. Fixing a part of the transfer tube 330 between the inner housing 110*c* and the outer housing 110*d* can also reduce occupancy of interior space of the inner housing 110*c* of the station body 110 by the transfer tube 330, improve a space utilization rate of the docking station 100, and contribute to reduction of the height of the docking station 100.

For example, as shown in FIG. 13*b*, a side of the inner housing 110*c* toward the outer housing 110*d* has a tube catch groove 110*b*, and at least part of the redundant part of the transfer tube 330 is disposed in the tube catch groove 110*b*. When the integrated box 120 moves, if the redundant part needs to move, the redundant part may move along the tube catch groove 110*b*, and the tube catch groove 110*b* has a better fixing and guiding effect on the transfer tube 330.

As shown in FIG. 13*a*, in one embodiment, the redundant part of the transfer tube 330 are located inside the inner housing 110*c*, and a plurality of transfer tubes 330 may also be fixed using connecting buckles.

Without limitation, the first functional element connected to the transfer tube 330 and fixed to the integrated box 120 may be a waste discharge pump 200. As shown in FIG. 13*a* and FIG. 13*b*, the transfer tube 330 includes a waste discharge tube 310, where one end of the waste discharge tube 310 is connected with the waste discharge pump 200, and the other end thereof may be fixed to a holder of the station body 110 and connected with a floor drain to discharge dirty-water discharged by the waste discharge pump 200 into the floor drain.

In addition, the transfer tube 330 may further include the above-mentioned waste inlet tube 192.

As shown in FIG. 4*b*, in one embodiment, as shown in FIG. 13*a*, the transfer tube 330 may further include a cleaning agent conveying tube 320, where one end of the cleaning agent conveying tube 320 is connected to the integrated box 120 and is connected with the cleaning agent storage space 123, and the other end of the cleaning agent conveying tube 320 may be connected with a valve or a liquid pipeline (the valve and the liquid pipeline are two forms of the second functional element described above) in the station body 100 leading to the docking chamber 111, so that a cleaning agent in the cleaning agent storage space 123 can be mixed with a cleaning liquid, which can improve cleaning effect of the cleaning assembly 510.

Without limitation, the cleaning agent and the cleaning liquid may be mixed in the valve. For example, the cleaning agent and the cleaning liquid are respectively led to two different inlets of the valve (e.g., the four-way valve 604 or the five-way valve 605 described below), and then the mixed cleaning agent and cleaning liquid flows out of the same outlet of the valve. Alternatively, the cleaning agent and the cleaning liquid may be mixed in the liquid pipeline, for example, the cleaning agent is introduced into the liquid pipeline for transferring the cleaning liquid to mix the cleaning agent and the cleaning liquid in the liquid pipeline.

When the transfer tube 330 is at least one of the waste discharge tube 310, the waste inlet tube 192, and the cleaning agent conveying tube 320 described above, the fluid conveyed by the transfer tube 330 is liquid. In addition, the transfer tube 330 may also be the dust collection tube 180 described below, at this time, the fluid conveyed by the transfer tube 330 is gas mixed with solid dirt.

Figure 14A:
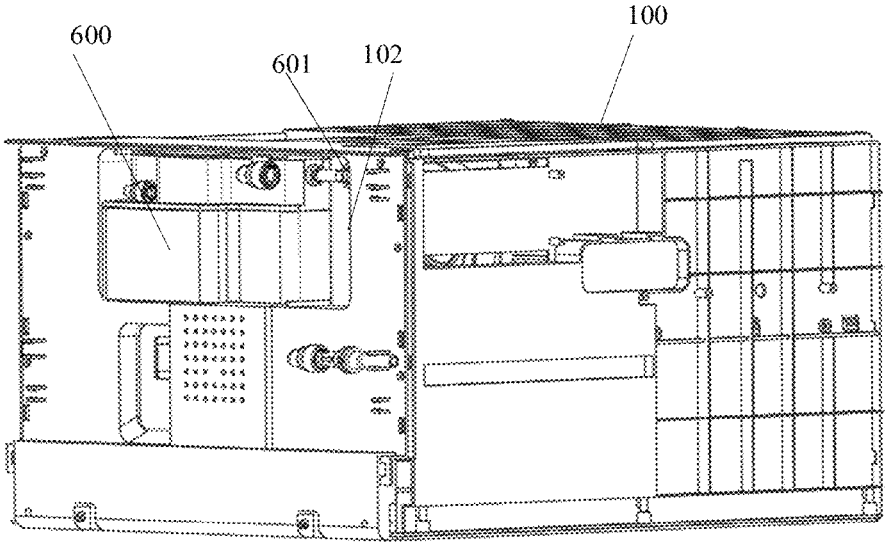
FIG. 14*a* shows a partial structure diagram of a docking station provided in an embodiment of the present disclosure, provided with a built-in clean water tank.

As shown in FIG. 14*a*, in one embodiment, the docking station 100 further includes: a clean water tank 600, and the station body 110 further includes: a mounting chamber 102, the clean water tank 600 being disposed in the mounting chamber 102.

The clean water tank 600, as a liquid supply source, may be connected with a liquid pipeline in the station body 110 via a liquid pipeline joint 601 to realize providing cleaning liquid to at least one liquid pipeline in the station body 110. The at least one liquid pipeline may be marked as: a first liquid pipeline, a second liquid pipeline . . . an $m_{th}$ liquid pipeline. For example, the first liquid pipeline may be utilized to convey a cleaning liquid for cleaning the cleaning assembly 510 into the docking chamber 111, and the second liquid pipeline may be utilized to replenish liquid for the self-moving cleaning apparatus 500. A plurality of liquid pipelines may realize different liquid-supply functions to satisfy different liquid-supply needs.

For example, the clean water tank 600 may be located above the docking chamber 111.

Figure 24:
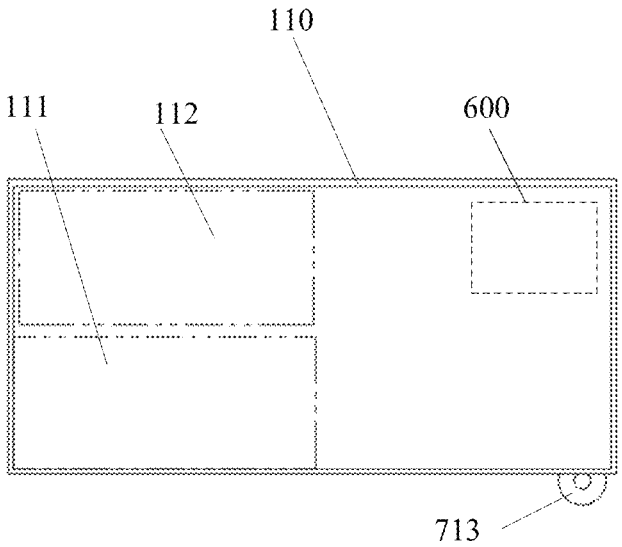
FIG. 24 shows a partial structure diagram of a docking station in an embodiment of the present disclosure, displaying a roller.

Without limitation, a relative position of the clean water tank 600 to the station body 110 may be that: the clean water tank 600 is located on a left side, a right side, or a rear side of the station body 110, where the clean water tank 600 being on the rear side of the station body 110 refers to that: the clean water tank 600 is located between the integrated box 120 and a rear wall of the station body 110. More preferably, as shown in FIG. 14*d* and FIG. 24, the clean water tank 600 is located above the docking chamber 111, and the clean water tank 600 is located on a rear side of the integrated box 120 and close to the rear wall of the station body 110.

In some examples, the rear wall of the station body 110 is a rear housing 110*e* of the station body 100.

In the embodiment shown in FIG. 14*a*, the mounting chamber 102 is located in the station body 110, and the docking station 100 may be closer to an external water source. For example, the docking station 100 may be placed near a tap water pipe. At this time, a first external pipeline that is shorter may be used to connect the external water source and the clean water tank 600, reducing the risk of possible intertwinement, extrusion, water leakage, etc., due to the docking of the first external pipeline. Generally, when the clean water tank 600 is located in the mounting chamber 102, standard components may be used for both the first pipeline and a joint connecting the first pipeline and the clean water tank 600, with the length of the standard components being within a safer usable range.

When the clean water tank 600 is located in the mounting chamber 102, an application scenario for the docking station 100 includes, but is not limited to that: the docking station 100 is located under an appliance which is connected with an external water source so that the clean water tank 600 and the appliance share a set of water line system. For example, the docking station 100 may be located under or on a sidewall of an household electrical appliance such as a laundry machine or toilet, and the docking station 100 shares a water line system with these appliances; or, the docking station 100 may be located under, on a sidewall of, or inside a cabinet such as a cupboard and a restroom cabinet. For example, the docking station 100 may share a water line system with a dishwasher in the cupboard, or, the docking station 100 may share a water line system with a basin of the restroom cabinet.

In addition, the docking station 100 may be placed adjacent to an apparatus containing a water line of a water source. For example, the docking station 100 may share the water line of the water source with an apparatus such as a water purifier, a water dispenser, and a tea bar machine.

Figure 14B:
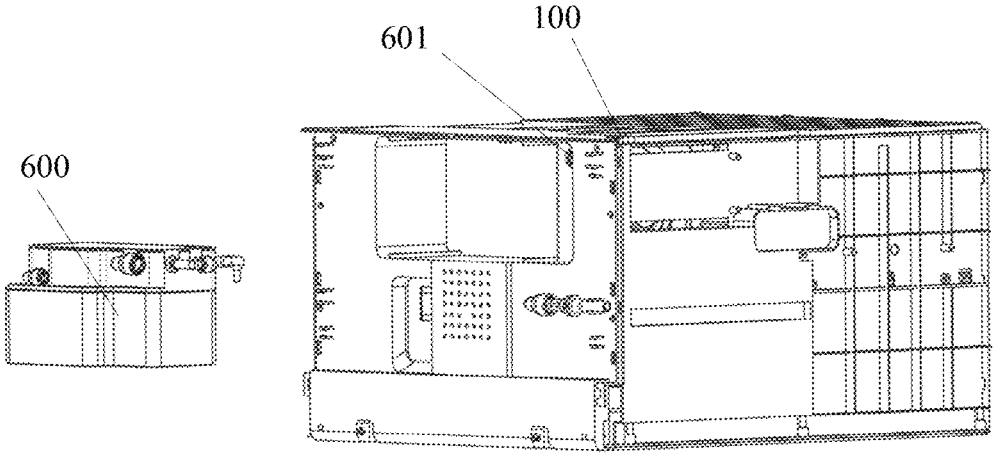
FIG. 14*b* shows a structure diagram of a relative position between a docking station and a clean water tank in an embodiment of the present disclosure, the clean water tank placed outside.

As shown in FIG. 14*b*, in one embodiment, the clean water tank 600 may not be located in the mounting chamber 102, and is provided separately from the station body 110. An additional pipeline may be used to communicate the clean water tank 600 with the liquid pipeline joint 601 to realize liquid supply for the docking station 100 by the clean water tank 600.

As in the embodiment shown in FIG. 14*b*, the clean water tank 600 is externally placed. The clean water tank 600 may be individually placed closer to an external water source, and the docking station 100 may be placed away from the external water source. For example, the docking station 100 may be located in a space away from the external water source such as a living room and a bedroom.

If a location where a user needs to place the docking station 100 is far away from the external water source, the clean water tank 600 may be placed externally so that the clean water tank 600 is placed individually close to the external water source. Providing the clean water tank 600 close to the external water source can shorten a distance between the clean water tank 600 and the external water source, which is then favorable to reducing water pressure borne by the first external pipeline communicating the external water source and the clean water tank 600, and is favorable to decreasing the problem of water leakage due to rupture of the first external pipeline.

Without limitation, the clean water tank 600 is detachably mounted in the mounting chamber 102, and when the clean water tank 600 is required to be externally placed, the clean water tank 600 may be detached and taken out of the mounting chamber 102 and then placed close to the external water source. When there is no need for the clean water tank 600 to be externally placed, the clean water tank 600 may be maintained in a state of being located in the mounting chamber 102. This way of providing the water tank 600 can satisfy different needs and enrich an application scenario of the docking station 100.

Figure 14C:
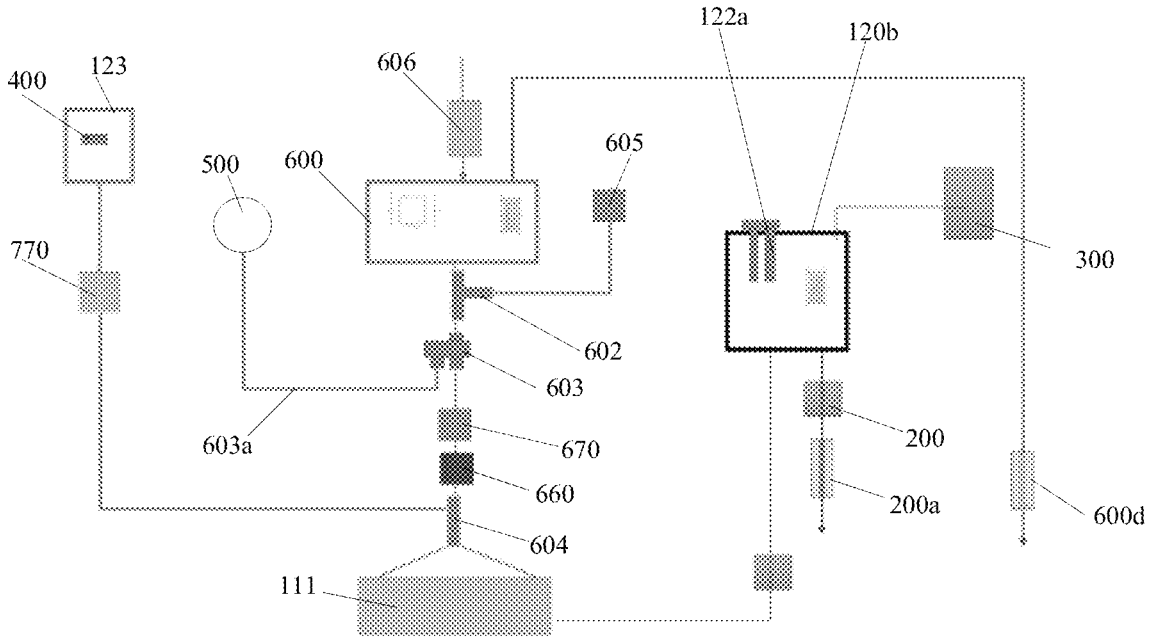
FIG. 14*c* shows a structure diagram of an automatic water supply and drainage system in a docking station provided in an embodiment of the present disclosure.
Figure 14D:
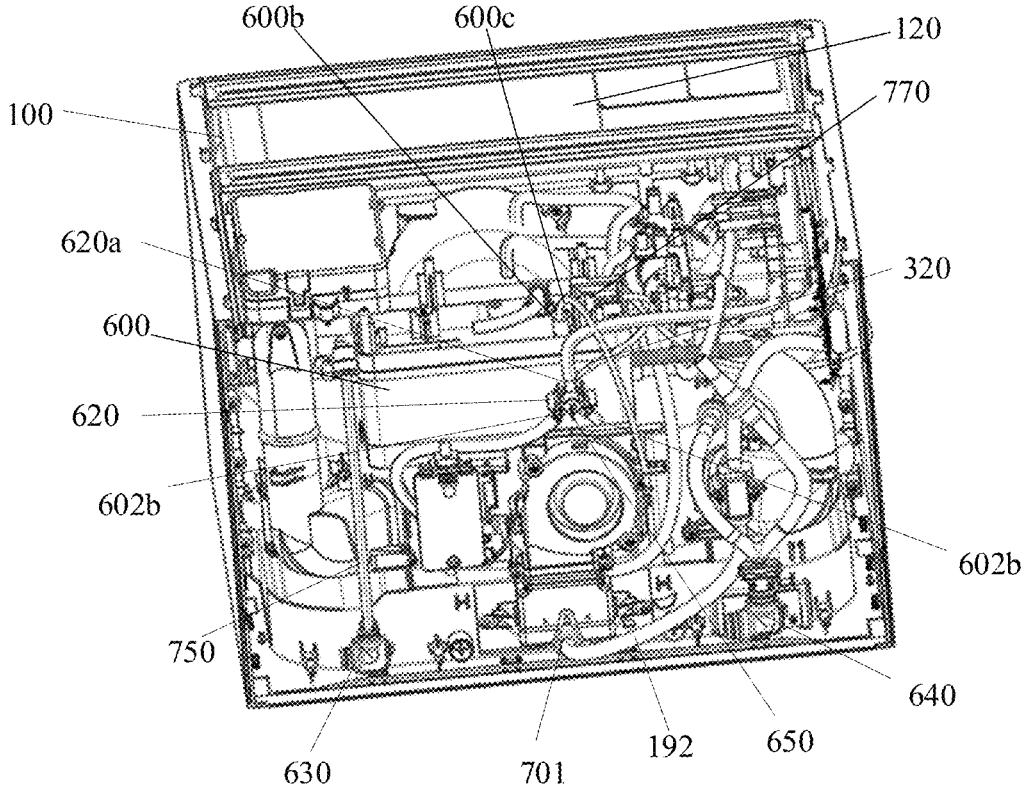
FIG. 14*d* shows a seventeenth partial structure diagram of a docking station provided by an embodiment of the present disclosure.

As shown in FIG. 14*c* and FIG. 14*d*, in one embodiment, the docking station 100 further includes: at least one of the following mounted on the clean water tank 600: a four-way valve 604, a five-way valve 620, and a cleaning agent transfer pump 770. By mounting at least one of the four-way valve 604, the five-way valve 620, and the cleaning agent transfer pump 770 on the clean water tank 600, it is possible to improve an integration level of the clean water tank 600 and fully utilize an internal space of the station body, which contributes to reducing the height of the docking station.

As shown in FIG. 14*c*, four ports of the four-way valve 604 respectively include: a cleaning liquid inlet port, a cleaning agent inlet port, and two cleaning liquid outlet ports. The two cleaning liquid outlet ports are connected with the docking chamber 111 via two transfer tubes respectively to transfer cleaning liquid to the docking chamber 111. In contrast to the four-way valve 604 shown in FIG. 14*c*, in FIG. 14*d*, the five-way valve 620 has an additional port which is a containing port for containing a temperature detection element 650 in addition to the cleaning liquid inlet-port, the cleaning agent inlet port 620*a*, and the two cleaning liquid outlet ports 620*b*. The temperature detection element 650 is configured to detect a temperature of the cleaning liquid leading into the docking chamber 111, so as to ensure that the temperature of the cleaning liquid leading into the docking chamber 111 is within a certain temperature range, which enables the cleaning liquid to both wash off greasy dirt on the cleaning assembly 510 and reduce damage to the docking station 100 and the self-moving cleaning apparatus 500 due to an excessive temperature.

For example, the temperature detection element 650 is an NTC (Negative Temperature Coefficient) temperature sensor.

In the embodiment shown in FIG. 14*d*, the five-way valve 620 and the cleaning agent transfer pump 770 are mounted on the clean water tank 600. In contrast to the four-way valve 604, the five-way valve 620 can further carry the temperature detection element 650 without the need for an additional holder for mounting the temperature detection element 650. Therefore, using the five-way valve 620 can further improve a space utilization rate, and is further favorable to reducing the height of the docking station.

As shown in FIG. 14*c*, the cleaning liquid flowing to the cleaning liquid inlet-port comes from the clean water tank 600.

As shown in FIG. 14*c* and FIG. 14*d*, the cleaning agent transfer pump 770 is configured to transfer the cleaning agent in the cleaning agent storage space 123 to the cleaning agent inlet port 620*a* of the four-way valve 604 or the five-way valve 620. The cleaning agent is transferred to the cleaning agent inlet-port 620*a* by the cleaning agent transfer pump 770 and mixed with the clean liquid entered from the cleaning liquid inlet-port, and subsequently the mixed solution enters the transfer tube via the cleaning liquid outlet-port 620*b*, and is transferred by the transfer tube to the docking chamber 111, so that the cleaning liquid entering the docking chamber 111 is mixed with the cleaning agent.

Without limitation, the cleaning agent transfer pump 770 may be a peristaltic pump.

As shown in FIG. 14*d*, for example, the cleaning agent transfer pump 770 is mounted on the top of the clean water tank 600.

Figure 14E:
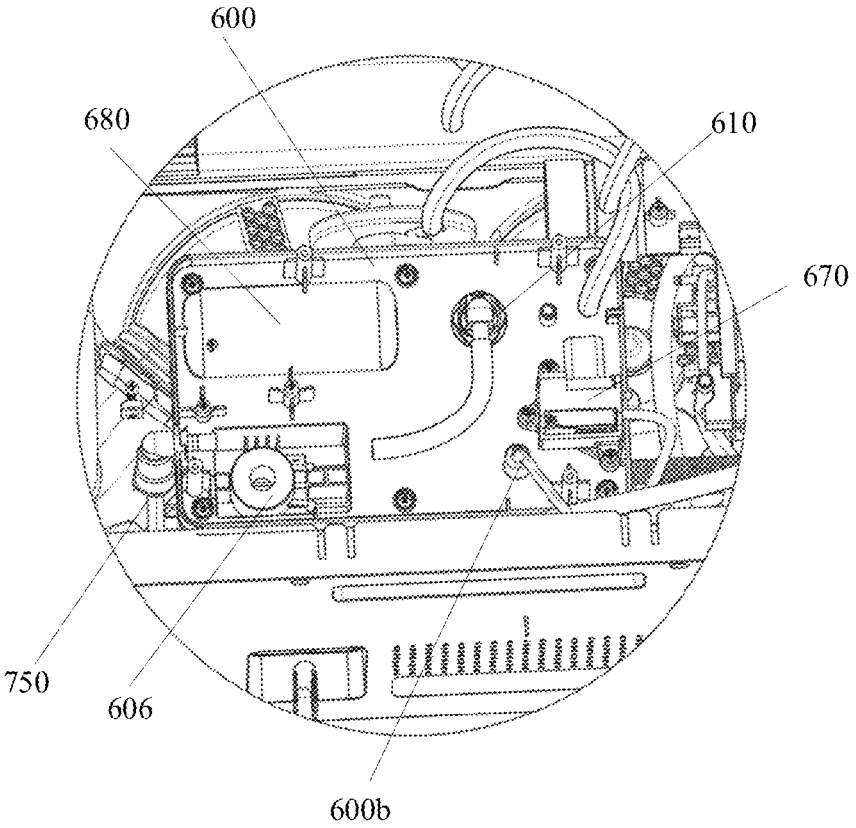
FIG. 14*e* shows a partial structure diagram of a docking station provided in an embodiment of the present disclosure, including a top wall of a clean water tank.

As shown in FIG. 14*d* and FIG. 14*e*, in one embodiment, the clean water tank 600 has a liquid storage chamber and an overflow hole 600*b*, where the liquid storage chamber is configured to contain cleaning liquid, and the overflow hole 600*b* is connected with the liquid storage chamber for passage of potential overflowing liquid.

In one embodiment, as shown in FIG. 14*d*, the overflow pipeline 600*c* may be utilized to communicate the overflow hole 600*b* with the docking chamber 111, so as to lead the overflowing liquid into the docking chamber 111; and the overflowing liquid may also be configured to clean the cleaning assembly 510 to realize more rational usage of water resources. In addition, after entering the docking chamber 111, the overflowing liquid may also be sucked into the wastewater storage space 122 and discharged from the dirty-water storage space 122.

As shown in FIG. 14*c*, the docking station 100 further includes a second check valve 600*d*, which is used for passage of the cleaning liquid flowing out of the overflow hole 600*b*, instead of guiding the liquid to the overflow hole 600*b* reversely.

In one embodiment, as shown in FIG. 14*e*, the docking station 100 further includes an electromagnetic decompression integral valve 606 and a cleaning liquid transfer pump 670 which are mounted on the clean water tank 600. The cleaning liquid transfer pump 670 is configured to extract the cleaning liquid in the clean water tank 600 and provide transfer power for the flow of the cleaning liquid to the docking chamber 111. The electromagnetic decompression integral valve 606 is configured to allow/disallow the flowing of the cleaning liquid to the liquid storage chamber and perform decompression on the cleaning liquid flowing to the liquid storage chamber. In this example, the electromagnetic decompression integral valve 606 and the cleaning liquid transfer pump 670 are integrated on the clean water tank 600, without the need for an additional holder to mount the electromagnetic decompression integral valve 606 and the cleaning liquid transfer pump 670, which can improve the internal space utilization of the docking station 100. Moreover, an electromagnetic valve for allowing/disallowing the flowing of the cleaning liquid to the liquid storage chamber and a decompression valve for performing decompression on the cleaning liquid are combined to form the electromagnetic decompression integral valve 606, which reduces space occupation in the station body 110, and is further favorable to reducing the height of the docking station 100. For example, as shown in FIG. 14*e*, both the electromagnetic decompression integrated valve 606 and the cleaning liquid transfer pump 670 may be mounted on the top of the clean water tank 600. Cleaning liquid flowing out of the electromagnetic decompression integral valve 606 enters the liquid storage chamber of the clean water tank 600 via a water inlet port 610 on the top of the clean water tank 600.

As shown in FIG. 14*c*, the cleaning liquid flowing out of an external water source is decompressed by the electromagnetic decompression integral valve 606 and then enters the liquid storage chamber, which can reduce impact on water usage of the docking station due to excessive pressure or unstable pressure of the external water source.

Without limitation, the clean water tank 600 further includes: a float valve and a sterilizing module, the float valve being configured to control a liquid level of the cleaning liquid in the liquid storage chamber to ensure reliability of water supply and drainage. The sterilizing module is configured to sterilize the cleaning liquid in the liquid storage chamber to reduce bacterial growth in the cleaning liquid, thereby ensuring hygiene of the cleaning liquid.

For example, the sterilizing module is a silver ion sterilizing module.

For example, the cleaning liquid transfer pump 670 is a peristaltic pump.

Figure 15:
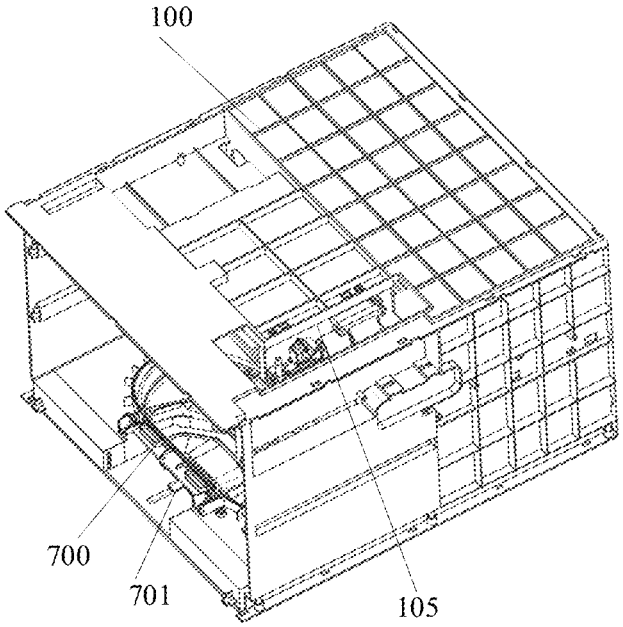
FIG. 15 shows a partial structure diagram of a docking station in an embodiment of the present disclosure, displaying an integrated module holder.

As shown in combination with FIG. 14*c* and FIG. 15, in one embodiment, the docking station 100 further includes an integrated module holder 105, which is connected to the station body 110 and carries at least a heating module 660. The heating module 660 is configured to heat the cleaning liquid flowing to the docking chamber 111.

In one embodiment, as shown in FIG. 14*c*, after extracting the cleaning liquid from the clean water tank 600, the cleaning liquid transfer pump 670 transfers the cleaning liquid to the heating module 660; and the cleaning liquid is conveyed to the docking chamber 111 after the heating module heats the cleaning fluid. Cleaning the cleaning assembly 510 of the self-moving cleaning apparatus 500 with the heated cleaning liquid can remove stubborn stains such as greasy dirt, which is favorable to improving cleaning effect on the cleaning assembly 510.

In one embodiment, after extracting the cleaning liquid from the clean water tank 600, the cleaning liquid transfer pump 670 may transfer the cleaning liquid directly to the docking chamber 111 without the cleaning liquid passing through the heating module 660.

For example, the heating module 660 is an instant heating module, and the instant heating module has a higher heating efficiency.

As shown in FIG. 14*c*, in one embodiment, the integrated module holder 105 is also configured to carry: an anti-siphon valve 605, a three-way pipe 602, and a three-way valve 603. The anti-siphon valve 605 is configured to restrict the cleaning liquid flowing out of the clean water tank 600 from returning to the clean water tank 600 by siphoning; three ports of the three-way pipe 602 respectively include: a first port connected with a water outlet port of the clean water tank 600, a second port connected with the anti-siphon valve 605, and a third port for outputting the cleaning liquid; and three ports of the three-way valve 603 respectively include: a liquid inlet port connected with the third port, a first liquid outlet port leading to the cleaning liquid transfer pump 670, and a second liquid outlet port leading to the liquid storage tank in the self-moving cleaning apparatus 500. Utilizing the integrated module holder 105 to integrate multiple components can further improve the internal space utilization rate of the station body 110, which is favorable to further reducing the height of the docking station 100.

For example, as shown in FIG. 14*c*, after the cleaning liquid flowing out of the liquid storage chamber of the clean water tank 600 enters the first port of the three-way pipe 602, the cleaning liquid passes into the liquid inlet-port of the three-way valve 603 via the third port of the three-way pipe 602, and is divided by the three-way valve 603 into two fluid branches. One fluid branch flows from the first liquid outlet-port to the cleaning liquid transfer pump 670, then enters the cleaning liquid inlet-port of the above-mentioned four-way valve 604 or five-way valve 620, and finally enters the docking chamber 111 to clean the cleaning assembly 510. The other fluid branch may pass into the self-moving cleaning apparatus 500 through the replenishment pipeline 603*a* to replenish liquid for the self-moving cleaning apparatus 500.

Figure 16A:
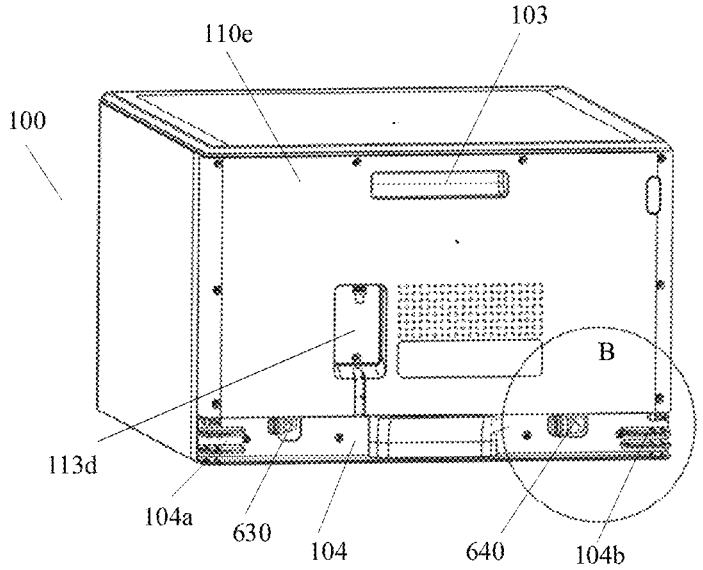
FIG. 16*a* shows an eighteenth partial structure diagram of a docking station provided by an embodiment of the present disclosure.
Figure 16B:
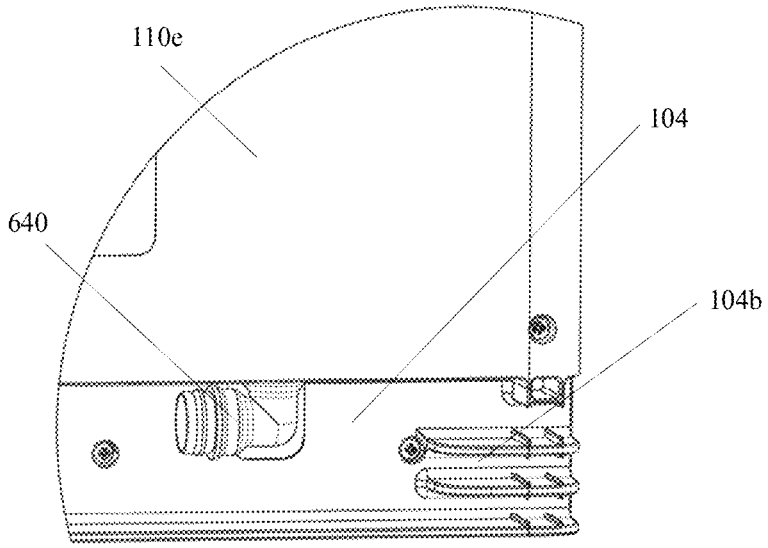
FIG. 16*b* shows an enlarged view of place B in FIG. 16*a*.

As shown in FIGS. 14*d*, 16*a*, and 16*b*, in one embodiment, the docking station 100 further includes: a liquid inlet tube 750, a liquid inlet joint 630, and a liquid outlet joint 640. The liquid inlet joint 630 is connected with the liquid inlet tube 750 and an external water source to transfer the cleaning liquid from the external water source to the liquid inlet tube 750. The liquid inlet tube 750 is connected with the clean water tank 600, and the cleaning liquid entering the liquid inlet tube 750 will enter the clean water tank 600 to replenish liquid for the clean water tank 600. A liquid inlet end of the liquid outlet joint 640 is connected to the waste discharge tube 310, and the liquid outlet joint 640 is used for passage of dirty-water flowing out of the waste discharge tube 310. The rear housing 110*e* of the station body 110 has: a groove 104, where the groove 104 is configured to contain the liquid inlet joint 630 and the liquid outlet joint 640 so that the liquid inlet joint 630 and the liquid outlet joint 640 do not protrude from the rear housing 110*e* of the station body 110.

By providing the groove 104 to contain the liquid outlet joint 640 and the liquid inlet joint 630, it is possible to prevent the liquid outlet joint 640 and the liquid inlet joint 630 from protruding from the rear housing 110*e*, and thus the rear housing 110*e* can be provided against a wall, reducing installation space occupied by the docking station 100.

Cleaning liquid flowing out of an external water source may flow to the clean water tank 600 via the liquid inlet joint 630, and the liquid flowing out of the dirty-water storage space 122 may flow to the liquid outlet joint 640 via the waste discharge tube 310, and then flow to the floor drain via the liquid outlet joint 640, realizing discharge of dirty-water.

After a placement location of the docking station 100 is determined, a first external pipeline fitted with a first distance is selected based on the first distance between the liquid inlet joint 630 and the external water source and is connected with the liquid inlet joint 630 and the external water source; and a second external pipeline fitted with a second distance is selected based on the second distance between the liquid outlet joint 640 and the floor drain, making the dirty-water flowing out of the liquid outlet joint 640 flow to the floor drain.

In one embodiment, the liquid inlet joint 630 is rotatably connected to the liquid inlet tube 750, and/or, the liquid outlet joint 640 is rotatably connected to the waste discharge tube 310.

As shown in FIG. 16*a* and FIG. 16*b*, the rotatable liquid inlet joint 630 and liquid outlet joint 640 can independently adjust orientations of the liquid inlet joint 630 and the liquid outlet joint 640 respectively as needed, and thus can adapt to different installation environments. Moreover, a rotation may also be utilized to realize that both the liquid inlet joint 630 and the liquid outlet joint 640 are oriented towards a side wall of the docking station 100, and thus the first external pipeline connected with the liquid inlet joint 630 and the second external pipeline connected with the liquid outlet joint 640 can be arranged left and right.

In the embodiments shown in FIG. 16*a* and FIG. 16*b*, the liquid inlet joint 630 and the liquid outlet joint 640 are both rotatable and may both have a first state and a second state by rotation. The first state is: a state in which an axial cross section of the liquid inlet joint 630 is approximately perpendicular to a plane where the rear housing 110*e* is located, or, a state in which an axial cross section of the liquid outlet joint 640 is approximately perpendicular to the plane where the rear housing 110*e* is located. The second state is: a state in which the axial cross section of the liquid inlet joint 630 is approximately parallel to the plane where the rear housing 110*e* is located, or, a state in which the axial cross section of the liquid outlet joint 640 is approximately parallel to the plane where the rear housing 110*e* is located. The liquid inlet joint 630 and the liquid outlet joints 640 shown in FIG. 16*a* and FIG. 16*b* are both in the second state. Two examples are included when both the liquid inlet joint 630 and the liquid outlet joint 640 are disposed in the groove 104. In the first example, the liquid inlet joint 630 in the first state or the second state and the liquid outlet joint 640 in the first state or the second state are both located in the groove 104, at this time, the docking station 100 can be provided against a wall regardless of the states of the liquid inlet joint 630 and the liquid outlet joint 640. In the second example, only the liquid inlet joint 630 and the liquid outlet joint 640 in the second state are located in the groove 104, and the liquid inlet joint 630 and the liquid outlet joint 640 in the first state are located outside the groove 104; and thus, in the first state, the liquid inlet joint 630 and the liquid outlet joint 640 will protrude from the rear housing 110*e*, and the docking station 100 cannot be placed against a wall. Only when both the liquid inlet joint 630 and the liquid outlet joint 640 are in the second state, the docking station can be placed against a wall. It can be understood that in contrast to the first example, the second example can realize that the docking station 100 is placed against a wall, and a distance between the rear housing of the docking station 100 and a front side and a rear side of the docking station 100 where the exterior decorative panel 120*e* is located is shorter, which is more favorable to reducing volume of the docking station 100.

In one embodiment, the rear housing 110*e* further has: a first limit groove 104*a* and a second limit groove 104*b*, where both the first limit groove 104*a* and the second limit groove 104*b* are located in the groove 104. The first limit groove 104*a* is configured to contain the first external pipeline connected to the liquid inlet joint 630, and the second limit groove 104*b* is configured to contain the second external pipeline connected to the liquid outlet joint 640. The first external pipeline may be limited and guided by the first limit groove 104*a*, and the second external pipeline may be limited and guided by the second limit groove 104*b*, which reduces a phenomenon of the first external pipeline and the second external pipeline protruding from the outer housing 110*d*, and improves connection reliability of the first external pipeline and the second external pipeline.

Figure 17:
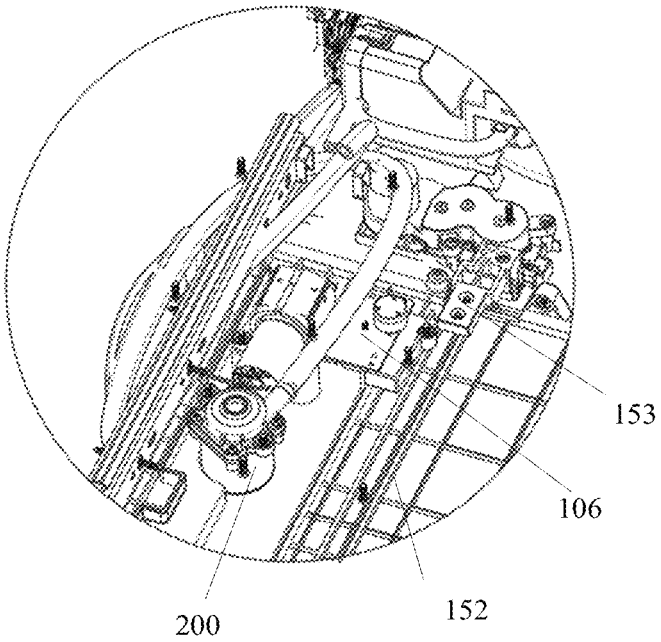
FIG. 17 shows a partial structure diagram of a docking station in an embodiment of the present disclosure, displaying a transit board.

As shown in FIG. 17, in one embodiment, the docking station 100 further includes: a transit board 106, at least two first wires, and at least one second wire. The transit board 106 is connected to the station body 110; one end of the first wire is connected to a first electrical component fixed to the integrated box 120, and the other end of the first wire is connected to the transit board 106; and the second wire is connected to the transit board and a main control module, the main control module being at least configured to: transmit control information for driving the movement of the integrated box 120 via the first wire and the second wire.

During a moving process of the first electrical component along with the integrated box 120, a wire of the first electrical component which is connected to the main control module will be pulled, and after its frequent movement, the wires electrically connecting the first electrical component and the main control module will be prone to problems such as loose connection and wire damage due to pulling. Wires that are located on the first electrical component and connected to the main control module can be classified into a first wire and a second wire by means of the transit board 106, where the first wire may move with the movement of the integrated box 120 while the second wire will not be pulled, and the first wire is closer to the integrated box 120, which may reduce pulling of the line during the moving process of the integrated box 120 and have a higher reliability.

The first wire may be a flexible printed circuit.

A plurality of first wires are respectively noted as first wire A, first wire B, first wire C . . . first wire N. Without limitation, the first wire A is a wire electrically connected to the air pump 300, and the first wire B is a wire electrically connected to the waste discharge pump 200 . . . and the like. Devices for signal transmission on the air pump 300 and the waste discharge pump 200 are all first electrical components.

Figure 18:
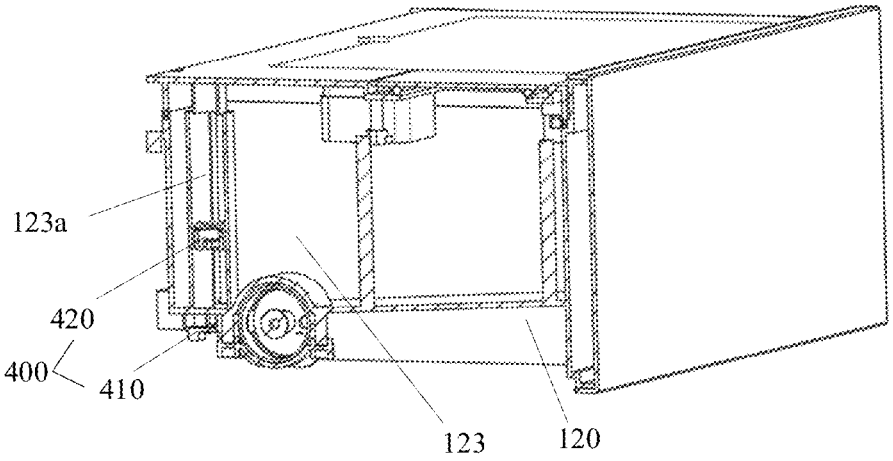
FIG. 18 shows a partial structure section view of a docking station provided by an embodiment of the present disclosure, the docking station located at a cleaning agent detector.

In one embodiment, the first wire may also be electrically connected to a second electrical component, the second electrical component being an electrical component that is not fixed to the integrated box 120. That is, the transit board 106 may be configured to transfer other electrical components than the first electrical component. For example, the first wire also includes some wires electrically connected to the heating module 660. As shown in FIG. 18, in one embodiment, the integrated box 120 further includes a cleaning agent detector 400 configured to detect a liquid level of the cleaning agent in the cleaning agent storage space 123, at least a part of the cleaning agent detector 400 being located in the cleaning agent storage space 123. The cleaning agent detector 400 may remind a user to replenish the cleaning agent when detecting that the liquid level of the cleaning agent is lower than a preset liquid level of the cleaning agent.

Without limitation, the wire electrically connected to the cleaning agent detector 400 may be a part of the first wire described above. For example, the cleaning agent detector 400 is a Hall liquid level sensor.

As shown in FIG. 18, in one embodiment, the cleaning agent detector 400 includes: a Hall sensing element 410 and a magnetic float 420. The magnetic float 420 is located in the cleaning agent storage space 123. The Hall sensing element 410 is configured to sense a Hall detection parameter obtained by a magnetic field generated by the magnetic float 420, and the Hall detection parameter may be configured to determine a position where the magnetic float 420 is located. Generally, the position where the magnetic float 420 is located is a liquid level position of the cleaning agent in the cleaning agent storage space 123.

Exemplarily, the Hall sensing element 410 may be located outside the cleaning agent storage space 123. For example, the Hall sensing element 410 is located at the bottom of the integrated box 120, as shown in FIG. 18. This may reduce an effect of the cleaning agent on the Hall sensing element 410 and improve a service life of the Hall sensing element 410.

As shown in FIG. 18, without limitation, the integrated box 120 further includes a float guiding groove 123*a* located in the cleaning agent storage space 123, where the float guiding groove 123*a* is perpendicular or approximately perpendicular to a horizontal plane, and the magnetic float 420 is disposed in the float guiding groove 123*a*. Affected by a buoyancy force of the cleaning agent, the magnetic float 420 may float in the float guiding groove 123*a* to limit a floating trajectory of the magnetic float 420, so that the magnetic float 420 comes close to the Hall sensing element 410, ensuring the detection accuracy of the Hall sensing element 410.

Figure 19:
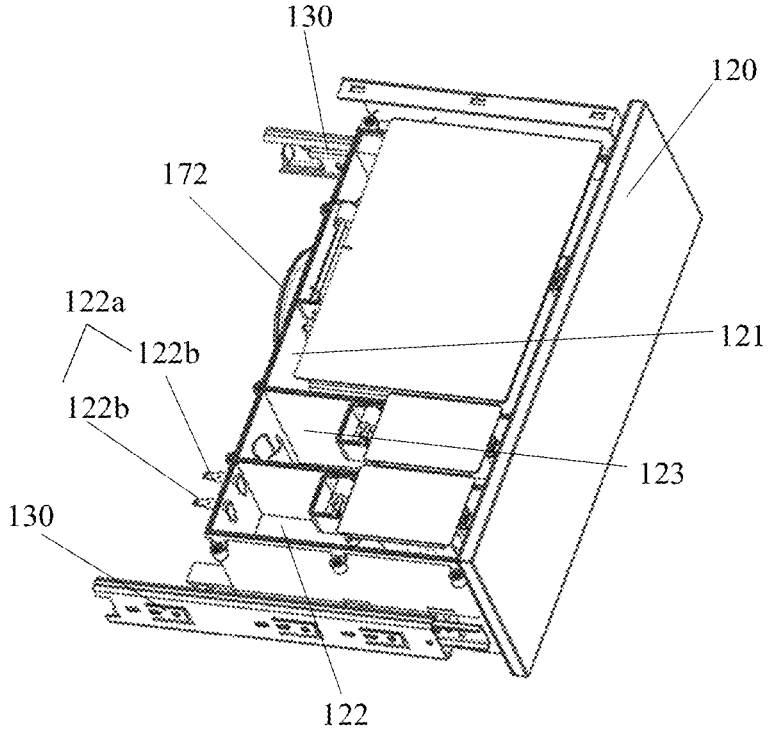
FIG. 19 shows a nineteenth partial structure diagram of a docking station provided by an embodiment of the present disclosure.

As shown in FIG. 19, in one embodiment, the integrated box 120 further includes a dirty-water level detector 122*a* configured to detect a maximum allowable liquid level of dirty-water in the dirty-water storage space 122, at least part of the dirty-water level detector 122*a* being located in the dirty-water storage space 122. When the dirty-water level detector 122*a* detects an electrical signal, it is indicated that a liquid level in the dirty-water storage space 122 has reached a maximum liquid level. At this time, a pipeline related to dirty-water transfer may be clogged, resulting in that the dirty-water in the dirty-water storage space 122 cannot be discharged, and it is necessary to remind the user to inspect or repair the docking station 100.

As shown in FIG. 19, for example, the dirty-water level detector 122*a* is located above the dirty-water storage space 122.

For example, the dirty-water entering the dirty-water storage space 122 may be discharged in time, at this time, the dirty-water level detector 122*a* may be configured to indicate whether a blockage has occurred in the dirty-water storage space 122. For example, if there is no blockage of the pipeline related to the dirty-water transfer, the dirty-water level in the dirty-water storage space 122 will not reach the dirty-water level detector 122, and the dirty-water level detector 122 will not detect an electrical signal. Conversely, if there is blockage of the pipeline related to the dirty-water transfer, the dirty-water level in the dirty-water storage space 122 reaches the dirty-water level detector 122, and the dirty-water level detector 122 detects the electrical signal. In this way, a detection number of the dirty-water level can be reduced, which is favorable to reducing power consumption.

Alternatively, the dirty-water entering the dirty-water storage space 122 will not be discharged in time, but will be discharged after the dirty-water reaches a certain liquid level. At this time, the dirty-water level detector 122*a* is configured to indicate whether the liquid level of dirty-water in the dirty-water storage space 122 reaches a preset liquid level. If the dirty-water level detector 122*a* detects that the dirty-water level reaches the preset liquid level, the control system of the docking station 100 may control discharging of the dirty-water (e.g., by controlling the air pump 300 and the waste discharge pump 310 to start working). Conversely, if the dirty-water level detector 122*a* detects that the dirty-water level does not reach the preset liquid level, the control system of the docking station 100 will not control the discharging of the dirty-water.

As shown in FIG. 19, for example, the dirty-water level detector 122*a* includes: a liquid level detection circuit and at least two detection probes 122*b* electrically connected to the liquid level detection circuit, the at least two detection probes 122*b* being mounted on the integrated box 120 and spaced apart. When the dirty-water level is below the maximum allowable dirty-water level in the dirty-water storage space 122, the at least two detection probes 122*b* spaced apart cannot be electrically connected to each other, and the liquid level detection circuit cannot form a pathway to detect the dirty-water level; and when the dirty-water level is equal to or higher than the maximum allowable dirty-water level in the dirty-water storage space 122, the dirty-water is in contact with the at least two detection probes 122*b*, so that the at least two detection probes 122*b* can be electrically connected, the detection probes and the liquid level detection circuit form a conductive pathway, and the liquid level detection circuit can detect a detection signal, and the reliability of the dirty-water level detector 122 of this structure is higher.

Figure 20:
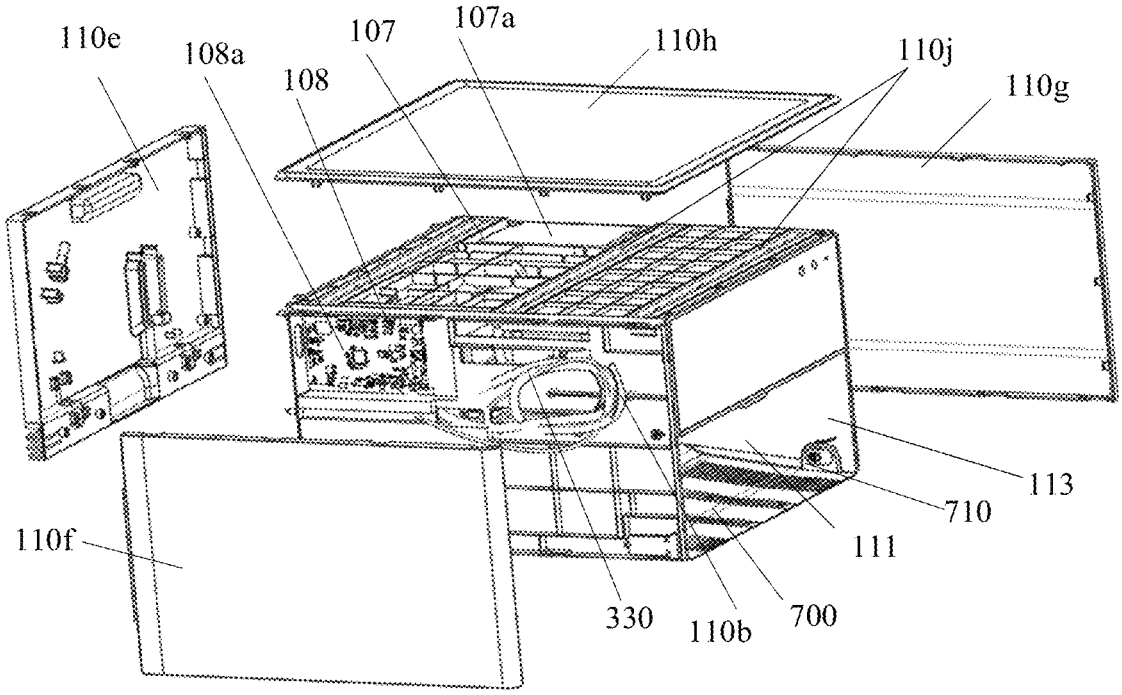
FIG. 20 shows a partial structure exploded view of a docking station in an embodiment of the present disclosure.

As shown in FIG. 20, in one embodiment, the inner housing 110*c* of the station body 110 further has: a first mounting groove 107 and a second mounting groove 108, the second mounting groove 108 and the first mounting groove 107 being arranged separately. One of the first mounting groove 107 and the second mounting groove 108 is configured to contain a strong electric module 107*a* of the docking station 100; and the other one of the first mounting groove 107 and the second mounting groove 107 is configured to contain a weak electric module 108*a* of the docking station; and the outer housing 110*d* of the station body 110 covers the first mounting groove 107 and the second mounting groove 108.

The strong electric module 107*a* includes a power line, and the weak electric module 108*a* may include a signal transmission line for communication. Without limitation, the above-mentioned main control module may be a main board in the weak electric module 108*a*.

Utilizing the first mounting groove 107 and the second mounting groove 108 that are arranged separately, separation of the strong electric module 107*a* and the weak electric module 108*a* can be realized, which ensures safety of using the docking station 100. Moreover, the first mounting groove 107 and the second mounting groove 108 can fully utilize a space between the inner housing 110*c* and the outer housing 110*d*, which can reduce the internal space occupation of the station body 110, and is favorable to reducing the volume of the docking station.

For example, the first mounting groove 107 is located on the top of the docking station 100 and the second mounting groove 108 is located on a side of the docking station 100.

As shown in FIG. 16*a*, in one embodiment, the rear housing 110*e* also has a fourth mounting groove 113*d*, the fourth mounting groove 113*d* being configured to contain a power line electrically connected to an external power source. Without limitation, the power line may be electrically connected to the strong electric module 107*a*.

The fourth mounting groove 113*d* may hide the power line so that the power line does not protrude from the rear housing 110*e*, which is not only more favorable to placing a rear wall of the docking station 100 against a wall, but also has a protective effect on the power line.

As shown in FIG. 20, in one embodiment, the docking station 100 further includes at least one reinforcing plate 110*h*, the at least one reinforcing plate 110*h* being mounted on the inner housing 110*c* and disposed between the inner housing 110*c* and the outer housing 110*d*. The reinforcing plate 110*h* may increase strength of the inner housing 110*c* and reduce collapse and deformation of the accommodating chamber 112 caused by insufficient strength of the inner housing 110*c*, which then affects the movement of the integrated box 120.

As shown in FIG. 20, for example, the top wall of the station body 110 may be considered to be jointly formed by the top wall of the inner housing 110*c* and the top wall of the outer housing 110*d*. The accommodating chamber 112 is defined by the top wall of the inner housing 110*c* together with side walls extending downwardly from the top wall of the inner housing 110*c*.

As shown in FIG. 20, in one embodiment, the outer housing 110*d* includes: an upper housing 110*h*, a left housing 110*f*, a right housing 110*g*, a rear housing 110*e*, and a front housing. At least one of the upper housing 110*h*, the left housing 110*f*, the right housing 110*g*, the rear housing 110*e*, and the front housing is detachably mounted on the inner housing 110*c*. Where, as shown in FIG. 9*a*, the front housing includes the exterior decorative panel 120*e* mounted on the integrated box 120, and/or, a storage door 160.

At least part of the outer housing 110*d* is detachable relative to the inner housing 110*c*, which facilitates a user to change the appearance of the docking station 100. For example, an outer housing 110*d* having a same material or color as a cabinet where the docking station 100 is embedded may be used, so that the docking station 100 is more matched to a user's desired home decoration style, and adaptability of the docking station 100 is improved.

In an embodiment of the present disclosure, a detachable mode includes, but is not limited to: a magnetic connection, a snap-fit connection, a bolt connection, etc.

As shown in FIG. 20, in one embodiment, the station body 110 further includes a base 700, which is detachably connected to the housing 113 of the station body 110 and located inside the docking chamber 111. The base 700 has a cleaning groove 111*c*, the cleaning groove 111*c* being configured to hold at least the cleaning assembly 510 of the self-moving cleaning apparatus 500. The cleaning groove 111*c* is a part of the docking chamber 111. The docking chamber 111 further includes a docking room located on the housing, the cleaning groove 111*c* and the docking room jointly forming the docking chamber 111. The docking room is used for holding at least a part of a machine body of the self-moving cleaning apparatus 500, and the cleaning assembly 510 is mounted below the machine body.

After the self-moving cleaning apparatus 500 enters the docking chamber 111, at least the cleaning element 512 in the cleaning assembly 510 is located in the cleaning groove 111*c*; and after the dirty-water generated by cleaning the cleaning element 512 is discharged out of the cleaning groove 111*c*, dirt will still be retained in the cleaning groove 111*c*, or for other reasons, dirt will be left on the base 700. Thus, it is necessary to clean the base 700 periodically. The base 700 will be detachably mounted below the housing, which facilitates removing the base 700 from the housing, and makes it easier to clean the dirt on the base 700.

As shown in FIG. 13*b* and FIG. 20, in one embodiment, the station body 110 further includes a latching assembly 710, which is connected to the base 700 and the housing. The latching assembly 710 is configured to: lock a connection between the base 700 and the housing, and unlock the connection between the base 700 and the housing.

Utilizing the latching assembly 710 to lock the base 700 can ensure reliability of the connection between the base 700 and the housing and reduce separation of the base 700 from the housing, the separation being caused by the self-moving cleaning apparatus 500 entering and exiting the docking chamber 111, maintenance of the self-moving cleaning apparatus 500, or other situations in which the docking station 100 would vibrate. Utilizing the latching assembly 710 to unlock the base 700 can facilitate removal of the base 700.

Figure 21A:
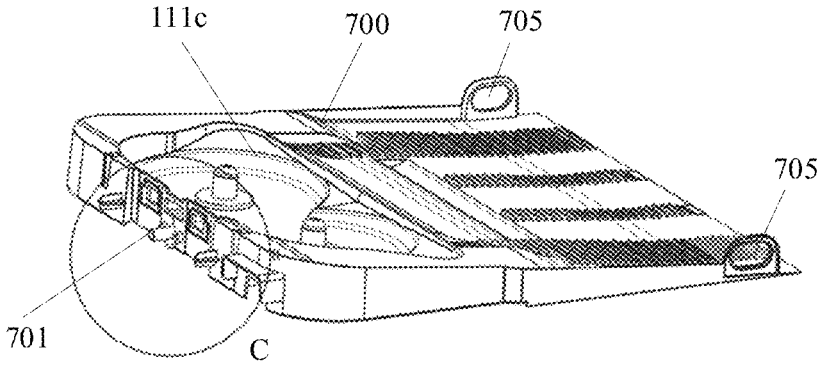
FIG. 21*a* shows a first partial structure diagram of a base in a docking station provided in an embodiment of the present disclosure.
Figure 21B:
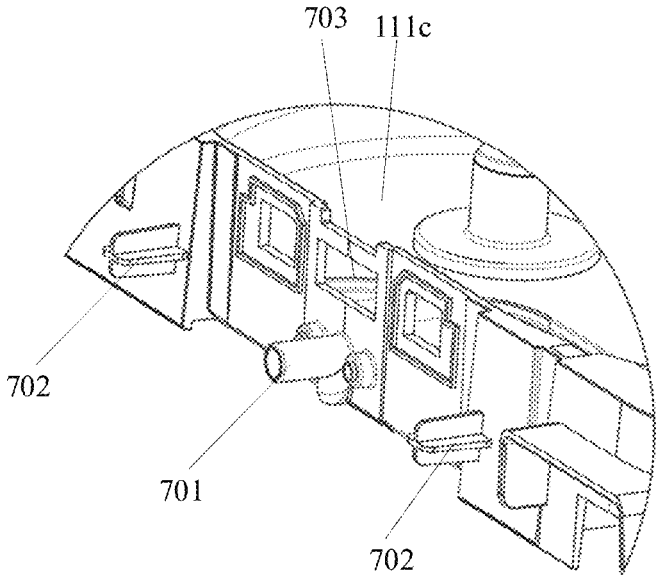
FIG. 21*b* shows a partial structure enlarged view of place C in FIG. 21*a*.
Figure 21C:
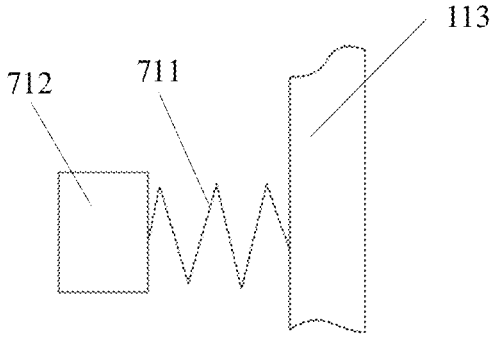
FIG. 21*c* shows a second partial structure diagram of a base in a docking station provided in an embodiment of the present disclosure.

As shown in FIG. 21*a* and FIG. 21*c*, the base 700 has avoidance holes 705. The latching assembly 710 includes: an elastic element 711 and a locking element 712, and two ends of the elastic element 711 are connected to the housing 113 and the locking element 712 respectively. The elastic element 711 is subjected to a force to be deformed, a distance between the elastic element 711 and the housing 113 is less than a distance between a hole wall of the avoidance hole 705 and the housing 113, and the base 700 is unlocked from the housing 113; after the external force is withdrawn, an elastic restoring force of the elastic element 711 drives the locking element 712 to pass through the avoidance hole 705, and the base 700 and the housing 113 are locked.

When the base 700 is connected to the underside of the housing 113, the latching assembly 710 is in a locked state where the base 700 and the housing 113 are locked together. When it is necessary to detach the base 700 from the housing 113, a force may be applied to the latching assembly 710 to unlock the base 700 from the housing 113 to remove the base 700. After removing the base 700, the applied force may be withdrawn.

For example, the elastic element 711 may be a compression spring or an elastic strip. The locking element 712 realizes locking the base 700 to the housing 113 by abutting against the hole wall of the avoidance hole 705. The locking element 712 may be retracted by pressing of the elastic element 711, the locking element 712 is separated from the hole wall of the avoidance hole 705, and the locking element 712 cannot limit the base 700, thereby realizing unlocking.

Figure 21D:
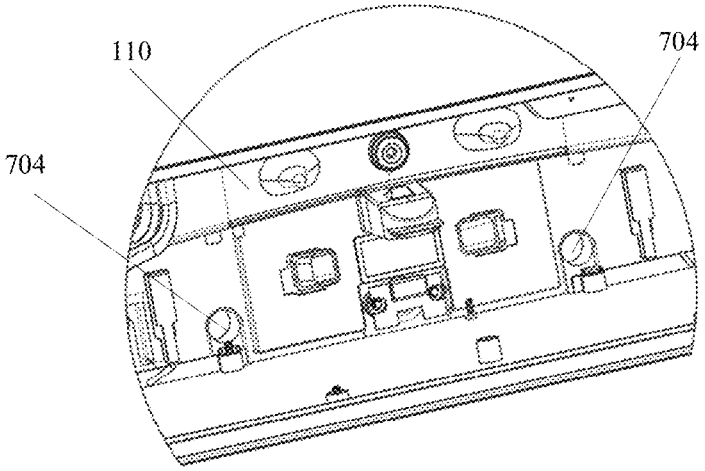
FIG. 21*d* shows a partial structure diagram of a housing mated with a structure shown in FIG. 21*b*.

As shown in FIG. 21*b* and FIG. 21*d*, the exterior of a side wall of the cleaning groove 111*c* includes a first insertion part; and the housing 113 includes a second insertion part at a position corresponding to the first insertion part, where the first insertion part and the second insertion part are docked with each other. The first insertion part is an insertion post 702, and the second insertion part is an insertion hole 704; or, the second insertion part is an insertion post, and the first insertion part is an insertion hole. The insertion post 702 is inserted into the insertion hole 704. The radial profile of the insertion post 702 is a cross shape, which increases strength of the insertion post 702 and ensures reliability of a connection between the insertion post 702 and the insertion hole 704.

For example, FIG. 21*b* and FIG. 21*d* show that the first insertion part is an insertion post 702 and the second insertion part is an insertion hole 704.

Figure 22:
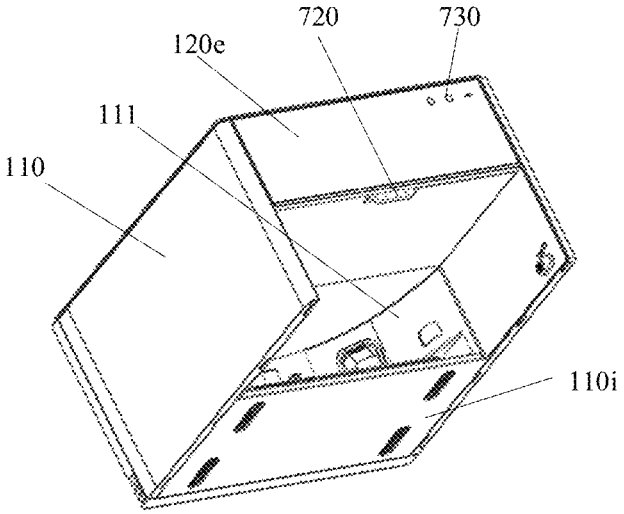
FIG. 22 shows a twentieth partial structure diagram of a docking station provided by an embodiment of the present disclosure.

As shown in FIG. 22, in one embodiment, the docking station 100 further includes: a base plate 110*i*, where the base plate 110*i* is connected to the station body 110, and at least a part of the base 700 is located between the base plate 110*i* and the station body 110.

When the docking station 100 is placed on the carrying surface, the docking station 100 may contact with the carrying surface through a bottom surface of the base plate 110*g*. Due to a controllable material and surface roughness of the base plate 110*i*, by providing the base plate 110*i*, the base 700 may be enabled to slide along a top surface of the base plate 110*i* when the base 700 is detached and mounted, which reduces a direct contact of the base 700 with the carrying surface, and thus can reduce abrasion of the base 700 and improve usage life of the base 700. Moreover, utilizing the base plate 110*i* to contact with the carrying surface can also ensure overall flatness of the docking station 100 and increase overall strength of the docking station 100.

As shown in FIGS. 21*a* and 21*b*, in one embodiment, the docking station 100 further includes: a waste discharge butting tube 701, where the waste discharge butting tube is connected with the cleaning groove 111*c* and located above a bottom wall of the cleaning groove 111*c*. The waste discharge butting tube 701 is connected to the waste inlet tube 192 to introduce dirty-water in the cleaning groove 111*c* into the dirty-water storage space 122 via the waste inlet tube 192. Height of at least a part of the waste discharge butting tube 701 is higher than height of the bottom wall of the cleaning groove 111*c*, which can reduce the flowing of dirty-water flowing out of the cleaning groove 111*c* back into the cleaning groove 111*c* and improve waste discharging effect.

In one embodiment, the base 700 further includes a fifth sealing element, the fifth sealing element being hermetically connected to the waste discharge butting tube 701 and the waste inlet tube 192, to realize sealing of a joint between the waste discharge butting tube 701 and the waste inlet tube 192 and to reduce dirty-water leakage at the joint between the waste discharge butting tube 701 and the waste inlet tube 192.

The fifth sealing element may be a rubber sealing ring, but is not limited to this.

As shown in FIG. 21*a* and FIG. 21*b*, in one embodiment, a side wall of the cleaning groove 111*c* has a through hole corresponding to a light sterilization module; and the docking station further includes: the light sterilization module and a light transmission sheet 703. The light sterilization module is mounted on the housing 113 of the station body 110; the light transmission sheet 703 is hermetically connected to a hole wall of the through hole; and the light transmission sheet 703 is used for transmitting light emitted by the light sterilization module.

The light sterilization module can sterilize the cleaning groove 111*c* and reduce unpleasant odor generated after the cleaning assembly 510 is cleaned. The light transmission sheet 703 can transmit the light emitted by the light sterilization module to ensure a function of the light sterilization module, and can also play a waterproof role to prevent liquid in the cleaning groove 111*c* from entering the outside of the cleaning groove 111*c* via the through hole, and at least reduce an effect of the liquid on the light sterilization module.

Without limitation, the light sterilization module may be a UV (ultraviolet) sterilization module.

For example, the light transmission sheet 703 may be a glass sheet or a transparent plastic sheet.

As shown in FIG. 2 and FIG. 4*a*, the station body 110 further includes: a cleaning plate 780 in contact with the cleaning assembly 510, the cleaning plate 780 being detachably mounted in the cleaning groove 111*c*.

The cleaning plate 780 is in direct contact with the cleaning element 512 of the self-moving cleaning apparatus 500 which needs to be cleaned, thereby realizing cleaning of the cleaning element 512 and improving a cleaning effect on the self-moving cleaning apparatus 500. The cleaning plate 780 is prone to residual dirt after being used for many times. The cleaning plate 780 being detachable can facilitate removal of the cleaning plate 780 from the cleaning groove 111*c*, which facilitates cleaning of the cleaning plate 780.

For example, the cleaning plate 780 includes a cleaning rib with a plurality of protruding points, and utilizing the cleaning rib can improve the cleaning effect on the cleaning element 512.

In one embodiment, the docking station 100 further includes: a third in-position detector, the third in-position detector is mounted on the base 700. The third in-position detector is configured to detect whether the cleaning plate 780 is mounted in place in the cleaning groove 111*c*, and, to detect whether the cleaning assembly 510 of the self-moving cleaning apparatus 500 is mounted in place in the cleaning groove 111*c*.

Utilizing one third in-position detector can detect whether the cleaning plate 780 is mounted in place, and whether the cleaning assembly 510 of the self-moving cleaning apparatus 500 is mounted in place, that is, two applications, without the need to respectively provide two in-position detectors, which not only can cause cost of the third in-position detector to be low, but also is favorable to improving the internal space utilization of the docking station 100 and reducing the volume of the docking station 100.

For example, the third in-position detector may be disposed in the cleaning groove 111*c* and located below the cleaning plate 780.

Figure 21E:
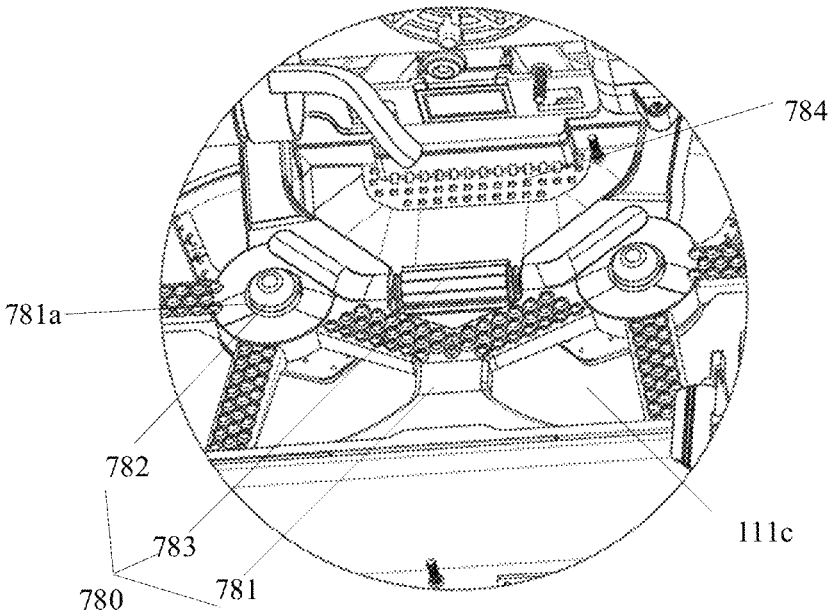
FIG. 21*e* shows a partial structure diagram of a docking station provided in an embodiment of the present disclosure, including a rotation shaft.

As shown in FIG. 21*e*, in one embodiment, the cleaning plate 780 includes: a cleaning plate holder 781, a drive assembly 782, and a rotation shaft 783, where the cleaning plate holder 781 has the cleaning rib described above; one part of the drive assembly 782 passes through a shaft hole 781*a* of the cleaning plate holder 781, and the other part of the drive assembly 782 is located below the cleaning plate holder 781; the rotation shaft 783 is connected to the drive assembly 782; and the drive assembly 782 is configured to connect with the cleaning assembly 510 of the self-moving cleaning apparatus 500. The third in-position detector is located below the rotation shaft 783.

Since the rotation shaft 783 is a part of the cleaning plate 780, the third in-position detector may realize in-position detection of the cleaning plate 780 through in-position detection of the rotation shaft 783. For example, the third in-position detector may detect two different detection signals X when the cleaning plate 780 is mounted in place in the cleaning groove 111*c* or when the cleaning plate 780 is not in the cleaning groove 111*c*, and thus whether the cleaning plate 780 is mounted in place in the cleaning groove 111*c* may be detected according to the third in-position detector.

When the self-moving cleaning apparatus 500 enters the docking chamber 111 and is mounted in place, the cleaning assembly 510 is connected to the part of the drive assembly 782 in the shaft hole 781*a*. And when the self-moving cleaning apparatus 500 is powered up, the cleaning assembly 510 rotates first, and then the cleaning assembly 510 drives the drive assembly 782 to rotate, the rotating drive assembly 782 then drives the rotation shaft 783 to rotate. If the self-moving cleaning apparatus 500 does not enter the docking chamber 111, i.e., when the self-moving cleaning apparatus 500 is not mounted in place on the base 700, the rotation shaft 783 will not rotate. Since the third in-position detector is located below the rotation shaft 783, it may output two different detection signals Y in two situations where the rotation shaft 782 rotates or not, and the detection signals Y are different from the detection signals X. Therefore, whether the cleaning assembly 510 is mounted in place in the cleaning groove 111*c* can also be detected according to the third in-position detector, which realizes multiplexing of the third in-position detector.

FIG. 21*e* further shows a filtering element 784 located above the waste discharge port.

For example, the third in-position detector is a Hall detector. Due to different heights of an inner wall of the cleaning groove 111*c* (i.e., the position where the third in-position detector is mounted), the cleaning plate 780, and the cleaning assembly 510, when the base 700 is mounted below the housing 113, the base 700 is not mounted below the housing 113, and the cleaning assembly 510 is located above the cleaning plate 780, the third in-position detector may detect three different Hall voltages, which realizes two detection applications of one third in-position detector.

Figure 23A:
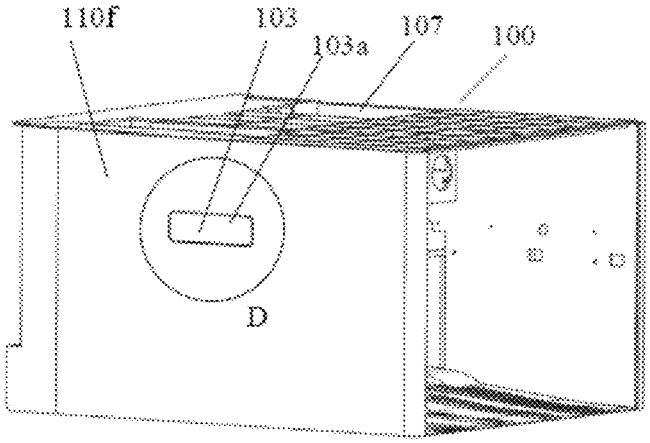
FIG. 23*a* shows a twenty-first partial structure diagram of a docking station provided by an embodiment of the present disclosure.

As shown in FIG. 16*a* and FIG. 23*a*, in one embodiment, the docking station 100 further includes a second handle structure 103. The second handle structure 103 is configured to drive the docking station 100 to change a placement location under an external force. As shown in FIG. 23*a*, the second handle structures 103 are respectively disposed on the left housing 110*f* and the right housing 110*g* of the station body 110; or, as shown in FIG. 16*a*, the second handle structure 103 is disposed on the rear housing 110*e* of the station body 110.

The docking station can be carried conveniently by utilizing the second handle structure 103.

In the embodiment shown in FIG. 23*a*, one second handle structure 103 is provided on each of two opposite sides of the station body 110 (e.g., the left housing 110*f* and the right housing 110*g*), and when in use, two hands each need to use one second handle structure 103 to achieve carrying.

In the embodiment shown in FIG. 16*a*, the carrying of the docking station may be realized with one hand pulling the second handle structure 103 on the rear housing 110*e* and the other hand aided by the top wall of the docking chamber 111. Thus, in FIG. 16*a*, the carrying of the docking station 100 can be realized by using one second handle structure 103, which is simpler in the structure. Moreover, in FIG. 16*a*, the second handle structure 103 is disposed on the rear housing 110*e*, and when the docking station 100 is placed, the rear housing 110*e* is usually placed against a wall and easily hidden, therefore, integrity of the docking station 100 in the embodiment shown in FIG. 16*a* is better.

As shown in FIG. 23*a*, the housing 110*d* of the station body 110 is provided with a third mounting groove 109; the second handle structure 103 includes: a handle 103*a*, and a drive element connected to the handle 103*a*. The drive element is configured to: provide a drive force for the handle 103*a* to be switched between a protruded state and a hidden state. When the handle 103*a* is in the protruded state, at least a part of the handle 103*a* protrudes from the housing 110*d*; and when the handle 103*a* is in the hidden state, an exterior surface of the handle 103*a* is flush with an exterior surface of the housing 110*d*. The housing 110*d* includes the left housing 110*f* and the right housing 110*g*; or, the housing 110*d* includes the rear housing 110*e*.

When there is a need to use the second handle structure 103 (for example, when there is a need to carry the docking station 100), the handle 103*a* may be set in the protruded state so as to apply an external force to the handle 103*a*. When there is no need to use the second handle structure 103, the handle 103*a* may be set in the hidden state so as to make an exterior surface of the housing 113 remain flat, which is favorable to ensuring the integrity of the appearance of the docking station 100 and improving usage experience.

For example, a drive element may be utilized to drive the handle to rotate, and with different rotation angles, the handle 103*a* may be in the protruded state and the hidden state.

The drive element may be a motor. Alternatively, as shown in FIG. 23*b*, the drive element is a driving torsional spring 103*b*.

Figure 23B:
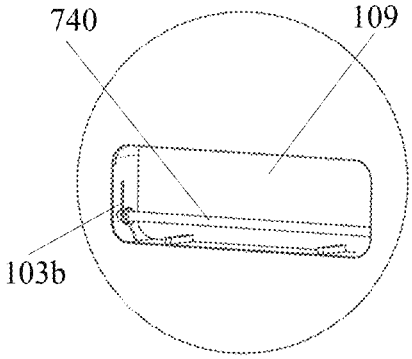
FIG. 23*b* shows a structural enlarged view of place D in FIG. 23*a*.

In the embodiment shown in FIG. 23*b*, the second handle structure 103 includes the handle 103*a*, the driving torsional spring 103*b*, and a mounting shaft 740. Both ends of the mounting shaft 740 are connected to a side wall of the third mounting groove 109, the driving torsional spring 103*b* is disposed on the mounting shaft 740, and two ends of the driving torsional spring 103*b* are connected to the housing 113 and the handle 103*a* respectively. When subjected to an external force transmitted from the handle, the driving torsional spring 103*b* undergoes deformation, and the handle 103*a* may be flipped over to be in the protruded state. After the external force applied to the driving torsional spring 103*b* disappears, the driving torsion spring 103*b* restores from deformation, and a deformation restoration force will drive the handle 103*a* to restore to be the hidden state.

In one embodiment, the second handle 103 may be a groove shown in FIG. 16*a*.

As shown in FIG. 24, in one embodiment, the docking station 100 further includes: a roller 713, the roller 713 being mounted at the bottom of the station body 110. When the docking station 100 is placed in an embedded mode, with the aid of the roller 713, the docking station 100 may be pulled out of an embedded space or pushed into the embedded space more conveniently. Thus, the roller 713 may assist in fetching and placing the docking station 100.

For example, the roller 713 is located at a rear of the station body 100. The roller 713 being located at the rear of the station body 100 includes, but is not limited to: that it is close to a rear wall of the station body 110, or that the roller 713 is connected to a rear wall of the station body 110.

In one embodiment, the roller 713 is two in number, and two rollers 713 are located at both sides of the rear of the station body 110 respectively. Or, the number of the roller 713 is one, and the one roller 713 is located in a center of the rear of the station body 110. Or, the number of the roller 713 is three or more, and the three or more rollers 713 may be spaced apart evenly at the rear of the station body 110.

For example, the roller 713 may be close to the rear housing 110*e*.

As shown in FIG. 13*b*, FIG. 20, and FIG. 22, in one embodiment, the docking station 100 further includes: a pickup module 720, the pickup module 720 being mounted on the exterior decorative panel 120*e*.

The pickup module 720 may recognize a voice to facilitate interaction of the docking station 100 with a user's target electronic device, thereby facilitating the user to operate and control the docking station.

Mounting the pickup module 720 on the exterior decorative panel 120*e* can reduce shielding of the pickup module 720 and ensure sensitivity and accuracy of acquiring an audio signal by the pickup module 720.

As shown in FIG. 13*b*, FIG. 20, and FIG. 22, in one embodiment, the docking station 100 further includes: an interaction module 730 mounted on the exterior decorative panel 120*e*. The interaction module 730 includes at least a button for controlling the movement of the integrated box 120. The interaction module 730 may be utilized to receive an instruction from a user, thereby realizing control of the docking station and improving the usage experience.

For example, the interaction module 730 may further include: a button for controlling the functional cover 120*f* to be open or closed, a button for controlling the lifting assembly to be open or closed, a button for controlling the rotation assembly 40 to rotate or stop rotating, etc. The button for controlling the functional cover 120*f* to be open or closed includes: a button for controlling the top cover of the cleaning agent tank to be open or closed, a button for controlling the top cover of the dirty-water tank to be open or closed, a button for controlling the top cover of the dust collection box to be open or closed, etc.

The buttons may be physical buttons or virtual buttons. In addition, the interaction module 730 may also include a display screen.

The embodiments of the present disclosure further provide a cleaning system, the cleaning system including the docking station 100 and the self-moving cleaning apparatus 500 described in any one of the above-mentioned embodiments.

Figure 25A:
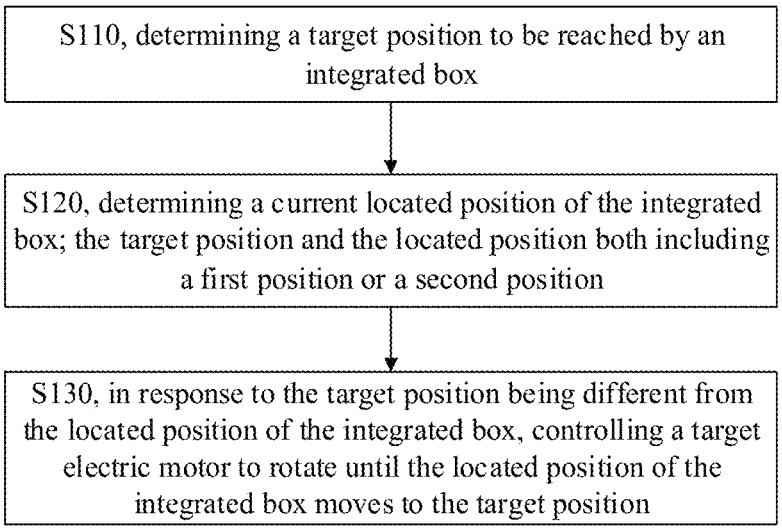
FIG. 25*a* shows a first flow diagram of a control method in an embodiment of the present disclosure.

As shown in FIG. 25*a*, the embodiments of the present disclosure further provide a control method applied to the docking station 100 described in the above-mentioned embodiments, and the method includes following steps:

- step S110, determining a target position to be reached by an integrated box 120;
- step S120, determining a current located position of the integrated box 120; the target position and the located position both including a first position or a second position;
- step S130, in response to the target position being different from the located position of the integrated box 120, controlling a target motor to rotate until the integrated box 120 moves to the target position; where the target motor is a motor in the docking station 100 which drives the integrated box 120 to move.

In step S110, the docking station 100 may automatically determine the target position. For example, if it is detected that a fault occurs in the integrated box 120, the target position is automatically determined to be the second position to better remind a user to find out and deal with the fault in time.

Alternatively, the docking station 100 may also passively determine the target position. For example, the docking station 100 determines the target position according to a detected control instruction. For example, if a control instruction indicative of moving the integrated box 120 to the second position is received from a target electronic device, the control instruction is executed.

The target electronic device includes, but is not limited to: a cell phone, a tablet computer, a television, a wearable device, etc.

In step S120, in one embodiment, the located position of the integrated box 120 may also be any position between the first position and the second position. If the located position of the integrated box 120 is between the first position and the second position, the target position may be determined according to interaction instruction indication or according to a state of a functional space 124, and then whether to control the integrated box 120 to move to the first position or to move to the second position is determined according to the target position.

The located position of the integrated box 120 may be different from the target position; or the located position of the integrated box 120 may be the same as the target position.

In one embodiment, step S120 may also be performed before step S110.

For example, step S120 includes: determining, according to detection information of the first in-position detector 155, the located position of the integrated box 120; or, determining, according to historical information of a movement of the integrated box 120, the located position of the integrated box 120.

For example, if the detection information of the first in-position detector 155 indicates that the integrated box 120 is in the first position, the located position of the integrated box 120 is also the first position; conversely, if the detection information of the first in-position detector 155 indicates that the integrated box 120 is not in the first position, the located position of the integrated box 120 is regarded as the second position.

The historical information of the movement of the integrated box 120 may at least record position information of the integrated box 120 at a current moment, and the located position of the integrated box 120 may be determined according to the historical information. The historical information may be information stored in a memory of the docking station 100; or, the historical information may also be information stored in a memory of the target electronic device, in this case, the docking station 100 may acquire the historical information sent by the target electronic device through information interaction with the target electronic device.

In step S130, in some embodiments, if the located position of the integrated box 120 is the same as the target position, the target motor may be stationary to keep the located position of the integrated box 120 unchanged.

For example, maintaining the target motor to be stationary may be not energizing the target motor.

In an embodiment of the present disclosure, a moving direction of the motor is determined according to the target position and the current located position of the integrated box 120, which realizes automatic control of the movement of the integrated box 120 and facilitates the docking station 100 to replace consumables in a lower space.

In one embodiment, the control method may further include:

in response to the integrated box 120 being in the second position, controlling, according to a first control information, the rotation assembly to drive the integrated box 120 to swing relative to the station body 110; or, controlling, according to a second control information, the lifting assembly to drive the functional module to enter or exit the functional space 124, to further facilitate fetching and placing a consumable.

Without limitation, the first control information and the second control information may be interaction instructions obtained by analyzing voice information acquired by a pickup module 720, or, interaction instructions detected by an interaction module 730.

The detection information of the first in-position detector 155 when the integrated box 120 is in the first position is different from the detection information of the first in-position detector 155 when the integrated box 120 is not in the first position. Thus, the detection information may be utilized to determine whether the integrated box 120 is in the first position.

Figure 25B:
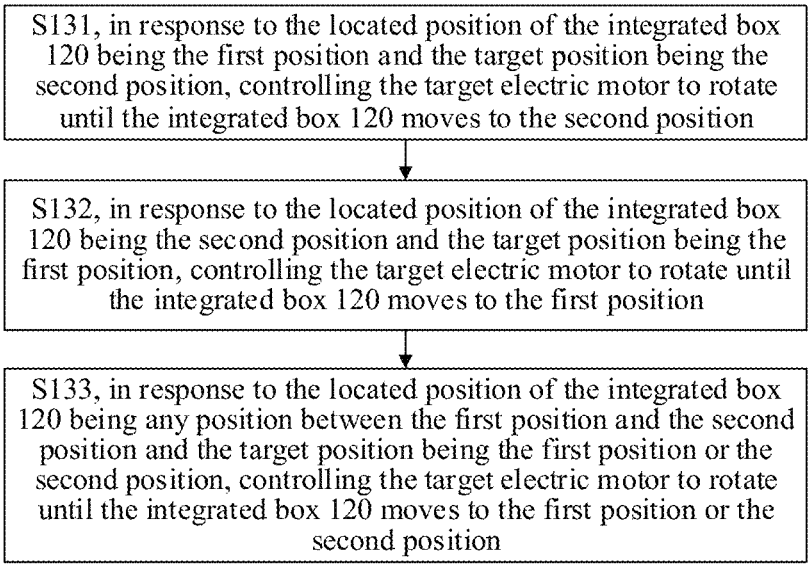
FIG. 25*b* shows a second flow diagram of a control method in an embodiment of the present disclosure.

As shown in FIG. 25*b*, in one embodiment, step S130 includes any one of following steps:

S131, in response to the located position of the integrated box 120 being the first position and the target position being the second position, controlling the target motor to rotate until the integrated box 120 moves to the second position;

S132, in response to the located position of the integrated box 120 being the second position and the target position being the first position, controlling the target motor to rotate until the integrated box 120 moves to the first position;

S133, in response to the located position of the integrated box 120 being any position between the first position and the second position and the target position being the first position or the second position, controlling the target motor to rotate until the integrated box 120 moves to the first position or the second position.

For example, if at least one first in-position detector 155 is utilized, whether the located position of the integrated box 120 is the first position, the second position, or any position between the first position and the second position may be determined. In this case, steps S131 to step S133 may each include: determining, according to the detection information of the first in-position detector 155, whether the integrated box 120 moves to the second position or the first position.

For example, when the first in-position detector 155 includes the first Hall sensor and the second Hall sensor described above, whether the integrated box 120 reaches the first position may be determined according to detection information of the first Hall sensor, and whether the integrated box 120 reaches the second position may be determined according to detection information of the second Hall sensor.

As another example, when the first in-position detector 155 includes the second Hall sensor described above and a non-Hall sensor, whether the integrated box 120 reaches the second position may be determined according to the detection information of the second Hall sensor, and whether the integrated box 120 reaches the first position may be determined according to detection information of the non-Hall sensor. The non-Hall sensor includes, but is not limited to: a photoelectric position sensor.

Figure 25C:
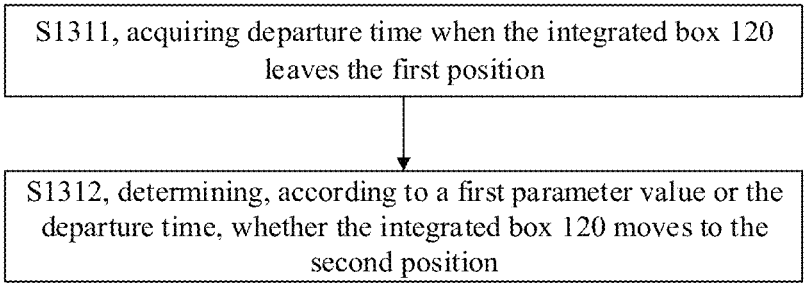
FIG. 25*c* shows a third flow diagram of a control method in an embodiment of the present disclosure.

For example, if the docking station 100 includes only one first in-position detector 155 and the in-position detector 155 is only configured to determine whether the integrated box 120 reaches the first position, a software method may be utilized to determine whether the integrated box 120 reaches the second position. For example, as shown in FIG. 25*c*, the above-mentioned step S131 may include:

S1311, acquiring departure time when the integrated box 120 leaves the first position;

S1312, determining, according to a first parameter or the departure time, whether the integrated box 120 moves to the second position.

In one embodiment, time may be counted from the departure time, and if the counted time reaches a certain time, it is indicated that the integrated box 120 has moved to the second position.

Thus, whether the integrated box 120 is in the second position may be determined by a first parameter value or the departure time.

For example, the first in-position detector 155 is the first Hall sensor described above, whether the integrated box 120 reaches the first position may be determined according to the detection information of the first Hall sensor, and whether the integrated box 120 reaches the second position may be determined according to the departure time.

For example, the first in-position detector 155 is the non-Hall sensor described above, whether the integrated box 120 reaches the first position may be determined according to the detection information of the non-Hall sensor, and whether the integrated box 120 reaches the second position may be determined according to the departure time.

In one embodiment, the step S1312 includes:

counting a first preset time duration with the departure time when the integrated box 120 leaves the first position as an initial time, and determining, according to a relationship between the first preset time duration and a second threshold value, whether the integrated box 120 is in the second position.

As the counted time increases, the target motor drives the integrated box 120 to move towards the second position for a longer time, indicating that the integrated box 120 is closer to the second position. When the counted time reaches the second threshold value, it is indicated that the integrated box 120 reaches the second position.

The second threshold may be 6 s, 7 s, or 8*s*.

In one embodiment, the determining, according to a relationship between the time after the integrated box 120 is away from the first position and the second threshold value, whether the integrated box 120 is in the second position includes:

in a case that the first preset time duration after the integrated box 120 is away from the first position is equal to the second threshold value, determining that the integrated box 120 is in the second position.

In one embodiment, if the time after the integrated box 120 is away from the first position is less than the second threshold value, it is determined that the integrated box 120 does not reach the second position and the integrated box 120 is in a certain position between the first position and the second position.

In one embodiment, the control method further includes: in response to the fact that an occurrence number of a first difference value being greater than or equal to a first threshold value is greater than or equal to a first preset number, generating a first control instruction, where the first control instruction indicates that: the target motor rotates in a direction opposite to a current rotating direction for a second preset time duration, and the first difference value is a difference value between a first parameter value of the target motor and a preset parameter value.

For example, the first parameter value may be a current value.

For example, the first parameter value is noted as Y (also known as transient operating current), and the preset parameter value is noted as X (also known as initial operating current). Taking the first threshold value being 100 mA and the first preset number being 5 as an example, if an occurrence number that $Y-X \geq 100$ mA is equal to 5, it is indicated that the target motor is blocked, and overcurrent protection will be triggered, the target motor will stop rotating and reverse for 1 s, to play a protective role for the target motor.

For example, the preset parameter value means: an average value of a plurality of second parameter values cumulatively detected per unit of time when the integrated box 120 enters and exits an accommodating chamber 112. The second parameter value and the first parameter value are both current values.

For example, when the integrated box 120 is in the first position, current data of the target motor is acquired every 20 ms for 5 times, and an average value thereof is taken as initial current data (i.e., the preset parameter value).

Entering and exiting the accommodating chamber 112 refers to that: in a process of the integrated box 120 moving from the first position to the second position or moving from the second position to the first position, there is no rotor blocking, stall, or other unforeseen circumstances in the target motor which drives the integrated box 120 to move.

Alternatively, the preset parameter value may also be determined according to a second parameter value detected at an initial movement of the integrated box 120. The second parameter value detected at the initial movement refers to: a second parameter value detected when the integrated box 120 just leaves the first position, or a second parameter value detected when the integrated box just leaves the second position.

Without limitation, the first threshold value may be 90 mA, 100 mA, 105 mA, 110 mA, or 120 mA, etc.

In an embodiment of the present disclosure, the second preset time duration may be 20 ms, 25 ms, or 30 ms, etc.

Without limitation, the first preset number is 4, 5, 6 or 7.

For example, the first parameter value is noted as Y (also known as the transient operating current), and the preset parameter value is noted as X. Taking the first threshold value being 100 mA and the first preset number being 5 as an example, if the occurrence number that $Y-X \geq 100$ mA is equal to 5, it is indicated that the integrated box 120 reaches the second position.

The first parameter value may be acquired for the first time at the departure time, or, the first parameter value may be acquired for the first time at a first second preset time duration after the departure time. The first parameter value is acquired repeatedly, and first difference value between each first parameter value and the preset parameter value is calculated. If the occurrence number that the first difference value is greater than or equal to the first threshold value is equal to the first preset number, it is determined that the integrated box 120 has moved to the second position.

If a large first difference value is still detected when the integrated box 120 is in the second position, it is indicated that the target motor may be blocked, and at this time, the target motor is controlled to rotate in a direction opposite to a current rotating direction for a second preset time duration, which can effectively protect the target motor.

For example, taking the first preset number being 5 as an example, if it is detected that a rotating direction of the target motor is a target direction, a first difference value starts to be determined according to the detected first parameter value;

and if it is detected that the first difference value is greater than or equal to the first threshold value for 5 times, it is indicated that the target motor of the integrated box 120 is blocked, and at this time, it is necessary to control the target motor to rotate in a direction opposite to the target direction for the second preset time duration (for example, changing from a clockwise rotation to an anticlockwise rotation for 1 s).

The second preset duration may be 1 s, 1.5 s or 2 s, etc., but is not limited to this.

In one embodiment, the control method further includes: in response to an occurrence number per unit of time that the first in-position detector 155 satisfies a condition of not being triggered being greater than or equal to a second preset number, generating notification information, the notification information indicating that the first in-position detector 155 fails. Where, the condition of not being triggered includes that: the integrated box 120 moves from the second position to the first position, and the detection information of the first in-position detector 155 is not detected within a third preset time duration, or, the detection information of the first in-position detector 155 within the third preset time duration indicates that the integrated box 120 does not reach the first position.

For example, whether the integrated box 120 moves from the second position to the first position may be determined according to a rotating direction of the target motor or according to an executed control instruction. For example, if the rotating direction of the target motor is opposite to the target direction, it is determined that the integrated box 120 moves from the second position to the first position. As another example, if the docking station 100 executes a control instruction of moving to the first position, it is indicated that the rotating target motor is driving the integrated box 120 to move to the first position.

Without limitation, the control instruction is an interaction instruction from a user. For example, the control instruction may be an interaction instruction obtained by analyzing voice information acquired by the pickup module 720 on the docking station 100, or an interaction instruction detected by the interaction module 730, or an interaction instruction received by the docking station 100 from the target electronic device.

In one embodiment, after step S132, the control method further includes: in response to the integrated box 120 reaching the first position, adjusting an operating mode of the target motor to a braking mode to increase difficulty of moving the integrated box 120.

Generally, if the target position is the first position, it may be indicated that the docking station 100 needs to perform maintenance on the self-moving cleaning apparatus 500, and at this point, the target motor is adjusted to the braking mode, which can ensure the reliability of the first position and reduce vibration generated by a maintenance operation of the docking station 100 which causes the integrated box 120 to detach from the first position.

Without limitation, the braking mode may refer to: configuring the GPIO (General Purpose Input Output) port to a braking mode (IN1&2H&H). In one embodiment, the control method further includes: in response to a dust collection fan 170 of the docking station 100 being in a non-operational state, determining, according to the detection information of the first in-position detector 155, whether the integrated box 120 is in the first position.

Vibration that is generated by the dust collection fan 170 in an operational state may cause an error in detection of the first in-position detector 155, reducing accuracy of the first in-position detector 155. When the dust collection fan 120 is in the operational state, the integrated box 120 is in the first position correspondingly; and only after the dust collection fan 120 completes dust collection operation, an operation of moving the integrated box 120 will be executed. Thus, when the dust collection fan 170 is in the non-operational state, whether the integrated box 120 is in the first position is determined according to the detection information of the first in-position detector 155, which can ensure a normal operation of the docking station 100.

In one embodiment, when the dust collection fan 170 is in the operational state, whether the integrated box 120 is in the first position is not determined according to the detection information of the first in-position detector 155. For example, when the dust collection fan 170 is in the operational state, an operation of the first in-position detector 155 may be stopped, which is favorable to saving energy.

In one embodiment, the step S110 includes: determining the target position according to an operational status of the docking station 100.

The docking station 100 may detect its own operational status and automatically determine the target position according to the operational status.

The operational status includes: a usage status of a consumable in the docking station 100, and/or, a status of maintenance of the self-moving cleaning apparatus 500 by the docking station 100.

In one embodiment, the determining the target position according to the operational status of the docking station 100 includes: determining the target position according to the usage status of the consumable in the docking station 100; and/or, determining the target position according to the status of the maintenance of the self-moving cleaning apparatus 500 by the docking station 100.

If the usage status of the consumable indicates that the consumable needs to be replaced, the target position is determined to be the second location, and the functional space 124 is exposed to the external environment to facilitate the user to replace the consumable.

If the docking station 100 is performing maintenance on the self-moving cleaning apparatus 500, the target position is determined to be the first location; conversely, if the docking station 100 does not perform maintenance on the self-moving cleaning apparatus 500, the integrated box 120 may stay at a currently located position, or, the target position may be determined according to own needs of the docking station 100 or according to an detected interaction instruction.

In one embodiment, the determining the target position according to the usage status of the consumable in the docking station 100 includes:

in response to the usage status of the consumable meeting a preset condition, determining the second location to be the target position; where the preset condition includes at least one of the following: a dust bag in a dust collection space 121 reaches a first preset amount, a liquid level of cleaning liquid in a cleaning liquid storage space 123 is lower than a preset liquid level, a dust bag is not detected in the dust collection space 121, and dirt on a filter mesh in a dirty-water storage space 122 reaches a second preset amount.

In one embodiment, in response to the usage status of the consumable not meeting the preset condition, the integrated box 120 stays at the current located position.

In one embodiment, the control method further includes: in response to the usage status of the consumable meeting the preset condition, generating reminder information;

where the reminder information serves as a reminder of replacing or replenishing the consumable.

The reminder information may timely remind a user that the consumable needs to be replaced or replenished to ensure the normal operation of the docking station 100. The replacement includes, but is not limited to, replacing a dust collection bag, and the replenishment includes, but is not limited to, replenishing the cleaning liquid.

For example, after the reminder information is generated, the control method may further include at least one of the following: displaying the reminder information at the interaction module 730, playing a reminder audio corresponding to the reminder information utilizing a voice playing module on the docking station 100, and sending the reminder information to the target electronic device to utilize the target electronic device to remind the user.

In one embodiment, the control method further includes: in response to the usage status of the consumable meeting the preset condition and a fourth preset time duration for which the integrated box 120 is in the second position being greater than a third threshold value, controlling the target motor to rotate until the integrated box 120 moves to the first position; and in response to the fact that a number of the integrated box 120 being switched between the first position and the second position reaches a second preset number, controlling the integrated box 120 to stay at the first position.

If it is detected that the consumable needs to be replaced and the integrated box 120 is ejected to the second position within a fourth preset time duration, the integrated box 120 will retract to the first position regardless of whether a user replaces the consumable. If the integrated box 110 has retracted to the first position and it is found that the consumable has not been replaced, the integrated box 110 will be ejected to the second position again, and is switched between the first position and the second position repeatedly in such a way until a number of switching reaches a second preset number, then the integrated box 120 is no longer ejected, so that the integrated box 120 stays at the first position. This situation is suitable for a special scenario where no one is available to deal with the consumable. For example, the user is not at home and cannot replace the consumable.

Without limitation, the second preset number may be 3, 4 or 5, etc. The third threshold value may be 20 min, 30 min or 60 min, etc.

In one embodiment, the determining the target position according to the status of the maintenance of the self-moving cleaning apparatus 500 by the docking station 100 includes: if a number of the docking station 100 collecting dust from the self-moving cleaning apparatus 500 is greater than or equal to a fourth threshold value, determining the second position to be the target position.

The fourth threshold value may be 5, 6, 7, 8, 10 or 15, etc.

After a number of dust collection reaches the fourth threshold value, it is indicated that an amount of dust in the dust bag is likely to reach an upper limit and the dust bag needs to be replaced. At this time, the target position is determined to be the second position so that the integrated box 120 can be removed from the accommodating chamber 112 and the dust bag can be replaced more conveniently.

In one embodiment, the step S110 includes:

determining a first control instruction;

determining the target position according to the first control instruction.

For example, the first control instruction may be an interaction instruction. For example, the first control instruction may include at least one of the following: an interaction instruction obtained by analyzing voice information acquired by the pickup module 720 on the docking station 100, or an interaction instruction detected by the interaction module 730, or an interaction instruction received by the docking station 100 from the target electronic device. Alternatively, the first control instruction may also be: an instruction received by the docking station 100 from the self-moving cleaning apparatus 500.

In one embodiment, the determining the first control instruction includes:

acquiring first voice information acquired by the pickup module 720 in the docking station 100, and/or, second voice information collected by the self-moving cleaning apparatus 500; and determining, according to the first voice information or the second voice information, the first control instruction.

In one embodiment, the self-moving cleaning apparatus 500 is provided with a voice recognition module, and the self-moving cleaning apparatus 500 acquires the second voice information by utilizing the voice recognition module.

After the voice recognition module of the self-moving cleaning apparatus 500 receives an instruction, the self-moving cleaning apparatus 500 may perform a task corresponding to the corresponding instruction. Without limitation, the docking station 100 may establish a wireless communication connection with the self-moving cleaning apparatus 500.

The docking station 100 is equipped with a processing chip, and the processing chip may be utilized to realize that the voice information detected by the pickup module 720 can be recognized in an offline or online state, and a recognition result obtained by recognizing the voice information is sent to the self-moving cleaning apparatus 500 by means of a wireless communication or transmitted to the self-moving cleaning apparatus 500 through a micro controller unit (MCU) in the docking station 100.

A wireless communication method between the docking station 100 and the self-moving cleaning apparatus 500 includes, but is not limited to: infrared, wifi, Bluetooth, etc.

In one embodiment, the determining, according to the first voice information or the second voice information, the second control instruction includes:

in response to the self-moving cleaning apparatus 500 being located in the docking chamber 111, determining, according to the first voice information, the second control instruction.

If the self-moving cleaning apparatus 500 is located in the docking chamber 111, the voice recognition module on the self-moving cleaning apparatus 500 is easily shielded, while the pickup module 720 of the docking station 100 is not shielded, thus, the docking station 100 can obtain clearer and more accurate voice information. Therefore, utilizing the first voice information of the docking station 100 to determine the second control instruction is favorable to improving interaction accuracy.

In one embodiment, the determining, according to the first voice information or the second voice information, the second control instruction includes:

in response to the self-moving cleaning apparatus 500 being located outside the docking chamber 111, determining confidence coefficients of the first voice information and the second voice information; and determining, according to the confidence coefficients, the second control instruction.

If the self-moving cleaning apparatus 500 is located outside the docking chamber 111, both the self-moving cleaning apparatus 500 and the docking station 100 can obtain clear and reliable voice information, and thus both the first voice information and the second voice information may be utilized to determine the second control instruction. If both the self-moving cleaning apparatus 500 and the docking station 100 receive a control instruction, the second control instruction may be determined according to the voice information having a higher confidence coefficient from the confidence coefficients of the first voice information and the second voice information, ensuring the interaction accuracy.

In one embodiment, the determining the confidence coefficients of the first voice information and the second voice information includes:

determining, according to a first user priority corresponding to the first voice information and a second user priority corresponding to the second voice information, the confidence coefficients; and in response to the first user priority being greater than the second user priority, determining that the confidence coefficient of the first voice information is higher than the confidence coefficient of the second voice information; or, in response to the second user priority being greater than the first user priority, determining that the confidence coefficient of the second voice information is higher than the confidence coefficient of the first voice information.

In one embodiment, the determining the confidence coefficients of the first voice information and the second voice information includes:

determining, according to voice quality of the first voice information and voice quality of the second voice information, the confidence coefficients.

For example, the voice quality may be a signal-to-noise ratio. If a signal-to-noise ratio of the first voice information is higher than a signal-to-noise ratio of the second voice information, it is indicated that the confidence coefficient of the first voice information is greater than the confidence coefficient of the second voice information; and conversely, if the signal-to-noise ratio of the second voice information is higher than the signal-to-noise ratio of the first voice information, it is indicated that the confidence coefficient of the second voice information is greater than the confidence coefficient of the first voice information.

In one embodiment, the determining the second control instruction includes:

detecting touch information in the interaction module 730; and determining, according to the touch information, the second control instruction.

The touch information includes, but is not limited to: touch information generated by touching a physical button with an operation such as pressing or rotating, or, touch information generated by touching a virtual button in a touch screen with an operation such as single-clicking, double-clicking, long-pressing, or flicking.

The interaction module 730 may include the physical button or the touch screen as described above. The touch information is obtained by using the interaction module 730 to receive a user operation.

For example, if different instruction labels can be displayed on the touch screen of the interaction module 730, an instruction label corresponding to the user operation may be determined according to a coordinate position of the user operation, and thus an instruction corresponding to the instruction label may be used as the second control instruction.

According to one embodiment, the control method further includes: in response to the waste discharge pump 200 and/or the dust collection fan 170 being in a operational state and a button for controlling the movement of the integrated box 120 being triggered, stopping operations of the cleaning agent transfer pump 770, the waste discharge pump 200, and the dust collection fan 170. When the waste discharge pump 200 is performing a waste discharge operation, and/or, the dust collection fan 170 is performing a dust collection operation, the integrated box 120 may be removed out of the accommodating chamber 112 if the button for controlling the movement of the integrated box 120 is touched by accident. At this time, the operations of the cleaning agent transfer pump 770, the waste discharge pump 200, and the dust collection fan 170 are stopped, thereby reducing malfunctions of the docking station 100 due to the functional space 124 being not in position.

Figure 26:
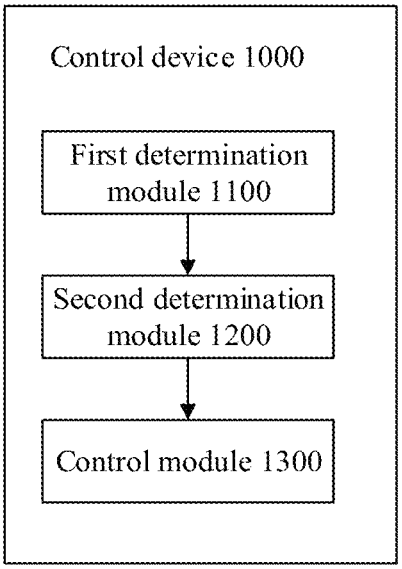
FIG. 26 is a structure block diagram of a control device in an embodiment of the present disclosure.

As shown in FIG. 26, the embodiments of the present disclosure further provide a control device 1000 applied to the docking station 100 described in the above embodiments, the device 1000 including:

a first determination module 1100 configured to determine a target position to be reached by an integrated box 120;

a second determination module 1200 configured to determine a current located position of the integrated box 120, the target position and the located position both including a first position or a second position; and a control module 1300 configured to in response to the target position being different from the located position of the integrated box 120, control a target motor to rotate until the integrated box 120 moves to the target position, where the target motor is a motor in the docking station 100 which drives the integrated box 120 to move.

In one embodiment, the control module is configured to at least one of the following:

in response to the located position of the integrated box 120 being the first position and the target position being the second position, control the target motor to rotate until the integrated box 120 moves to the second position;

in response to the located position of the integrated box 120 being the second position and the target position is the first position, control the target motor to rotate until the integrated box 120 moves to the first position; and in response to the located position of the integrated box 120 being any position between the first position and the second position and the target position is the first position or the second position, control the target motor to rotate until the integrated box 120 moves to the first position or the second position.

In one embodiment, the second determination module is configured to:

determine, according to the detection information of the first in-position detector 155, whether the integrated box 120 is in the first position.

In one embodiment, the control module is configured to:

in response to the integrated box 120 leaving the first position, obtain a first parameter value of the target motor, where the first parameter value is an electrical signal parameter value when the target motor is operating;

acquire departure time when the integrated box 120 leaves the first position; and determine, according to the first parameter value or the departure time, whether the integrated box 120 moves to the second position.

In one embodiment, the control module is configured to:

count a first preset time duration with the departure time when the integrated box 120 leaves the first position being initial time, and determine, according to a relationship between the first preset time duration and a second threshold value, whether the integrated box 120 is in the second position.

In one embodiment, the control module is configured to:

in a case that the first preset time duration that the integrated box 120 is away from the first position is equal to the second threshold value, determine that the integrated box 120 is in the second position.

In one embodiment, if the time that the integrated box 120 is away from the first position is less than the second threshold value, it is determined that the integrated box 120 does not reach the second position but is in a certain position between the first position and the second position.

In one embodiment, the control device further includes:

a first generation module, configured to: in response to the fact that an occurrence number of a first difference value being greater than or equal to a first threshold value is greater than or equal to a first preset number, generate a first control instruction, where the first control instruction indicates that the target motor rotates in a direction opposite to a current rotating direction for a first preset time, and the second difference value is a difference value between the first parameter value of the target motor and a preset parameter value.

In one embodiment, the preset parameter value is an average value of a plurality of second parameter values cumulatively detected per unit of time when the integrated box 120 enters and exits an accommodating chamber 112.

In one embodiment, the control device further includes:

a second generation module, configured to: in response to the fact that a number per unit of time of the first in-position detector 155 satisfying an condition of not being triggered is greater than or equal to a second preset number, generate notification information, the notification information indicating that the first in-position detector 155 fails; where the condition of not being triggered includes that: the integrated box 120 moves from the second position to the first position, and the detection information of the first in-position detector 155 is not detected within the second preset time, or, the detection information of the first in-position detector 155 within the second preset time indicates that the integrated box 120 does not reach the first position.

In one embodiment, the control module is configured to:

in response to the dust collection fan 170 of the docking station 100 being in a non-operational state, determine, according to the detection information of the first in-position detector 155, whether the integrated box 120 is in the first position.

In one embodiment, the first determination module is configured to:

determine the target position according to an operational status of the docking station 100.

In one embodiment, the first determination module is configured to:

determine the target position according to a usage status of a consumable in the docking station 100; and/or determine the target position according to a status of maintenance of the self-moving cleaning apparatus 500 by the docking station 100.

In one embodiment, the first determination module is configured to:

in response to the usage status of the consumable satisfying a preset condition, determine the second location to be the target position, where the preset condition includes at least one of the following:

a dust bag in a dust collection space 121 reaches a first preset amount;

a liquid level of cleaning agent in a cleaning agent storage space 123 is lower than a preset liquid level;

the dust bag is not detected in the dust collection space 121; and the dirt on a filter mesh in a dirty-water storage space 122 reaches a second preset amount.

In one embodiment, the device further includes:

a third generation module configured to in response to the usage status of the consumable satisfying the preset condition, generate reminder information; where the reminder information serves as a reminder of replacing the consumable.

In one embodiment, the device further includes: a processing module, the processing module being configured to: in response to the usage status of the consumable satisfying the preset condition and a third preset time duration for which the integrated box 120 is in the second position being greater than a third threshold value, control the target motor to rotate until the integrated box 120 moves to the first position; and in response to the fact that a number of the integrated box 120 being switched between the first position and the second position reaches a second preset number, control the integrated box 120 to stay at the first position.

In one embodiment, the first determination module is configured to:

if a number of the docking station 100 collecting dust from the self-moving cleaning apparatus 500 is greater than or equal to a fourth threshold value, determine the second position to be the target position.

In one embodiment, the first determination module is configured to:

determine a second control instruction; and determine the target position according to the second control instruction.

In one embodiment, the first determination module is configured to:

acquire a first voice information acquired by the pickup module 720 in the docking station 100, and/or, a second voice information collected by the self-moving cleaning apparatus 500; and determine, according to the first voice information or the second voice information, the second control instruction.

In one embodiment, the first determination module is configured to:

in response to the self-moving cleaning apparatus 500 being located in the docking chamber 111, determine, according to the first voice information, the second control instruction; or in response to the self-moving cleaning apparatus 500 being located outside the docking chamber 111, determine a confidence coefficient of the first voice information and a confidence coefficient of the second voice information; and determine, according to the confidence coefficient, the second control instruction.

In one embodiment, the first determination module is configured to:

detect touch information in the interaction module 730; and determine, according to the touch information, the second control instruction.

The embodiments of the present disclosure further provide a docking station 100, the docking station 100 including: a processor and a memory for storing computer service capable of running on the processor, where the methods described in the above-mentioned embodiments are implemented when the processor is configured to execute the computer service.

The embodiments of the present disclosure further provide a storage medium having a computer executable instruction, which, when being executed by the processor, implements the methods described in the above-mentioned embodiments.

On the premise of no conflict, different embodiments or different technical features in the present disclosure may be arbitrarily combined to form new embodiments.

It should be noted that, the terms used herein are intended only to describe specific embodiments and not intended to limit the exemplary embodiments according to the present disclosure. As used herein, a singular form is intended to include a plural form as well, unless otherwise indicated in the context clearly. In addition, it should also be understood that when terms "comprise" and/or "include" are used in this specification, they indicate the presence of features, steps, operations, devices, components, and/or combinations thereof.

Unless otherwise specifically described, a relative arrangement, a numerical expression and a value of the components and the steps set forth in these embodiments do not limit the scope of the present disclosure. At the same time, it should be understood that the size of each part shown in the drawings is not drawn in an actual proportional relationship for the sake of description. Techniques, methods, and devices known to persons of ordinary skill in the relevant field may not be discussed in detail, but where appropriate, the techniques, methods, and devices should be considered as a part of the authorized specification. In all of the examples shown and discussed herein, any specific value should be interpreted as merely exemplary and not as limitations. Thus, other examples of an exemplary embodiment may have different values. It should be noted that: similar reference signs and letters represent similar items in the following drawings, and thus, once an item is defined in a drawing, no further discussion thereof is required in the subsequent drawings.

In the description of the present disclosure, it should be understood that orientations or positional relationships indicated by nouns of locality such as "front", "rear", "top", "below", "left", "right", "lateral", "vertical", "perpendicular", "horizontal" and "top", "bottom", etc., are generally based on orientations or positional relationships shown in the drawings and are intended only to facilitate the description of the present disclosure and to simplify the description. In the absence of any explanation to the contrary, these nouns of locality do not indicate and imply that the apparatus or element referred to must have a particular orientation or be constructed and operated in a particular orientation, and thus cannot be construed as a limitation on the protection scope of the present disclosure; and the nouns of locality "inside, outside" refer to the inside and the outside relative to contours of components themselves.

For the sake of description, spatial relative terms such as "on . . . ", "above . . . ", "on an upper surface of . . . ", "upper", etc., may be used herein to describe a spatial location relationship between one device or feature and other device or feature as shown in the drawings. It should be understood that the spatial relative terms are intended to contain different orientations in use or operation in addition to an orientation of a device depicted in the drawings. For example, if a device in the drawings is inverted, the device described as "above other device or structure" or "on top of other device or structure" would later be positioned as "below other device or structure" or "underneath other device or structure". Thus, an exemplary term "above . . . " may include two orientations of "above . . . " and "below . . . ". The device may also be positioned in other different ways (rotated by 90 degrees or in other orientations) and the spatial relative description used herein is explained accordingly.

In addition, it should be noted that the use of terms such as "first" and "second" to define parts is merely for the purpose of facilitating differentiation of corresponding parts, and the above-mentioned terms do not have special meanings if not otherwise declared, and thus cannot be construed as a limitation on the protection scope of the present disclosure.

The foregoing is only preferred embodiments of the present disclosure and is not intended to limit the present disclosure, and various changes and variations may be made to the present disclosure for those skilled in the art. Any modification, equivalent substitution, improvement, etc. made within the spirit and principle of the present disclosure shall be included in the protection scope of the present disclosure.

What is claimed is:

1. A docking station, comprising:

a station body having an accommodating chamber and a docking chamber for docking of a self-moving cleaning apparatus, wherein at least a part of space of the accommodating chamber is located above the docking chamber; and a storage door, used for covering the docking chamber, wherein a height of the docking station is less than 350 mm, wherein the station body further comprises: a latching assembly, a base, and a housing, wherein the latching assembly is connected to the base and the housing, respectively and is configured to: lock a connection of the base to the housing, and unlock the connection of the base to the housing.

2. The docking station according to claim 1, wherein a ratio of a height of the docking chamber to the height of the docking station is: 1/1.5 to 1/3.5.

3. The docking station according to claim 1, wherein the accommodating chamber has a functional space, and the functional space comprises at least two of following spaces: a dust collection space, a dirty-water storage space, and a cleaning agent storage space;

wherein a configuration of the spaces comprised in the functional space is any one of following modes:

all the spaces comprised in the functional space are horizontally arranged side by side above the docking chamber; or all the spaces comprised in the functional space are horizontally arranged side by side at a side of the docking chamber; or among all the spaces comprised in the functional space, one part of the spaces comprised in the functional space are horizontally arranged side by side above the docking chamber and the other part of the spaces comprised in the functional space are horizontally arranged side by side at the side of the docking chamber.

4. The docking station according to claim 3, wherein a chamber wall of the functional space forms an integrated box, and the integrated box comprises: a functional module, wherein the functional module is detachably mounted in the functional space and comprises at least one of: a dust collection box located in the dust collection space, a dirty-water tank located in the dirty-water storage space, and a cleaning agent tank located in the cleaning agent storage space.

5. A cleaning system, comprising: a self-moving cleaning apparatus, and a docking station, wherein the docking station comprises:

a station body having an accommodating chamber and a docking chamber for docking of the self-moving cleaning apparatus, wherein at least a part of space of the accommodating chamber is located above the docking chamber; and a storage door, used for covering the docking chamber, wherein a height of the docking station being less than 350 mm, wherein the station body further comprises: a latching assembly, a base, and a housing, wherein the latching assembly is connected to the base and the housing, respectively and is configured to: lock a connection of the base to the housing, and unlock the connection of the base to the housing.

6. The cleaning system according to claim 5, wherein the storage door is pivotally connected to the station body, for opening or closing of the docking chamber.

7. The cleaning system according to claim 5, wherein the accommodating chamber has a functional space, and a chamber wall of the functional space forms an integrated box; and the storage door is slidably connected to an exterior decorative panel of the integrated box, for opening or closing of the docking chamber.

8. The cleaning system according to claim 7, wherein a sliding direction of the storage door relative to the exterior decorative panel is perpendicular to a horizontal plane direction.

9. The cleaning system according to claim 7, wherein an interaction module is mounted on the exterior decorative panel and is configured to receive an instruction from a user to control the docking station.

10. The cleaning system according to claim 5, wherein a ratio of a height of the docking chamber to the height of the docking station is: 1/1.5 to 1/3.5.

11. The cleaning system according to claim 5, wherein the accommodating chamber has a functional space, and the functional space comprises at least two of following spaces: a dust collection space, a dirty-water storage space, and a cleaning agent storage space; and wherein a configuration of the spaces comprised in the functional space is any one of following modes:

all the spaces comprised in the functional space are horizontally arranged side by side above the docking chamber; or all the spaces comprised in the functional space are horizontally arranged side by side at a side of the docking chamber; or among all the spaces comprised in the functional space, one part of the spaces comprised in the functional space are horizontally arranged side by side above the docking chamber and the other part of the spaces comprised in the functional space are horizontally arranged side by side at the side of the docking chamber.

12. The docking station according to claim 1, wherein the storage door is pivotally connected to the station body, for opening or closing of the docking chamber.

13. The docking station according to claim 1, wherein the accommodating chamber has a functional space, and a chamber wall of the functional space forms an integrated box; and the storage door is slidably connected to an exterior decorative panel of the integrated box, for opening or closing of the docking chamber.

14. The docking station according to claim 13, wherein a sliding direction of the storage door relative to the exterior decorative panel is perpendicular to a horizontal plane direction.

15. The docking station according to claim 13, wherein an interaction module is mounted on the exterior decorative panel and is configured to receive an instruction from a user to control the docking station.

16. The docking station according to claim 3, wherein a chamber wall of the functional space forms an integrated box, and the integrated box has an operation window connected with the functional space, wherein a housing of the station body includes a movable cover, the movable cover has a closed state and an opened state with respect to the integrated box, when the movable cover is in the closed state, the movable cover covers the operation window; and when the movable cover is in the opened state, the operation window is exposed to an external environment.

17. The docking station according to claim 1, wherein the docking station further comprises:

a liquid inlet tube, the liquid inlet tube being configured to at least provide a cleaning liquid for cleaning a cleaning assembly of the self-moving cleaning apparatus; and a liquid inlet joint, wherein the liquid inlet joint is connected to the liquid inlet tube and is configured to be connected with an external water source to convey the cleaning liquid from the external water source to the liquid inlet tube, and the liquid inlet joint is rotatably connected to the liquid inlet tube.

18. The docking station according to claim 1, wherein the accommodating chamber has a functional space, and the docking station further comprises: a liquid outlet joint, wherein the liquid outlet joint is connected to a waste discharge tube, the waste discharge tube is configured for passage of dirty-water flowing out of the functional space, the liquid outlet joint is configured for passage of the dirty-water flowing out of the waste discharge tube, and the liquid outlet joint is rotatably connected to the waste discharge tube.

19. The docking station according to claim 1, wherein the base has an avoidance hole, the latching assembly comprises: an elastic element and a locking element, and two ends of the elastic element are connected to the housing and the locking element, respectively;

wherein a distance between the elastic element and the housing is less than a distance between a hole wall of the avoidance hole and the housing when the latching assembly unlocks the connection of the base to the housing, and the locking element passes through the avoidance hole when the latching assembly locks the connection of the base to the housing.

20. The cleaning system according to claim 5, wherein the base has an avoidance hole, the latching assembly comprises: an elastic element and a locking element, and two ends of the elastic element are connected to the housing and the locking element, respectively;

wherein a distance between the elastic element and the housing is less than a distance between a hole wall of the avoidance hole and the housing when the latching assembly unlocks the connection of the base to the housing, and the locking element passes through the avoidance hole when the latching assembly locks the connection of the base to the housing.

* * * * *